US006691497B1

(12) United States Patent
Rodgers

(10) Patent No.: US 6,691,497 B1
(45) Date of Patent: Feb. 17, 2004

(54) HUMANE HORSE HEADGEAR

(75) Inventor: William E. Rodgers, Streetsboro, OH (US)

(73) Assignee: Mondial Industries, Ltd., Hudson, OH (US)

( * ) Notice: Subject to any disclaimer, the term of this patent is extended or adjusted under 35 U.S.C. 154(b) by 0 days.

(21) Appl. No.: 10/208,296

(22) Filed: Jul. 30, 2002

Related U.S. Application Data

(63) Continuation-in-part of application No. 10/137,596, filed on May 2, 2002, now abandoned.

(51) Int. Cl.[7] ..... B68B 1/02; B68B 1/04
(52) U.S. Cl. ..... 54/6.1; 54/24
(58) Field of Search ..... 54/6.1, 6.2, 7, 54/12, 13, 24

(56) References Cited

U.S. PATENT DOCUMENTS

| | | | | |
|---|---|---|---|---|
| 293,108 A | * | 2/1884 | Sutphen | 54/6.1 |
| 565,681 A | * | 8/1896 | Hutton | 54/7 |
| 734,004 A | * | 7/1903 | Stiegler | 54/6.2 |
| 989,479 A | * | 4/1911 | Biggart | 54/7 |
| 1,015,165 A | * | 1/1912 | Fox | 54/6.1 |
| 3,318,069 A | * | 5/1967 | Cunard | 54/6.1 |
| 3,949,538 A | | 4/1976 | Woodruff | |
| 3,998,033 A | | 12/1976 | Watkins et al. | |
| 4,337,610 A | | 7/1982 | Taylor | |
| 4,343,136 A | | 8/1982 | LeTixerant et al. | |
| 4,459,795 A | | 7/1984 | LeTixerant | |
| 4,472,925 A | | 9/1984 | Woodruff | |
| 4,480,427 A | | 11/1984 | Conrad | |
| 4,495,752 A | | 1/1985 | Simpson | |
| 4,495,753 A | | 1/1985 | Simpson | |
| 4,524,569 A | | 6/1985 | Hanna | |
| 4,565,055 A | | 1/1986 | Simpson | |
| 4,722,171 A | | 2/1988 | Meroth | |
| 4,999,980 A | | 3/1991 | McGowan | |
| 5,079,904 A | | 1/1992 | Berube | |
| 5,086,611 A | | 2/1992 | Purdy | |
| 5,615,539 A | | 4/1997 | Graham | |
| 5,660,031 A | | 8/1997 | Clark | |
| 6,202,393 B1 | | 3/2001 | Myler et al. | |

FOREIGN PATENT DOCUMENTS

| | | |
|---|---|---|
| DE | 29720858 | 1/1998 |
| DE | 19731635 | 2/1998 |
| GB | 2264218 | 8/1993 |
| GB | 2310123 | 8/1997 |

OTHER PUBLICATIONS

Lea & Sachs, Inc.—"Woven & Knit Elastics"—www.leasachs.com—May 2002, pp. 1–3, U.S.—Internet.
State Line Tack, Inc., Catalog pp. 128, 131, 179, 180, 72, 73—Available as of Mar. 2002, U.S.
State Line Tack, Inc., "State Line Tack Premium Nylon Halter With Snap"—Jul. 23, 2002—www.statelinetack.com—U.S.—Internet.
Congress Leather, "Arabian Show Halters"—www.congressleather.com—pp. 1–3—U.S.—May 22, 2002—Internet.
Exclusively Arabian, Brown and Gold Halter—www.Egyptian–arabian.com—May 22, 2002—pp. 1–3—Internet.

(List continued on next page.)

*Primary Examiner*—Robert P. Swiatek
(74) *Attorney, Agent, or Firm*—Reinhart Boerner Van Deuren s.c.

(57) ABSTRACT

A humane horse headgear having one or more portions, encircling and conforming to a horse's head, constructed, in whole or in part, of a resilient material, preferably exhibiting elastic properties, softness and conformability to the horse's head at one or more pressure points on the horse's head. A contoured crown piece and a curb device are also disclosed.

54 Claims, 36 Drawing Sheets

OTHER PUBLICATIONS

Show Stopper Tack, Inc., "SS Weymouth Show Bit"—www.showstoppertack.com—Jul. 19, 2002—pp. 1–3—U.S.—Internet.
Diamond R Saddlery, "Curb Chains, Straps & Headstalls"—www.diamondrsaddlery.com—Jul. 19, 2002—pp. 1–6—U.S.—Internet.
Turner's Saddlery & Western Wear, "BITS"—www.turner-saddlery.com—Jun. 20, 2002—pp. 1–4—U.S.—Internet.
Horse Data, "Points of a Bridle"—www.horsedata.co.uk/points_of_a_bridle.htm—2002—UK—Internet.
Brown Paula, "The Humble Halter—Worth a Second Look"—www.clipclop.com—May 22, 2002—pp. 1–3—U.S.—Internet.
Horse Health USA, "Riveted Leather Halters"—www.horsehealthusa.com—May 22, 2002—pp. 1—U.S.—Internet.

* cited by examiner

FIG. 12
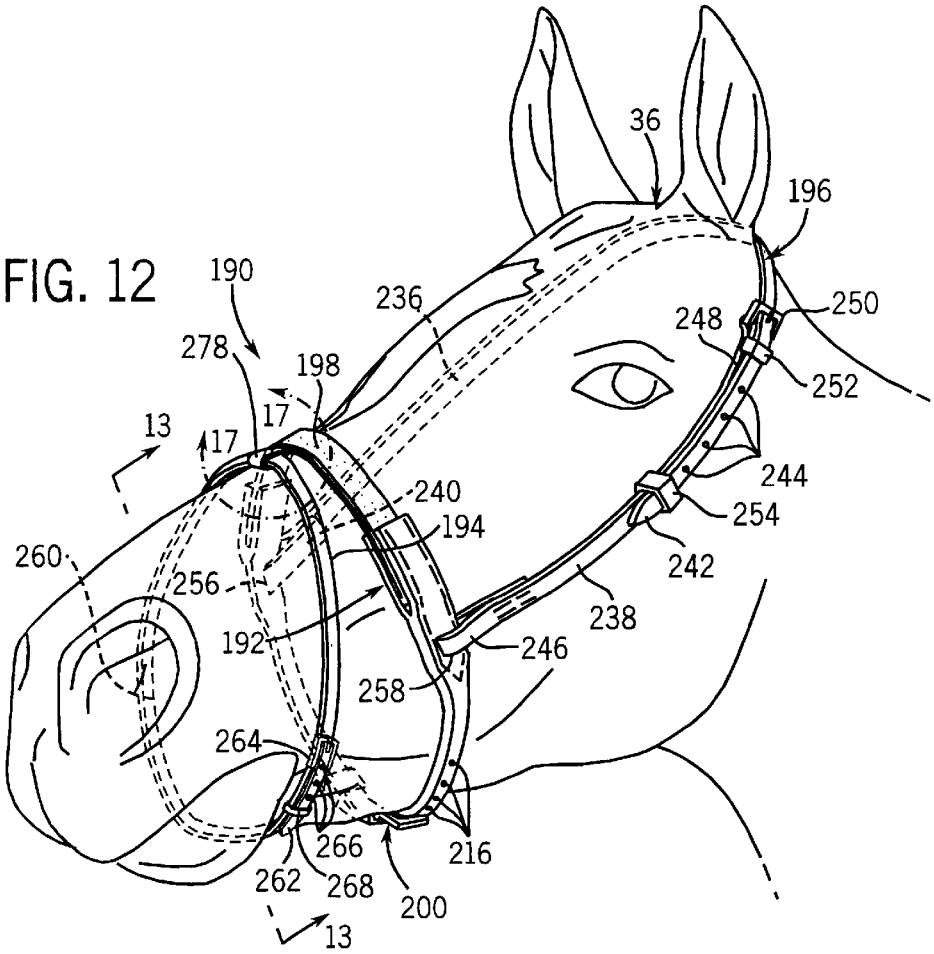
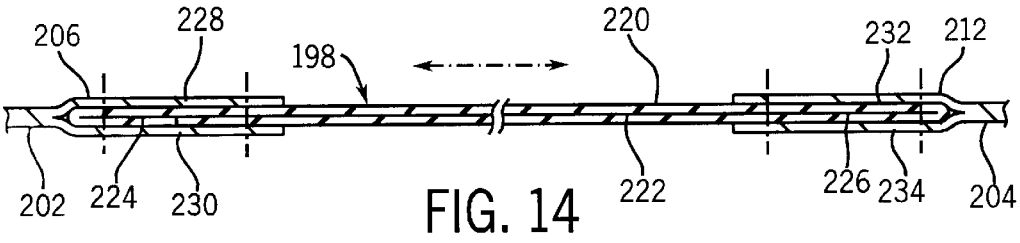
FIG. 14

FIG. 17
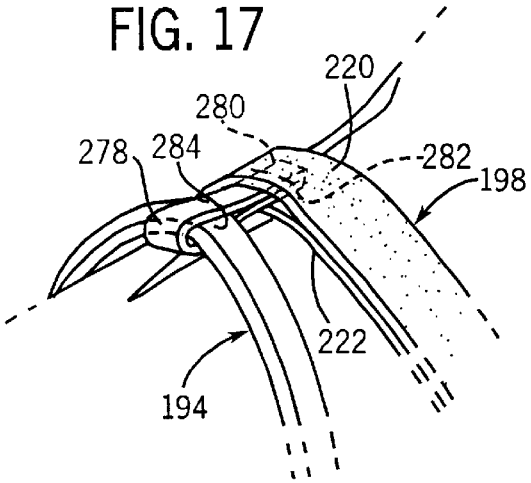
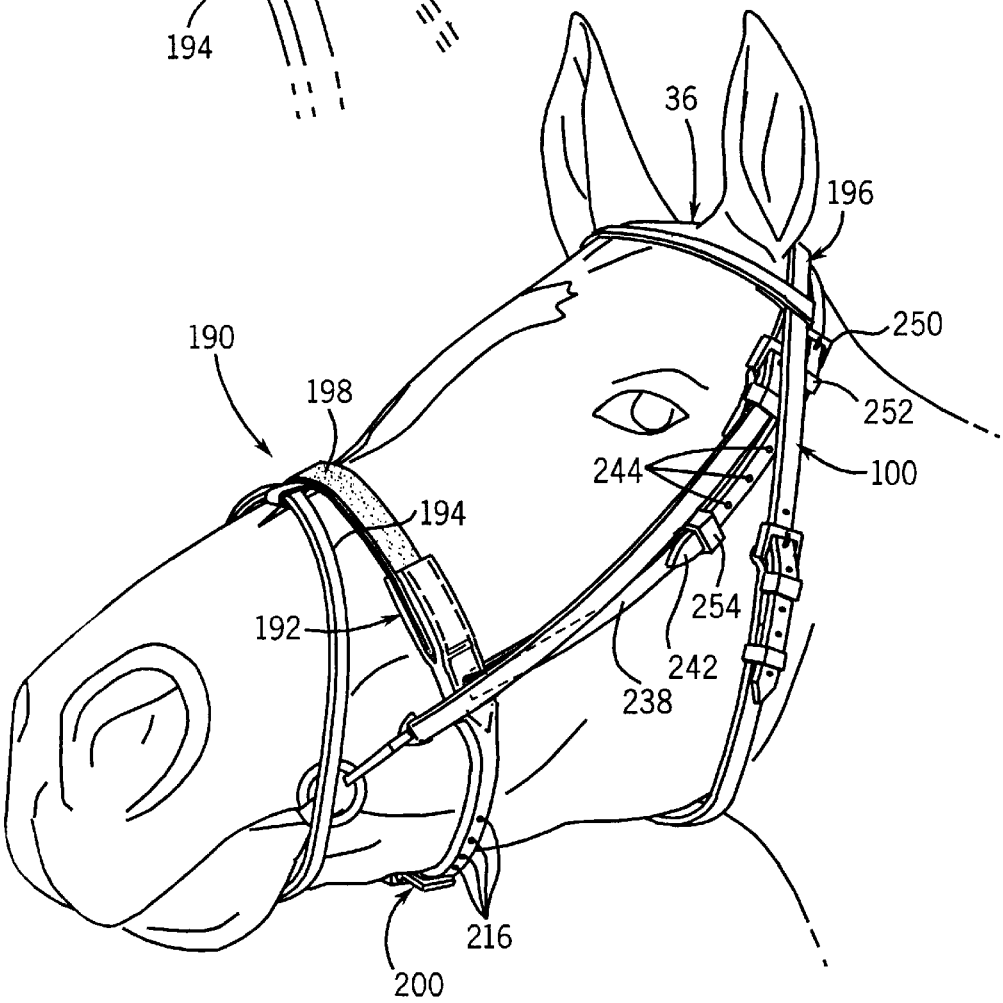
FIG. 18

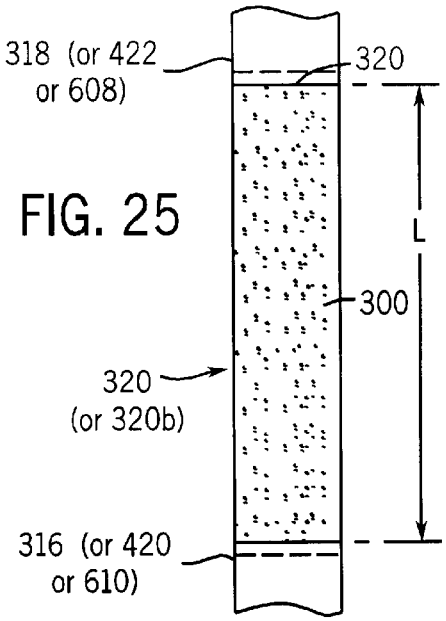
FIG. 25
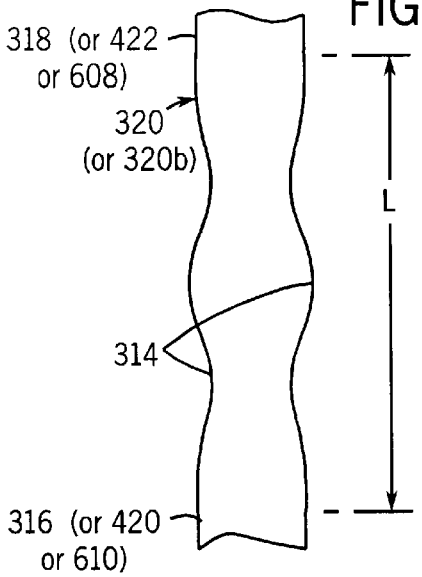
FIG. 26
FIG. 46
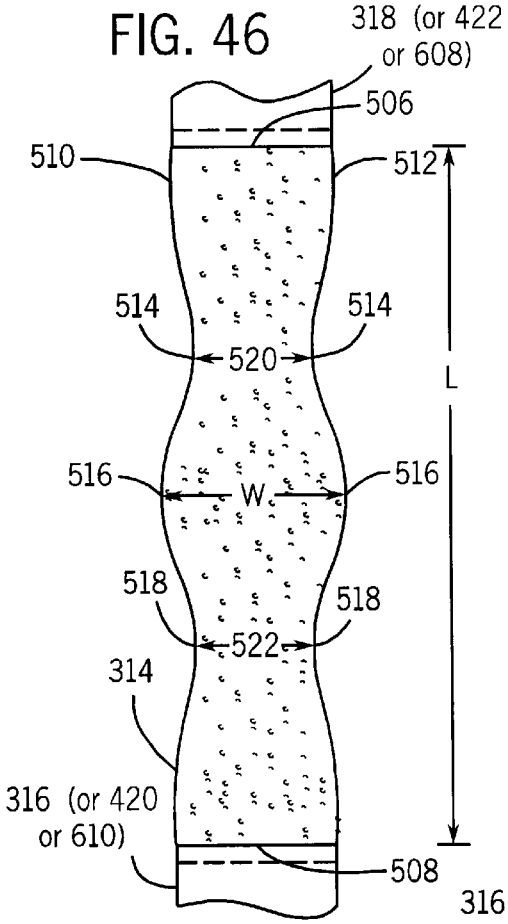
FIG. 47
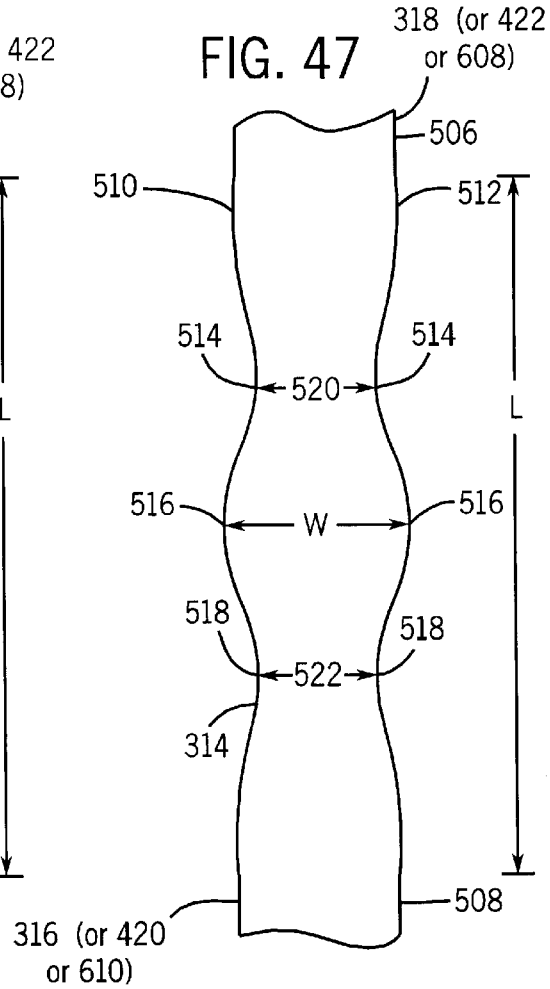

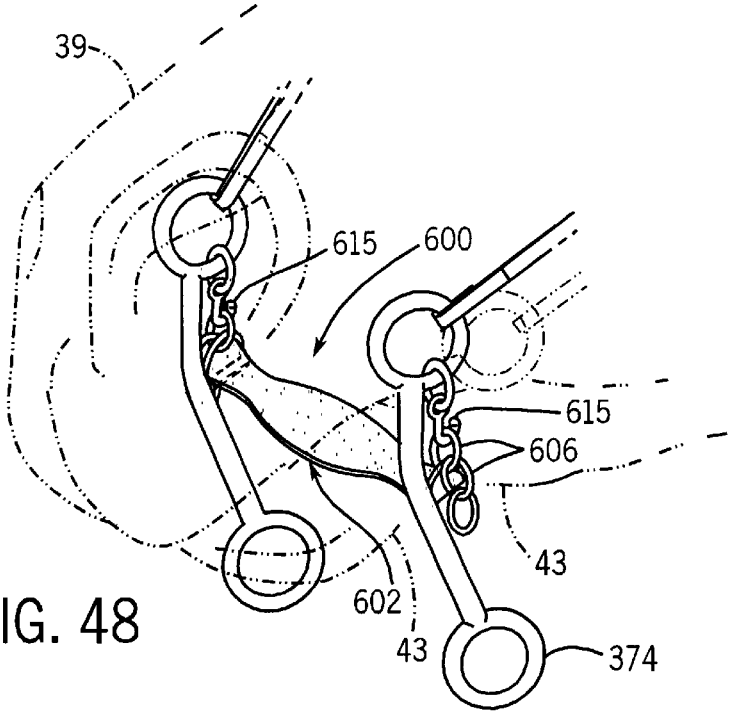
FIG. 48
FIG. 49
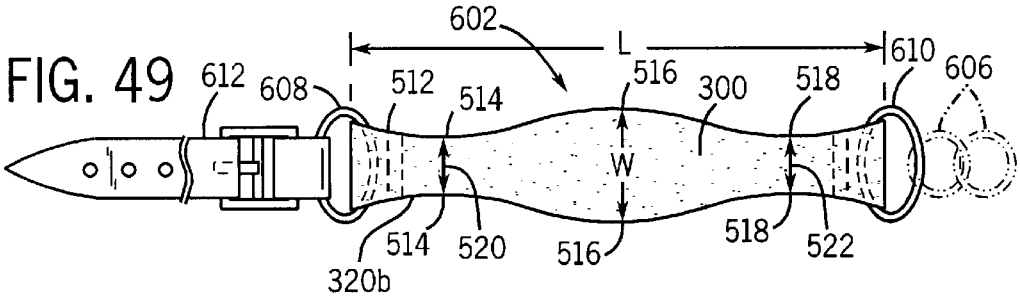
FIG. 50
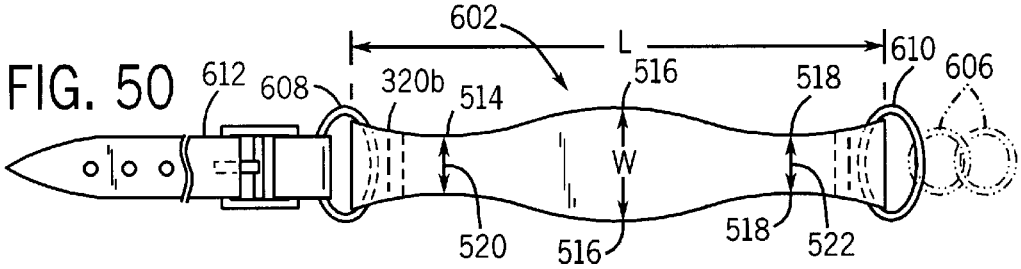

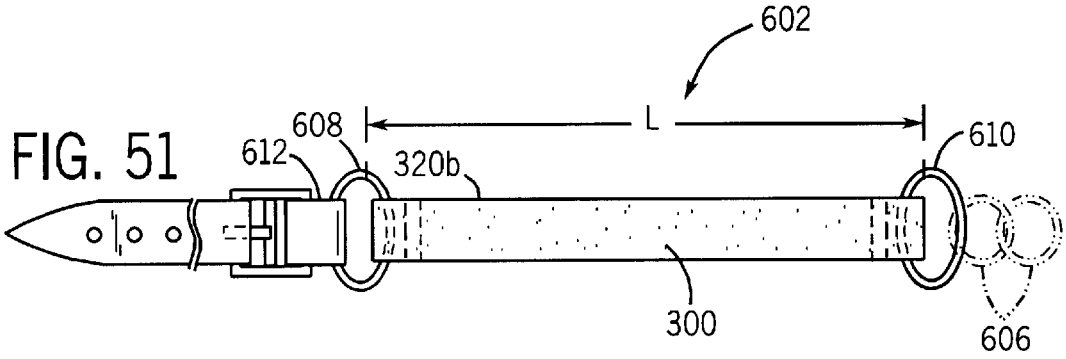
FIG. 51
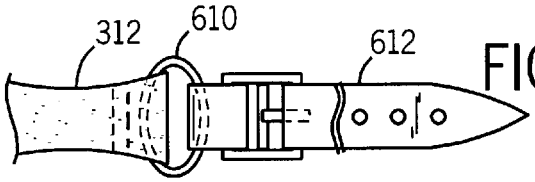
FIG. 52
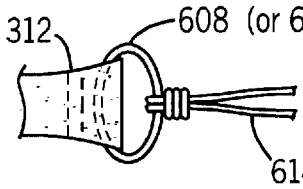
FIG. 53
FIG. 54
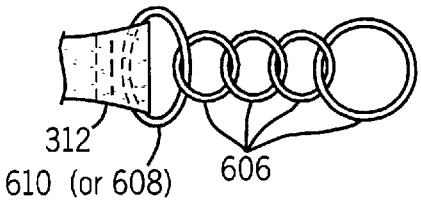

HUMANE HORSE HEADGEAR

This is a continuation-in-part of U.S. application Ser. No. 10/137,596 filed May 2, 2002, now abandoned, the disclosure of which is incorporated herein by reference.

BACKGROUND OF THE INVENTION

Field of the Invention

The present invention relates generally to tack used for a horse's headgear, e.g. cavesons, halters, bridles, crown pieces, curb chains and curb straps and more specifically to a horse's headgear for use in humanely controlling a horse's movements. The invention is particularly well-suited for a caveson for use with horses in which the caveson allows for limited movement of the horse's mouth, for a halter which permits limited movement of the horse's head in an upward direction and keeps the horse's mouth soft, and for a bridle which permits limited movement of the horse's head in an upward direction and for a contoured crown piece which permits a broader bearing surface on a horse's poll.

A portion of horse's headgear that encircles a horse's head is frequently referred to as a headstall. The headstall is used in a bridle and a halter. The bridle used in riding is the headgear with which a horse is governed and which carries a bit and reins. The bit enables the rider of the horse to turn and to stop the horse. The bridle is not used to tie the horse or to restrain the horse. The bridle is customarily made of a headstall having a framework of rigid, inelastic (non-elastic) materials such as thick bridle leather straps (or stiff woven strap-like materials like nylon straps) having a rigid bit. The framework of the headstall of the bridle includes a number of portions. The portions of the bridle may be made adjustable for the size of the horse's head and for fastening around the horse's head by the use of engageable adjustable fasteners, such as buckles, hooks, snaps, or VELCRO® strips (Velcro Industries B.V. Limited Company Assignee of Netherlands Castorweg 22–24 Curacao Netherlands) used with engaging portions such as connecting straps having holes or apertures, corresponding snap parts or mating VELCRO® strips for adjustable engagement of the fastener; hereinafter the aforementioned engagable fasteners and engaging portions are referred to as "fastening means".

A bridle in which only one bit is used is called a single bit bridle. The plurality of portions of a single bit bridle encircling and conforming to a horse's head include a crown piece (also known as a head band or headpiece), a brow band, a throat latch (also known as a throat lash), two cheek pieces, means for connecting portions to one another, bit attachments for holding the bit and for holding the reins. The crown piece rests on the area on the top of the horse's head on the edge of the skull bones behind its ears. The crown piece connects on either side of the horse's face to cheek pieces. The cheek pieces are disposed on the horse's cheeks on opposite sides of the horse's face. The brow band is connected to the crown piece and to the cheek pieces and is disposed in front of the horse's ears and above the horse's eyes on the horse's brow. The cheek pieces, the crown piece and the brow band are connected to the throat latch which is disposed under the horse's jowl. Each cheek piece has an end bearing a bit attachment which holds the bit and to which the reins are attached.

Another design of a bridle, called a "double bridle" or "show bridle", bears a second bit. In the double bridle, the structure is as previously described for the single bit bridle, but a second pair of cheek pieces is added to the framework of the bridle. The second pair of cheek pieces may extend from the crown piece or may be integral with a second crown piece disposed at the connection of the brow band and first crown piece. Each cheek piece of the second pair of cheek pieces has an end bearing a bit attachment which holds a second bit (a snaffle bit). Yet, alternatively, a snaffle piece is used with a single bit bridle. The snaffle piece is a leather strap extending around the horse's head and bearing a snaffle bit. The snaffle piece connects on the browband and is disposed under the crown piece, has a pair of cheek pieces with each end of the cheek pieces bearing a bit attachment for the snaffle bit. Either the single bit bridle or the double bit bridles may be worn with a caveson which will be described later.

As is known in the tack art, a curb bit is sometimes used with a bridle. The curb bit is used in association with a curb chain or curb strap which is a chain or strap which is adjustably hooked or buckled onto the curb bit. The curb chain runs through the horse's chin groove and is positioned under the horse's chin. The curb chain (or strap) prevents the bit from sliding in the horse's mouth.

In contrast to a bridle, a halter is headgear used for leading the horse. It is used mainly in the stable to lead the horse or to tie it. The halter comes in two types. One type is a work halter, the other type is a show halter. The work halter (also known as a head collar or barn halter) is the headgear used in training horses to accustom the horse to wearing headgear and following on a lead. The work halter typically includes a frame work of a plurality of inelastic portions, typically made of leather or other stiff woven strap-like materials, interconnected by fasteners or connectors or other attachments. The portions of the work halter may be affixed to one another and/or may be made adjustable to fit the horse's head size and/or may be fastened around the horse's head by the use of is fastening means. The portions of the work halter include a crown piece, two cheek pieces, a throat latch, a noseband, a jaw band, a connector strap, and means for connecting portions to one another. In contrast to the bridle, the work halter does not include a bit. The crown piece rests on the area on the top of the horse's head on the edge of the skull bones behind the horse's ears. The crown piece connects on either side of the horse's face to the cheek pieces. The cheek pieces are disposed on the horse's cheeks on opposite sides of the horse's face. The cheek pieces and the crown piece are connected to the throat latch which is disposed under the horse's jowl. Extending down the horse's face and above the horse's mouth is the noseband. The noseband is part of a headstall of the work halter that passes over the horse's nose. The cheek pieces attach to the noseband on top of the horse's face and to the jaw strap (also called the chin strap) on the bottom. The jaw strap is disposed under the horse's mouth. The jaw strap in turn connects to the throat latch via an under jaw connector strap. A connector, typically an O-ring is used to connect the under jaw connector strap to the jaw strap. A lead rope is connected to the connector when the horse is being trained to follow on the lead rope. With the work halter, unlike the bridle, there is no pressure on the horse's mouth because there is no bit.

The show halter is used when horses are shown in hand. The show halter tends to be smaller and much tighter than the work halter. The show halter has a plurality of inelastic portions, interconnected into a frame-work which fits around the horse's head. The show halter is typically an interconnected framework of leather straps. The straps are usually a slim leather and quite close fitting, since the horse wears no bridle or caveson with the show halter. Sometimes the straps are a fine, rolled leather. Other show halters are made of more rigid leather straps. The portions of the show halter include a crown piece, a pair of cheek pieces, a noseband, a jaw strap and a throat latch. Sometimes the crown piece and the cheek pieces are integral with each other; other styles of show halters have the crown piece and cheek pieces having fastening means, for adjustment to the horse's head size. The crown piece is disposed on the area on the top of the horse's head on the edge of the skull bones behind its ears. The crown piece connects or extends on either side of the horse's face to the cheek pieces. The cheek pieces are disposed on the horse's cheeks on the horse's face. The cheek pieces and the crown piece are connected to the throat latch which is disposed under the horse's jowl. The throat latch is typically made of a very thin leather. Extending down the horse's face and above the horse's mouth is the noseband. The noseband is part of a headstall of the show halter that passes over the horse's nose. The noseband of a show halter is relatively tightly fitting. The cheek pieces attach to the noseband on top of the horse's face and to the jaw strap on the bottom. Typically an O-ring, loop or other connector is used to connect these portions. The O-rings are disposed on either side of the noseband. The jaw strap is disposed under the horse's mouth. A lead rope with either a single line or two lines in a "Y" fashion is attached to the connectors. Typically, a chain or a strip of leather is run through the O-rings. The chain is attached to the lead line. The horse is then lead on the lead rope.

The bridle is placed on a horse's head and used by a rider to control the horse's movement. Control or communication with the horse is achieved by pulling on the reins, which are attached to the bridle and thereby transmit pressure to the horse's head through the bridle and the bit. The bit(s) is disposed in the horse's mouth on the gums behind the teeth. A caveson fits underneath the bridle to prevent the horse from avoiding the action of the bit(s) by opening its mouth. Accordingly, training a horse to accept the bit(s) of the bridle is essential for proper communication and control of a horse throughout its life. Similarly, the halter is placed on the horse's head and used to accustom the horse to the headgear and to train the horse to follow on a lead rope.

A caveson is positioned on a horse for the purpose of ensuring that the horse holds a bit correctly in its mouth, with the caveson preventing the horse from excessively opening its mouth while being ridden. Further, a caveson aids in training a horse to accept a bridle and bit. By virtue of inhibiting the level to which the horse can open its mouth, a caveson also controls the amount of pressure a rider can apply to the bit, it may also control breathing and the tendency for the horse to run away with its rider.

A caveson resembles a well fitting halter and includes a circular segment comprised of a noseband and a jaw strap which together encircle the horse's jaw and a retaining strap or headstall that holds the noseband in position. The noseband, secured relatively tightly around the horse's nose by the jaw strap, acts on the horse's nasal bone to control and guide the horse. The impact on the horse is determined by the tightness of the jaw strap on the underside of the noseband.

Because of its use as a training device, the caveson noseband is traditionally made of a rigid, inelastic material, such as thick bridle leather, nylon or metal. In some instances, the caveson can include even harsher materials on the noseband such as metal studs to encourage the horse to keep its mouth closed while being ridden. While some rigid cavesons include padding on the underside of the noseband to improve comfort, the caveson materials themselves are rigid and inelastic to prevent opening of the horse's mouth.

However, some horses are not easily trained or accepting of these rigid cavesons, halters or bridles. Rigid or harsh cavesons, halters and bridles used to provide negative reinforcement during training often proves unsuccessful in achieving results. The use of a rigid caveson, bridle, halter, or conventional curb chain or curb strap could be painful and uncomfortable for the horse, and may be ineffective in training and lead to less inverted working attitudes.

A horse's head has a number of pressure points with both joints and nerves running through the horse's spine to the head and then on to the horse's brain. The pressure points in the horse's head are located on the poll, on the bridge of the horse's nose and nose, and on the horse's chin. The poll is the area where the skull connects to the spine and is the most vulnerable pressure point area on the horse's body. The pressure points on the bridge of the nose and nose and the pressure point on the chin are not as sensitive as the poll, but can be a source of discomfort depending on the individual horse.

It is known that a horse will naturally pull away from pressure. Thus when a horse is yanked forward on a lead or reins, the horse starts and pulls backward. The pressure caused on the horse's poll from the tension in the lead or rope will generate an instinctive reaction for the horse to back away faster and even rear up. The horse tends to extend its head upward and backward resisting the efforts to lead it forward and the horse attempts to move in an opposite direction to the forward pull.

If a horse resists or pulls back on a caveson, a halter or a bridle, this action will inflict pain and can often times damage the nerves leading to the brain, not to mention the possibility of the horse developing bad training habits as a result of this action.

Furthermore, the use of a rigid caveson, bridle or halter can be is inhumane since it may increase the risk of vertebral dislocation of the upper vertebrae (first and second vertebrae) in the horse's neck. This provides discomfort to the horse and chance of prolonged or chronic injury. The continued use of this conventional rigid headgear (rigid caveson, bridle or halter) may also create pain around and in the horse's nose, bridge of nose, chin and mouth areas. The conventional headgear fails to contribute to the health and wellbeing of the horse and provides a negative reinforcement when attempts are made to train the horse to the lead rope or reins.

The placement of the present designs of crown pieces of bridles and of halters is on the edge of the bones behind the horse's head. Placing the load bearing surface of the crown pieces on these areas can lead to discomfort, agitation and distraction during the horse's training.

What is needed is humane horse headgear for training horses and thereafter, which promotes the horse's attention to training efforts by lessening and/or eliminating the discomfort attendant with use of conventional horse headgear in training horses.

It is accordingly the primary objective of the present invention to provide a humane horse headgear, using resilient materials in portions of the headgear, for use in horse training and thereafter which will allow limited movement of the horse's head during training and will allow the horse to adapt gently to the concept of a mouth constraint. It is an objective of the present invention to provide the humane horse headgear as a training aid which encourages the horse to respond to training by not having to give in to pain or discomfort caused by inhumane or conventional headgear. It is a related objective to provide resilient elastic materials, preferably woven elasticized materials, in portions of the humane horse headgear which provide comfort to the horse during training thereby aiding relaxation and concentration by the horse in training and thereafter. It is another objective of the present invention to provide the resilient portion in portions of the headgear disposed at one or more of the pressure points on the horse's head. It is yet another objective of the present invention to provide humane horse headgear having one or more resilient portions disposed in the headgear to transition a horse from a loose halter to a full bridle with caveson in such a manner as to have the horse remain calm, controlled and listening without the need to use aggressive restraints on the horse.

It is a further objective of the present invention to provide a caveson for use in horse training and thereafter which will allow limited movement of the horse's mouth during training and allow the horse to adapt gently to the concept of a mouth constraint. It is a related objective of the present invention to provide a caveson in which the noseband is comprised at least in part of a resilient material, allowing enough movement of the horse's mouth to prevent pain or discomfort while exerting progressive and constant pressure on the horse's nose when the horse opens his mouth or crosses his jaw, ensuring that the trainer or rider maintains control and communication with the horse through the bit.

It is a further objective of the present invention to provide a caveson with an adjustable jaw strap thereby permitting a trainer or rider to vary the circumference of the circular portion of the caveson according to the size of the horse's nose. It is a related objective of the present invention to provide a caveson with an adjustable headstall thereby permitting a trainer or rider to vary the size of such headstall allowing the caveson to be fitted and used on more than one horse.

It is a further objective of the caveson of the present invention that the caveson jaw strap may optionally be made of at least in part a resilient material to allow limited movement of the horse's mouth while acting in cooperation with the caveson noseband to exert progressive and constant pressure on the horse's nose, ensuring the horse's mouth is sufficiently closed to properly engage with the bit. It is an additional objective of the present invention to provide a caveson for use in horse training and thereafter that optionally includes a headstall made at least in part of a resilient material to further provide comfort to the horse while working with the noseband and the jaw strap to maintain pressure on the horse's nose.

It is a further objective to provide a bridle having a headstall having one or more portions constructed of a resilient material for permitting limited movement of the horse's head to prevent pain or discomfort at one or more of the pressure points on the horse's head during training and thereafter. It is a related objective of the present invention to provide a bridle in which the crown piece is made up at least in part of a resilient material, allowing enough movement of the horse's head to prevent pain or discomfort, ensuring that the trainer or rider maintains control and communication with the horse through the bit.

It is a further objective of the present invention to provide a bridle in which a crown piece, and/or one or more pairs of cheek pieces and/or a brow piece and/or a throat latch is made up in part or entirely of a resilient material, thereby permitting painless flexion of the horse's head when it is being trained and thereafter. It is another objective of the bridle of the present invention that the resilient material is a woven elasticized material.

It is a further objective of the bridle of the present invention to provide an integral caveson for use with a bridle having a crown piece, where the integral caveson includes a pair of caveson cheek pieces, and/or a first circular segment, preferably including a noseband and a jaw strap, and/or a second circular made up, in part or entirely of a resilient material, preferably a woven elasticized material, thereby permitting painless flexion of the horse's head and limited movement of the horse's mouth when it is being trained and thereafter.

It is a further objective of the bridle of the present invention to provide a crown piece which is a contoured crown piece having a broader bearing surface for resting across the poll of the horse's head. It is a related objective of bridle of the present invention to provide the contoured crown piece having a resilient portion, most preferably made of a woven elasticized material, ranging from 1% to 100% of a length of the contoured crown piece.

It is yet another objective of the present invention to provide a snaffle piece for use with a bridle, where the snaffle piece is made up in whole or in part of a resilient material, most preferably a woven elasticized material.

It is a further objective of the present invention to provide a halter for use in horse training and thereafter which will allow limited movement of the horse's head and/or mouth during training and allow the horse to adapt gently to the concept of a mouth constraint. It is a related objective of the present invention to provide a halter in which one or more of a crown piece, a pair of cheek pieces, a noseband, a jaw strap, a throat latch and an under jaw connector strap is made up in part or in entirety of a resilient material, allowing enough movement of the horse's head and/or mouth to prevent pain or discomfort while exerting progressive and constant pressure on the horse's nose when the horse rears its head backward and/or opens his mouth and/or crosses his jaw, ensuring that the trainer or rider maintains control and communication with the horse through the lead rope.

It is a further objective of the present invention to provide a work halter in which a crown piece, and/or a pair of cheek pieces and/or a noseband and/or a jaw strap and/or a throat latch and/or a under jaw connector strap are made up in part or in entirety of a resilient material, most preferably a woven elasticized material, thereby permitting painless flexion of the horse's head when it is being trained and thereafter.

It is a further objective of the present invention to provide a show halter in which a crown piece, and/or a pair of cheek pieces and/or a noseband are made up in part or in entirety of a resilient material, most preferably a woven elasticized material, thereby permitting painless flexion of the horse's head when it is being trained and thereafter.

It is a further objective of the of the present invention to provide a contoured crown piece for use in a headstall of a halter, a snaffle piece, a caveson, and/or a headstall of a bridle, with the contoured crown piece having a contoured portion having a broader load bearing portion for resting across the poll of the horse's head, thereby aiding relaxation and concentration by the horse in training and thereafter. It is a related objective of the contoured crown piece of the present invention to have a portion of a length of the contoured portion of the contoured crown piece made of a resilient material, most preferably a woven elasticized material. It is a related objective of the contoured crown piece of the present invention for the resilient material to make up a portion ranging from 1% to 100% of the length of the contoured portion.

It is further objective of the present invention to provide a curb device, e.g. a curb chain and a curb strap, for use with a curb bit with the curb chain or curb strap made up in part or in entirety of a resilient material, preferably an elastic material, most preferably a contoured elastic material. It is a related objective for the curb chain (or curb strap) to have a contoured portion having a broader portion disposed under the horse's chin to provide less pain to the horse when the reins on the bit are pulled.

The caveson, the integral caveson, the bridles, the halters, the snaffle piece, the contoured crown piece, and the curb device of the present invention must also be of construction which is both durable and long lasting, and it should also require little or no maintenance to be provided by the user throughout its lifetime. In order to enhance the market appeal of the caveson, the integral caveson, the bridle, the halter, the snaffle piece and the contoured crown piece of the present invention, it should also be of inexpensive construction to thereby afford it the broadest possible market. Finally, it is also an objective that all of the aforesaid advantages and objectives of the caveson, integral caveson, bridles, halters, snaffle piece and contoured crown piece of the present invention be achieved without incurring any substantial relative disadvantage.

SUMMARY OF THE INVENTION

The disadvantages and limitations of the background art discussed above are overcome by the present invention. With this invention, humane horse headgear is provided which allows limited movement of the horse's head during training and thereafter. The humane headgear comprises one or more portion(s) encircling and conforming to a horse's head. One or more of the portions is constructed of a resilient material permitting limited movement of one or more parts of the horse's head. The resilient material in one or more of the portions of the headgear is preferably disposed at one or more of the pressure points on the horse's head. Each of the one or more portions constructed of the resilient material has a portion length. The resilient material corresponds to 1% to 100% of the portion length. The one or more portions constructed of resilient materials is comprised of at least one layer of resilient material. In the preferred embodiment, the one or more portions constructed of a resilient material is constructed of two layers of resilient material, placed directly on top of each other and affixed together permanently by stitching or other well-known methods. In a preferred embodiment, the resilient material is a material that not only exhibits elastic properties but which also imparts softness and conformability to the shape of the horse's head at the points of contact, such as an elasticized material, most preferably a woven elasticized material.

In the preferred embodiment, the humane horse headgear of the present invention includes a caveson, a headstall of a bridle, a single bit bridle, a double bit bridle, a snaffle piece, an integral caveson for use with a single bit bridle and for use with a double bit bridle, a work halter and a show halter. The humane horse headgear also includes a contoured crown piece for use in any of the aforementioned bridles, cavesons, snaffle piece or halters. The humane horse headgear also includes a curb device, e.g., a curb chain and humane curb strap for use with a curb bit.

The humane horse headgear includes a caveson for use in horse training and thereafter, which consists of a circular segment that is fitted around the horse's nose and a headstall, attached to the circular segment and placed behind the horse's ears to secure the caveson on the horse's head.

The circular segment includes an upper portion consisting of a noseband, having first and second ends, and a lower portion consisting of a jaw strap, also having first and second ends, with the first ends of the noseband and the jaw strap secured to each other and the second ends of the noseband and the jaw strap secured to each other, thereby forming the circular segment. In the preferred embodiment, the noseband is secured to the jaw strap by permanently stitching the ends together.

The noseband of the caveson of the present invention is constructed, at least in part, of a resilient material, allowing the noseband to yield slightly in response to movement of the horse's mouth. In the preferred embodiment, the noseband is constructed of two layers of resilient material, placed directly on top of each other and affixed together permanently by stitching or other well-known methods. In an alternate embodiment, the noseband of the caveson of the present invention is constructed, at least in part, of a resilient material that not only exhibits elastic properties but which also imparts softness and conformability to the shape of the horse's nose at the points of contact, such as woven elasticized materials.

The jaw strap of the caveson of the present invention includes an adjustment mechanism for securing the circular segment around the horse's nose and varying the circumference of the circular segment. In the preferred embodiment, the jaw strap includes a buckle that allows the circular segment to be adjusted in circumference, depending upon the size of the horse's nose and the amount of pressure on the horse's nose required by the trainer or rider. In the preferred embodiment, the buckle is positioned within the jaw strap such that when the buckle is fastened to the desired circumference, it is located on the underside of the horse's nose.

The caveson of the present invention also includes a headstall which consists of a strap having first and second ends which are relatively secured to the circular segment of the caveson on opposite sides thereof so that the headstall forms a loop which runs from one side of the circular segment to a location behind the horse's ears, and back to the opposite side of the circular segment. The headstall also includes means for adjusting the size thereof and for ensuring that the headstall is securely fitted behind the ears of the horse. In the preferred embodiment, the headstall consists of two segments, each segment having first and second ends, wherein the first ends are each secured to the circular portion of the caveson on opposite sides of the horse's nose, and the second ends are fastened together by a buckle. In this embodiment, the length of each segment is such that when the buckle is fastened, the buckle is located on the side of the horse's head.

In alternate embodiments, either the jaw strap or the headstall, or both, may be constructed, at least in part, of a resilient material, allowing additional movement of the horse's mouth.

In yet another embodiment, the caveson is provided with an additional component, namely a crown piece strap which is connected at each end to opposite sides of the headstall, and is located so as to run along the forehead of the horse. This crown piece may be constructed of leather or any other commonly used material known in the art.

In further alternative embodiments, the caveson is provided with a second circular segment that is connected to first circular segment at a point on the noseband of the caveson that is directly on the bridge of the horse's nose and extends around the horse's chin in front of the bit, encircling the horse's nose. The second circular segment may also be constructed, at least in part, of a resilient material, allowing for additional control over movement of the horse's mouth.

It may therefore be seen that the caveson of the present invention overcomes the disadvantages of the prior art by providing a comfortable and humane caveson that can be used for training horses and thereafter, wherein the noseband is constructed in part of a resilient material that allows movement of the horse's mouth while also acting in conjunction with the jaw strap to apply light and continuous pressure to the horse's nose, encouraging the horse to keep its mouth closed while being ridden. It may thus be seen that the present invention provides a caveson for use in horse training and thereafter without the need for harsh, painful, and inelastic components previously seen in the prior art.

The humane horse headgear includes a bridle for use in horse training and thereafter which comprises a headstall and one or more bits. The headstall of the bridle has a plurality of portions encircling and conforming to the horse's head. The headstall of the bridle includes a crown piece, one or more pairs of cheek pieces, a brow band, and a throat latch. The one or more of the aforementioned plurality of portions of the headstall has a portion constructed of a resilient material. Preferably the crown piece has a portion constructed of a resilient material. The crown piece is disposed on an area on the top of the horse's head. One or more pairs of the cheek pieces extend from or are attached or are connected to the crown piece. Each cheek piece has an end bearing a bit attachment. The end bearing the bit attachment is opposite the crown piece. The cheek pieces of each pair of the cheek pieces are disposed on the horse's cheeks on opposite sides of a horse's face. The brow band has opposite ends which are connected or attached to the crown piece and to the one or more pairs of cheek pieces. The brow band is disposed in front of the horse's ears and above the horse's eyes on the horse's brow. The throat latch is connected to or attached to or extends from the one or more pairs of cheek pieces, the crown piece and the brow band. The throat latch is disposed under the horse's jowl.

The crown piece of the humane horse headgear of the present invention is constructed, in part or in entirety of a resilient material, preferably an elasticized material, allowing the crown piece to yield slightly in response to the movement of the horse's head.

In a preferred embodiment, the crown piece has a contoured portion shaped to provide a load-bearing surface disposed on the poll of the horse. The contoured portion has a length. The resilient portion of the bridle crown piece extends from 1% to 100% of the length of the contoured portion.

In alternate embodiments the bridle is a single bit bridle with one pair of cheek pieces and one bit, or the bridle is a double bit bridle with two pair of cheek pieces and two bits, one bit for each of the pairs of cheek pieces. Alternatively, the bridle is a single bit bridle used along with a snaffle piece having a pair of cheek pieces and a separate bit for the snaffle piece. In the alternate embodiments, preferably the one or more pairs of cheek pieces of the bridle each have a portion constructed of the resilient material allowing the horses's head limited movement in training and thereafter.

In a further alternate embodiment, the humane horse headgear includes an integral caveson for use with a bridle having a crown piece. The integral caveson includes a pair of caveson cheek pieces and a first circular segment, preferably having a noseband and a jaw strap, attached to the noseband. The first circular segment, e.g., the jaw strap and noseband, encircle the horse's nose. The pair of caveson cheek pieces extends from or connects to or is attached to the crown piece. One cheek piece of the pair of caveson cheek pieces is disposed on one of the horse's cheeks on either side of the horse's face. Each cheek piece has an end opposite the crown piece. Each end is attached to the circular segment, preferably at the noseband. The noseband has a portion constructed of the resilient material and either or both, the jaw strap and the pair of caveson cheek pieces have one or more portions constructed of the resilient material.

In another alternate embodiment, the integral caveson further includes a second circular segment encircling the horse's nose and attached to the first circular segment, preferably at the noseband. The second circular segment has a portion constructed of the resilient material. Either embodiment of the integral caveson is preferably used with either the single bit bridle or the double bit bridle of the humane horse headgear of the present invention.

The humane horse headgear includes a work halter for use in horse training and thereafter. The work halter comprises a headstall having a plurality of portions encircling and conforming to the horse's head. The plurality of portions of the work halter include, a crown piece, a pair of cheek pieces, a throat latch, a noseband, a jaw strap and a connector strap. One or more of the plurality of portions has a portion constructed of a resilient material. Preferably the crown piece has a portion constructed of a resilient material. In a preferred embodiment, the crown piece has a contoured portion shaped to provide a load-bearing surface disposed on the poll of the horse. The contoured portion has a length. Preferably, the resilient portion of the halter crown piece extends from 1% to 100% of the length of the contoured portion.

In alternate embodiments of the work halter of the humane horse headgear of the present invention, one or more of the noseband, the pair of cheek pieces and the connector strap may be constructed with a portion of resilient material. In a preferred embodiment of the work halter, one or more of the halter crown piece, the pair of cheek pieces, the throat latch, the noseband, the jaw strap and the connector strap, has a portion constructed of a resilient material.

The humane horse headgear includes a show halter for use in horse training and thereafter. The show halter comprises a plurality of portions encircling and conforming to the horse's head. The plurality of portions of the show halter include a crown piece, a pair of cheek pieces, a throat latch, and a noseband. Preferably, the crown piece has a portion constructed of a resilient material. In a preferred embodiment, the crown piece has a contoured portion shaped to provide a load-bearing surface disposed on the poll of the horse. The contoured portion has a length. Preferably, the resilient portion of the crown piece extends from 1% to 100% of the length of the contoured portion. In alternate embodiments of the show halter of the humane horse headgear of the present invention, one or more of the crown piece the noseband, the pair of cheek pieces, are constructed having a portion of resilient material.

The humane horse headgear also includes a contoured crown piece for use as a crown piece in a headstall of a conventional bridle and/or a halter and in the cavesons, bridles, halters, and snaffle piece described in the present invention. The contoured crown piece comprises a first end, an opposite second end and intermediate portion disposed between the first and second ends. The intermediate portion is fastened to or integral with the first and second ends. The intermediate portion has a contoured portion. The first end, the intermediate portion with the contoured portion and the second end are disposed to encircle a portion of the top part of the horse's head, with the contoured portion resting on the poll of the horse, behind the horse's ears. The contoured portion has a width, a length, a pair of opposed, preferably parallel, sides across the width, and a pair of opposed curved sides across the length. Each side of the pair of opposed curved sides has a first concave portion, continuous with a convex portion, continuous with a second concave portion. The first concave portion of each side of the pair of curved sides is aligned to form a first narrow portion. The convex portion of each side of the pair of curved sides is aligned to form a broad portion. The second concave portion of each side of the pair of curved sides is aligned to form a second narrow portion. Preferably one of the pair of opposed, preferably parallel, sides are attached to the first end and the other of the pair of opposed, preferably parallel, sides is attached to the second end. Alternatively the contoured portion is continuous with the first end and with the second end.

The length of the contoured portion of the crown piece is sufficient to fit around and behind a horse's ears in the hollow formed by the horse's skull. The width of the broad portion of the contoured portion of the contoured crown piece provides a broad load-bearing surface across the horse's poll. In the preferred embodiment, the contoured portion of the contoured crown piece has a resilient portion extending from 1% to 100% of the length of the contoured portion.

The humane horse headgear of the present invention includes a curb device for use with a curb bit. The curb device is a curb strap or curb chain having a resilient portion therein. Alternatively, the curb device has a contoured portion therein, shaped like the intermediate portion of the contoured crown piece. In the preferred embodiment, the curb device has a portion both resilient and contoured.

In each of the aforementioned embodiments of the humane horse headgear of the present invention, the resilient portion is preferably an elasticized material (elastic), most preferably a woven elastic (elasticized) material.

It may therefore be seen that the humane horse headgear of the present invention (the caveson, the headstall of a bridle, the single bit bridle, the double bit bridle, the integral caveson for use with the single bit bridle, the integral caveson for use with the double bit bridle, the snaffle piece, the work halter, the show halter and the contoured crown piece) and curb device overcome the disadvantages of the prior art by providing a comfortable and humane horse headgear that can be used for training horses and thereafter, wherein one or more portions of the headgear is constructed in part or in whole of a resilient material that allows movement of the horse's head and head parts. It may thus be seen that the present invention provides humane horse headgear for use in horse training and thereafter without the need for harsh, painful, and inelastic components previously seen in the prior art.

The contoured crown piece for use in a bridle or a halter is advantageously shaped to transfer the load-bearing surface of the crown piece from the edge of the bones behind the horse's ears to the poll. This shaping eliminates some of the discomfort in training the horse to bridle or halter.

The humane horse headgear of the present invention is of a construction which is both durable and long lasting, and which will require little or no maintenance to be provided by the user throughout its lifetime. The humane horse headgear of the present invention is also of inexpensive construction to enhance its market appeal and to thereby afford it the broadest possible market. Other advantages and a fuller appreciation of the is specific attributes of this invention will be gained upon an examination of the following drawings, detailed description of preferred embodiments and appended claims. It is expressly understood that the drawings are for the purpose of illustration and description and are not intended as a definition of the limits of the invention. Finally, all of the aforesaid advantages and objectives of the humane horse headgear of the present invention are achieved without incurring any substantial relative disadvantage.

DESCRIPTION OF THE DRAWINGS

These and other advantages of the humane horse headgear of the present invention are best understood with reference to the drawings, in which:

FIG. 12 is a perspective view of a horse wearing a third alternate embodiment caveson, which includes a second circular segment having an adjustment buckle;

FIG. 14 is a cross-sectional view of the caveson illustrated in FIGS. 12 and 13, showing a detailed depiction of the connection of the noseband to the jaw strap which forms the first circular segment;

FIG. 17 is a partial perspective view of the caveson illustrated in FIGS. 12 through 16, showing a detailed depiction of the connection of the second circular segment to the first circular segment;

FIG. 18 is a perspective view of a horse wearing the caveson illustrated in FIGS. 12 through 17 positioned underneath a bridle;

FIG. 25 is a plan view showing an intermediate portion, and parts of a first end and a second end for use in an alternate crown piece for use in the bridles of FIGS. 23–24, 35–36, the bridles with integral caveson of FIGS. 30–32, 39–41, the snaffle piece of FIG. 38, the halters of FIGS. 42–45, and in the headstall of the cavesons of FIGS. 1–22, or for use in a curb device of FIGS. 35, 37, 48–60, with the intermediate portion having a portion constructed of a resilient material;

FIG. 26 is a plan view of an intermediate portion and parts of the first end and second end for use in another alternate crown piece for the bridles of FIGS. 23–24, 35–36, the bridles with integral caveson of FIG. 30–32, 39–41, the snaffle piece of FIG. 38, the halters of FIGS. 42–45, and in the headstall of the cavesons of FIGS. 1–22, or for use in a curb device of FIGS. 35–37, 48–60, with the intermediate portion having a contoured portion;

FIG. 46 is a detailed plan view of the intermediate section of the preferred contoured crown piece and the intermediate section of the preferred curb device of the present invention;

FIG. 47 is another detailed plan view of the intermediate section of the contoured crown piece and the intermediate section of the curb device constructed according to the present invention;

FIG. 48 is a perspective view of a curb device, constructed according to the teachings of the humane horse headgear of the present invention; with the curb device releasably fastened to shanks of a curb bit;

FIGS. 49–51 are alternate plan views of a curb chain of the curb device of the present invention;

FIGS. 52–54 are plan views of fasteners for the opposite ends of the curb device of the present invention.

DETAILED DESCRIPTION OF THE PREFERRED EMBODIMENT

Figure 1:
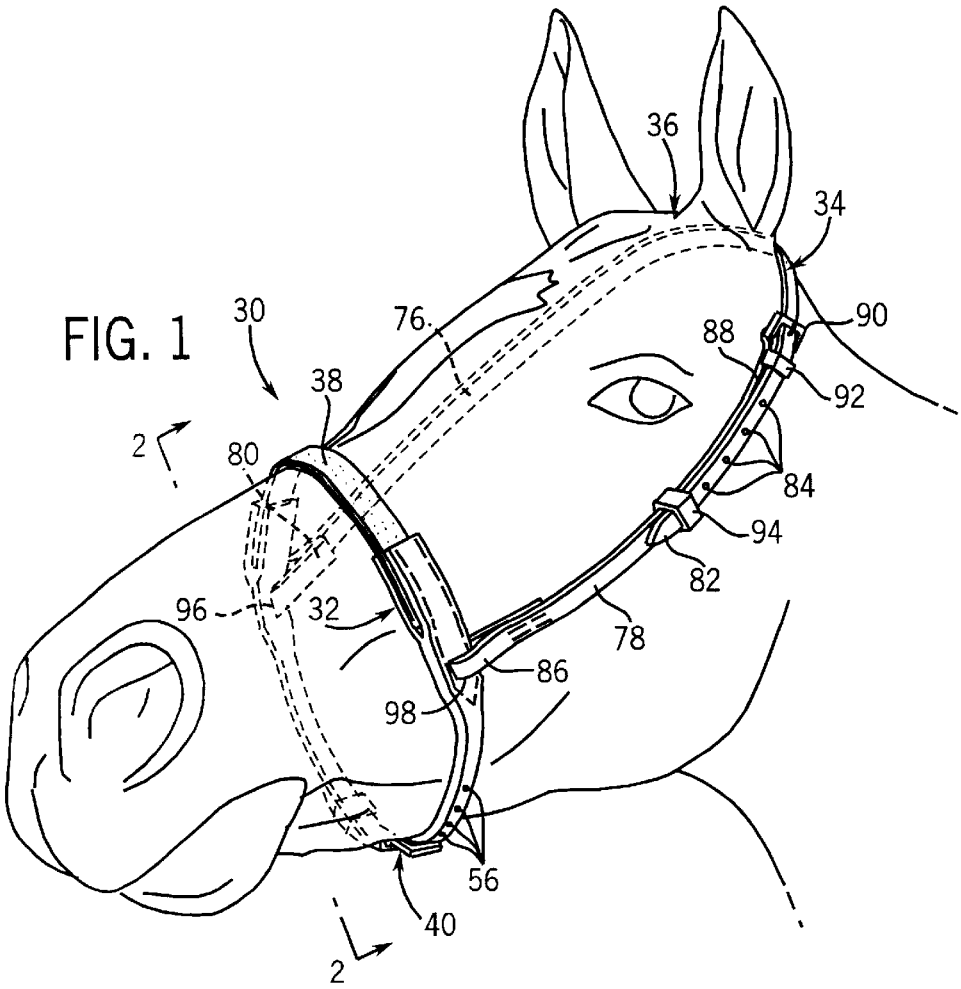
FIG. 1 is a perspective view of a horse wearing a caveson constructed according to the teachings of the humane horse headgear of the present invention.

The present invention provides humane horse headgear using resilient materials 300 in one or more portions encircling and conforming to a horse's head 36. The resilient material 300 in the one or more portions of the headgear is preferably disposed at one or more of the pressure points on the horse's head and is preferably a stretchable elasticized material. The pressure points correspond to the poll 37, the nose 39 and bridge of the nose 41 and the chin 43 of the horse's head. These points are shown in FIGS. 21–23, and 27–29 and incorporated by reference into all other figures showing the horse's head. The selection of the one or more portions with the resilient material incorporated therein, may be customized to the individual needs of the horse. For example if the horse has had a broken or injured jaw, the resilient materials may be used in portions of the headgear encircling the nose and chin areas. The humane horse headgear of the present invention advantageously protects the poll and minimizes unnecessary pressure on the horse's mouth.

The resilient materials may be used in additional portions in the horse headgear to allow for the other portions of the headgear to stretch. Stretchability of the other portions is desirable in response to the horse jerking or moving its head backward in response to pressure on one or more of the pressure points on its head. The humane horse headgear of the present invention is a training aid used in horse training and thereafter allowing limited movement of the horse's head during training and allowing the horse to adapt gently to the concept of a mouth constraint. The present invention provides humane horse headgear encourages the horse to respond to training, preferably by not having to give in to pain or discomfort caused by inhumane headgear. Resilient elastic materials are provided in one or more portions of the horse's headgear; preferably the resilient elastic material in the humane horse headgear provides comfort to the horse, thereby aiding in relaxation and in concentration by the horse in training and thereafter. The present invention provides resilient material ranging from 1% to 100% of a length of the portion in which the resilient material is incorporated.

The humane headgear of the present invention also provides a contoured crown piece for use in a headstall for a bridle, a halter, a caveson, or a snaffle piece. The contoured crown piece may also have a resilient portion ranging from 1% to 100% of a length of the contoured crown piece.

The humane horse headgear of the present invention also provides a curb device for use with a curb bit for a bridle. The curb device may be contoured like the aforementioned crown piece or may have a resilient portion ranging from 1% to 100% of a length of the curb device, or may be both contoured and have a resilient portion.

As is known is the tack art, horse headgear is produced in small, medium and large sizes and is dimensioned according to horse head size. The small size is typically dimensioned for a cob size or for an Arabian horse. The medium size is typically dimensioned for a standard horse. The large size is typically dimensioned for a warm-blood size horse (between a draft horse and a hot-blood horse). Likewise the humane horse headgear of the present invention is dimensioned according to horse head size.

The determination of how much of the length of the portion of the humane horse headgear is constructed of resilient materials is easily determined and depends on the coefficient of elasticity of the material, the length of the portion into which the resilient material is to be incorporated and how much stretch is desired. If a material has a low coefficient of elasticity, it may not stretch as readily, as one with a larger coefficient of elasticity. For example for shorter lengths, resilient materials having a high coefficient of elasticity are desirable; whereas for longer lengths, resilient materials with a smaller coefficient of elasticity are desirable. For example, if a half inch of stretch is desired, then for a one inch length, a resilient material with a 50% coefficient of elasticity is desired so that the resilient material can stretch from one inch to one and one half inches and recover back to its original shape when unstretched and retain its strength. Whereas, for the same half inch stretch for a six inch length, a resilient material with about an 8% coefficient of elasticity is desired so that the resilient material can stretch from six inches to six and one half inches and recover back to its original shape when unstretched and retain its strength. In the humane horse headgear of the present invention, the preferred stretch is one half inch for the portion constructed of resilient material.

Preferably, the resilient material used in one or more portions of the humane headgear including the contoured crown piece and the curb device is made of an elastic material (or elasticized material) such as a woven elasticized material (or woven elastic material), most preferably a woven elastic web having qualities of intrinsic strength as well as elasticity. Preferably, the resilient material is not only elastic but also is soft and conforms to the shape of the horse's head at points of contact and especially at one or more of the pressure points. The elastic materials have elastic properties and recover from the stretched state to the unstretched state. One source of such elastic materials is Lea & Sachs, Inc., Des Plaines, Ill. 60017 (www.leasachs.com) woven elastics. Other resilient elastic materials that are known in the art, for example, but not limited to, surgical tubing, may be used for the portions of the humane horse headgear of the present invention constructed of resilient materials.

The resilient material may be used in a single layer or in multiple layers and incorporated into the one or more portions of the humane horse headgear. The resilient material may be incorporated by stitching, joining, or affixing in any way known in the art, to the non-resilient rigid portions of the horse headgear, or may be integral with a non-resilient portion, as a separate resilient section of the portion of the headgear.

An example of an integral resilient section is a strap having an elastic portion woven into the strap. Yet alternatively, in another example of an integral resilient section, the humane horse headgear of the present invention is made of a breathable polymer material which has a molded elastomer polymer as the resilient material where softness and elasticity are required and a leather-like polymer where strength and flexibility are required (in the non-resilient, e.g., non-elastic, portions)

In the preferred embodiments, the resilient material is incorporated in at least two layers and stitched into one or more portions of the humane horse headgear of the present invention. The preferred method of stitching the resilient material in multiple layers is disclosed in the detailed description of the cavesons in FIGS. 1–20, this disclosure is incorporated by reference for all other embodiments of FIGS. 21–60 where applicable. Alternatively, in a preferred embodiment, a single layer is stitched to, or is looped and sewn to itself and to, one or more portions of the humane horse headgear of the present invention, or otherwise joined or connected in a manner known to those skilled in the art.

The humane headgear includes a caveson, a bridle (including the headstall of the bridle, a single bit bridle, a snaffle piece, a double bit bridle, an integral caveson for use with a single bit bridle, an integral caveson for use with a double bit bridle), a halter (including a work halter and a show halter), a contoured crown piece for use in bridles and/or halters and/or snaffle pieces, and/or cavesons, and a curb device for use with a curb bit. The portion of the humane horse headgear of the present invention resting on the horse's poll behind the horse's ear, and the portion under the horse's chin, e.g., the intermediate portion, is advantageously shown in three different embodiments, resilient, contoured, and preferably both contoured and resilient.

Figure 27:
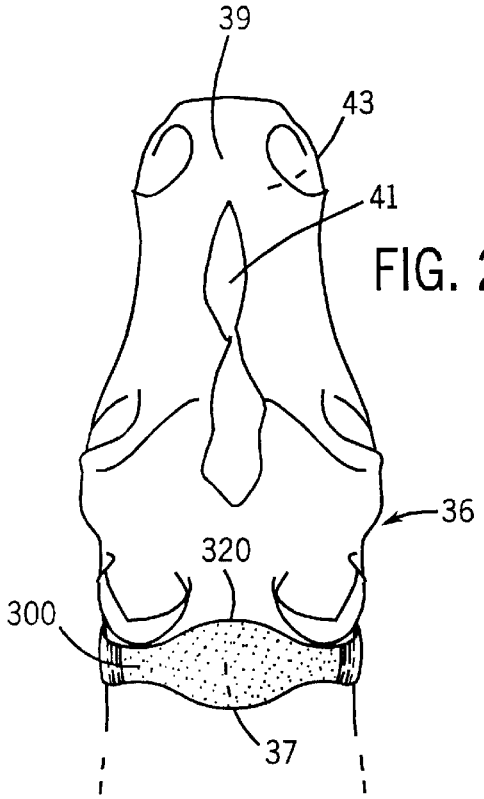
FIG. 27 is a top plan view of the positioning of the intermediate portion of the preferred contoured resilient crown pieces shown in FIGS. 21–22, 23–24, 30–32, 35–46, on the poll of the horse.
Figure 28:
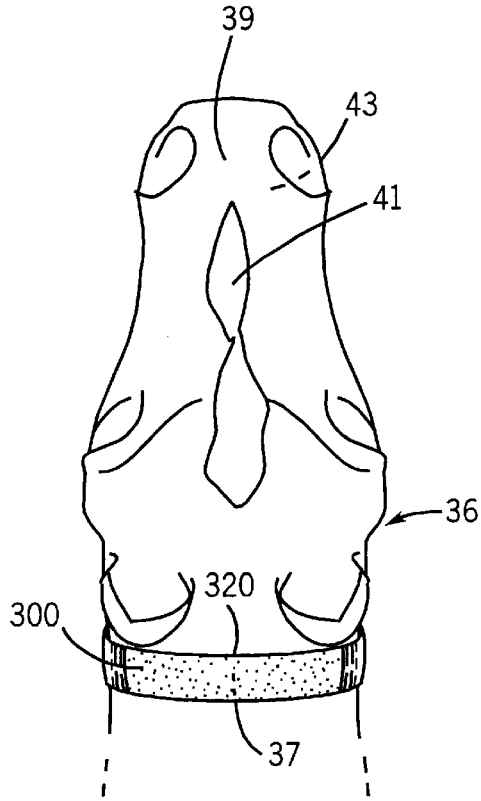
FIG. 28 is a top plan view of the positioning of the intermediate portion of the resilient crown piece of FIG. 25, on the horse's head.
Figure 29:
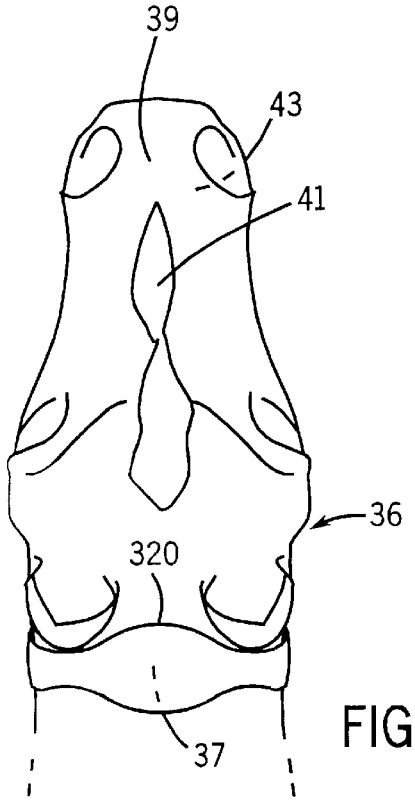
FIG. 29 is a top plan view of the positioning of the intermediate portion of contoured crown piece of FIG. 26, on the poll of the horse.
Figure 59:
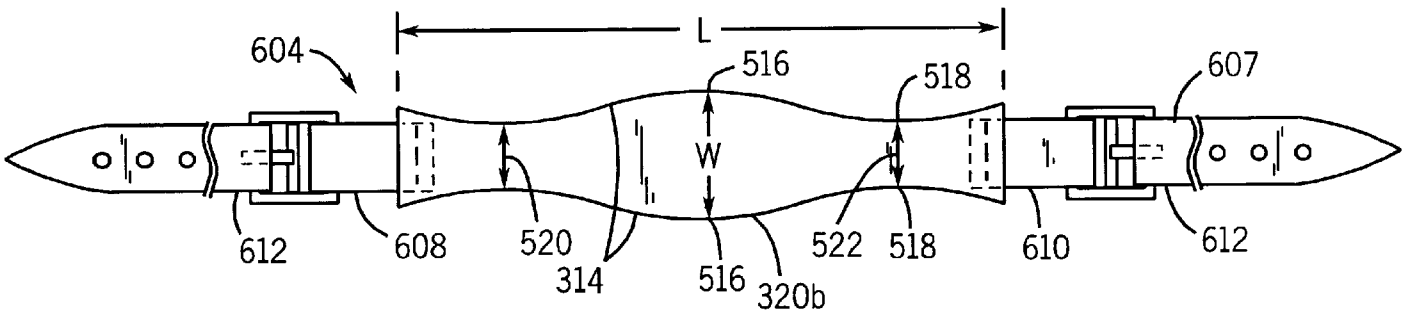
Figure 60:
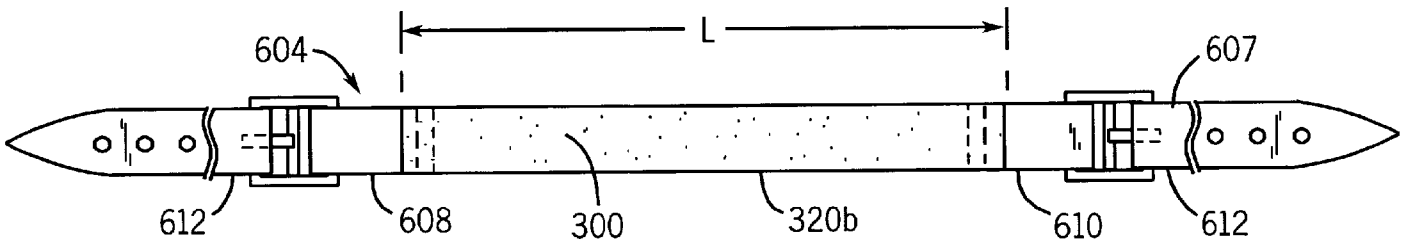

Referring now to FIGS. 1–60 of the humane headgear of the present inventions FIGS. 1–22 pertain to the caveson, FIGS. 23–41 pertain to the bridles, integral cavesons, and snaffle piece for use with a bridle. FIGS. 42–45 pertain to the halter. FIGS. 46–47 pertain to the detail of the contoured crown piece, as well as the detail of the curb device. FIGS. 35, 37, and 48–60 pertain to the detail of the curb device. FIGS. 25–26 pertain to the intermediate section of the alternate embodiments of the crown piece of the present invention used in the caveson, bridles, modified crown pieces, snaffle piece and halters as well as the curb device of the present invention. FIGS. 27–29 pertain to the placement of the intermediate portion of the crown pieces and caveson headstall of the present invention on the top of the horse's head, behind its ears. FIGS. 35, 37, and 48 pertain to the placement of the intermediate potion of the curb device of the present invention under the horse's chin.

CAVESON EMBODIMENT OF THE HUMANE HORSE HEADGEAR

Figure 2:
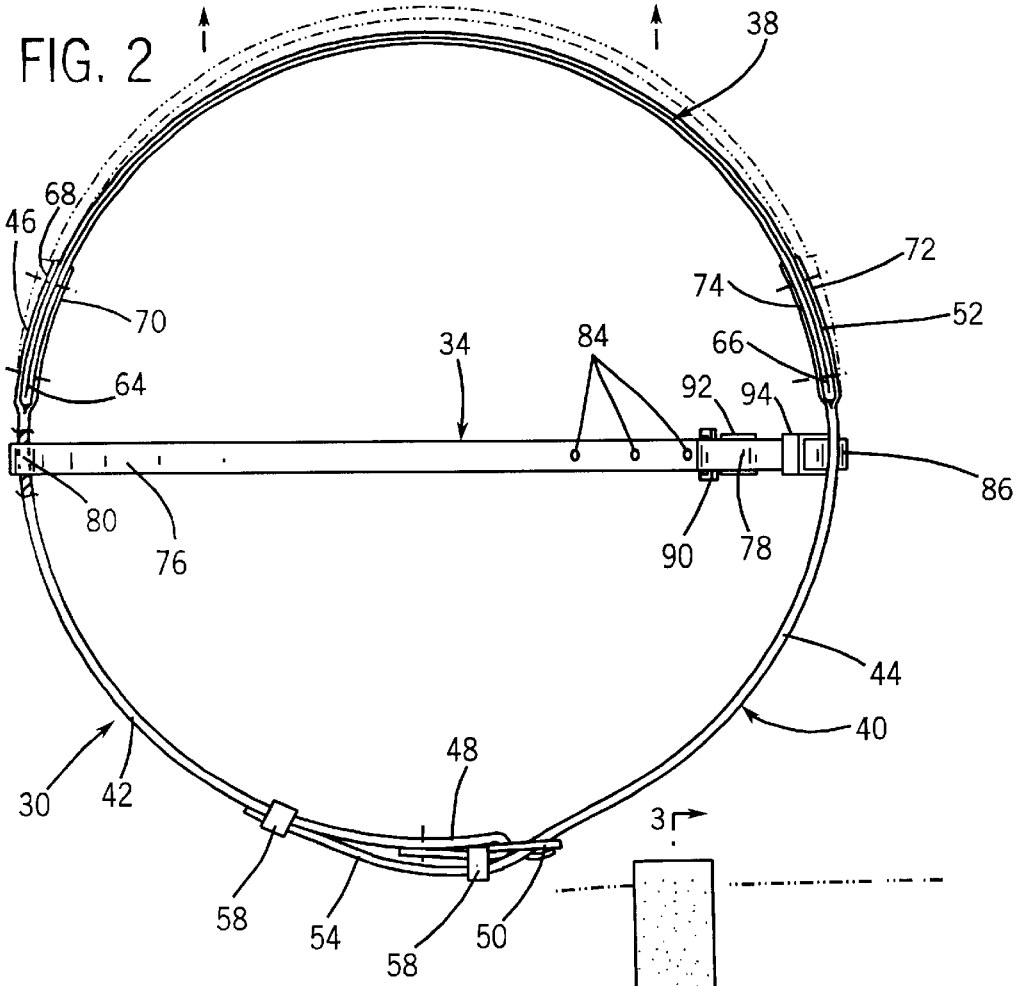
FIG. 2 is a front view of the preferred embodiment shown in FIG. 1.

FIGS. 1 and 2 illustrate the preferred embodiment of a caveson 30 which is consistent with the teachings of the present invention. As illustrated in FIG. 1, the caveson 30 in its simplest form consists of a circular segment 32 that fits around the horse's nose and a headstall 34 that is connected to the circular segment 32 on opposite sides thereof and runs behind the horse's ears to maintain the caveson 30 in place on horse's head 36.

The circular segment 32 of the caveson 30 consists of a noseband 38 that runs over the nasal bone of the horse and a jaw strap indicated generally at 40 that makes up the lower portion of the circular segment 32.

The jaw strap 40 of the caveson 30 is used to adjust the size of the circular segment 32, to accommodate different size horse noses, and to vary the amount of pressure to be applied to the horse's nose. The jaw strap 40 consists of two segments, a first segment 42 and a second segment 44. The first segment 42 has a first end indicated generally at 46 which is attached to the noseband 38, and a second, opposite end indicated generally at 48 which is connected to a buckle 50 or similar mechanism for removably fastening the first segment 42 to the second segment 44. The second segment 44 has a first end indicated generally at 52 which is attached to the noseband 38, and a second, opposite end indicated generally at 54 which contains a series of regularly spaced apertures 56 (best shown in FIGS. 1 and 4) which will receive the buckle 50.

FIG. 2 best illustrates the manner in which the first segment 42 is provided with buckle loops 58 located close to the buckle 50 for retaining the second end 54 of the second segment 44 after the jaw strap 40 has been buckled into place. The relative lengths of each of the segments 42 and 44 of the jaw strap 40 is such that when the buckle 50 is fastened, it is located on the underside of the horse's nose.

Figure 3:
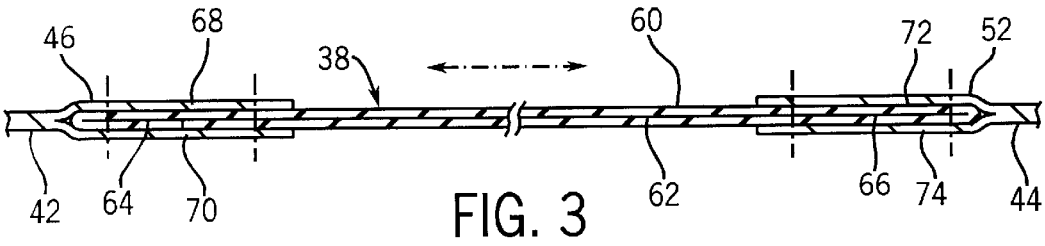
FIG. 3 is a cross-sectional view of the caveson illustrated in FIGS. 1 and 2, showing a detailed depiction of the connection of the noseband to the jaw strap which forms the circular segment.

Referring for the moment to FIG. 3, the preferred embodiment of the noseband 38 consists of a first layer 60 and a second layer 62 of a resilient material of identical width and length, stitched or otherwise joined together permanently in a manner known to those skilled in the art, forming a single reinforced band of resilient material. The noseband 38 has a first end indicated generally at 64 and a second, opposing end indicated generally at 66, in which ends 64 and 66 are used to connect the noseband 38 to the jaw strap 40. In an alternate embodiment, one or more layers of the noseband 38 may be constructed of a material that is not only elastic but also is soft and conforms to the shape of the horse's nose at the points of contact.

In accordance with the present invention, the noseband 38 is connected to the jaw strap 40, forming the circular segment 32 (shown in FIGS. 1 and 2). FIG. 3 also illustrates a detailed view of the connection of the noseband 38 to the jaw strap 40 of the preferred embodiment. The first end 46 of the first segment 42 of the jaw strap 40 is split into two layers, namely a first layer 68 and a second layer 70. The first end 64 of the noseband 38 is inserted between the first layer 68 and the second layer 70, and the resulting joint is stitched or otherwise permanently joined together in a manner known to those skilled in the art.

Likewise, the second end 52 of the second segment 44 of the jaw strap 40 is split into two layers, namely a first layer 72 and a second layer 74. The second end 66 of the noseband 38 is inserted between the first layer 72 and the second layer 74, and the resulting joint is stitched or otherwise permanently joined together in a manner known to those skilled in the art. In the preferred embodiment, the jaw strap 40 is constructed of leather, although it could instead be made of any other appropriate material that either has two layers or may be split into two layers as previously is described. It will at once be appreciated by those skilled in the art that the jaw strap 40 may instead be constructed of one or more layers of resilient material, nylon, rope or any other appropriate material and connected to the noseband 38 to form the circular segment 32 by stitching or in any other manner known to those skilled in the art.

Referring again to FIGS. 1 and 2, the headstall 34 consists of two segments, a first segment 76 and a second segment 78. The first segment 76 has a first end indicated generally at 80 which is attached to the circular segment 32 on the side thereof which will be located on the right side of the nose of the horse's head 36, and a second, opposite end indicated generally at 82 which contains a series of regularly spaced apertures 84. The second segment 78 has a first end indicated generally at 86 which is attached to the circular segment 32 on the side thereof which will be located on the left side of the nose of the horse's head 36, and a second, opposite end indicated generally at 88 which is connected to a buckle 90 or similar mechanism for removably fastening the first segment 76 to the second segment 78. The apertures 84 will receive the buckle 90 when the headstall 34 is fastened onto the horse's head 36.

FIG. 1 illustrates the preferred embodiment of the caveson 30 in which the second segment 78 is provided with a first buckle loop 92 located close to the buckle 90 for retaining the second end 82 of the first segment 76, and a second buckle loop 94 located a distance away from the is buckle 90 for further retaining the first segment 76 when the headstall 34 is fastened in place. The relative lengths of each of the segments 76 and 78 is such that when the buckle 90 is fastened, the buckle 90 will rest on the side of the horse's head 36.

Figure 4:
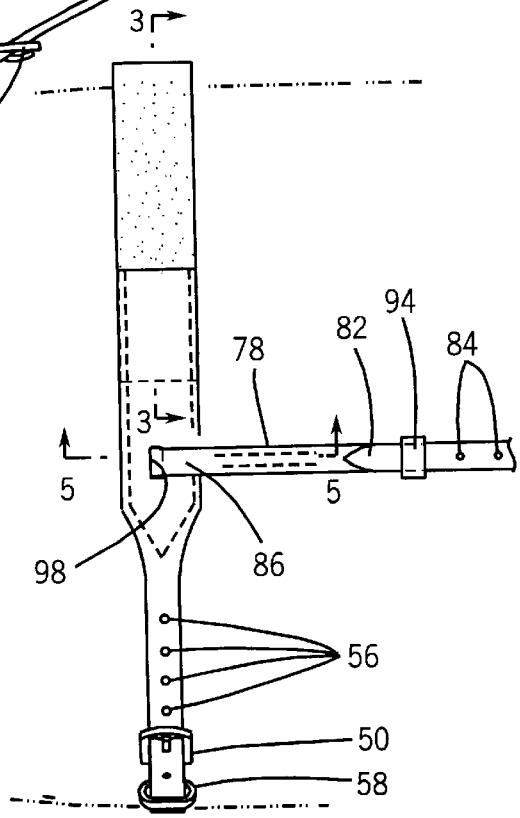
FIG. 4 is a side view of a portion of the caveson illustrated in FIGS. 1 through 3, showing the connection of the noseband to the jaw strap which forms the circular segment, and also showing the connection of the headstall to the circular segment.
Figure 5:
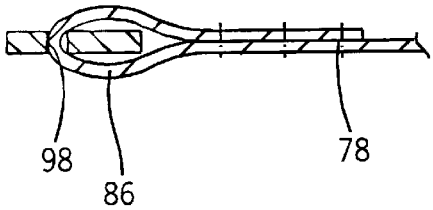
FIG. 5 is a cross-sectional view of the caveson illustrated in FIGS. 1 through 4, showing a detailed depiction of the connection of the headstall to the circular segment.

Referring now to FIGS. 4 and 5 in addition to FIGS. 1 and 2, detailed views of portions of the caveson 30 of the present invention showing the connection of the headstall 34 to the circular segment 32 is provided. The first segment 42 of the jaw strap 40 contains an elongated aperture 96 for receiving one end of the headstall 34. The first end 80 of the first segment 76 of the headstall 34 is looped through the elongated aperture 96 and stitched directly onto itself (as shown in FIGS. 4 and 5), or otherwise permanently joined together in a manner known to those skilled in the art.

Likewise, the second segment 44 of the jaw strap 40 contains an elongated aperture 98 for receiving the other end of the headstall 34. The first end 86 of the second segment 78 of the headstall 34 is looped through the elongated aperture 98 and stitched directly onto itself (as shown in FIGS. 4 and 5), or otherwise permanently joined together in a manner known to those skilled in the art. Note that the elongated apertures 96 and 98 are located on opposite sides of the circular segment 32, and will be respectively located on the right and left sides of the horse's head 36 when the caveson 30 is installed thereupon. It will at once be appreciated by those skilled in the art that the headstall 34 may be connected to the circular segment 32 as described, or alternatively, by stitching it directly to the circular segment 32, or by any other mechanism known to those skilled in the art.

Figure 6:
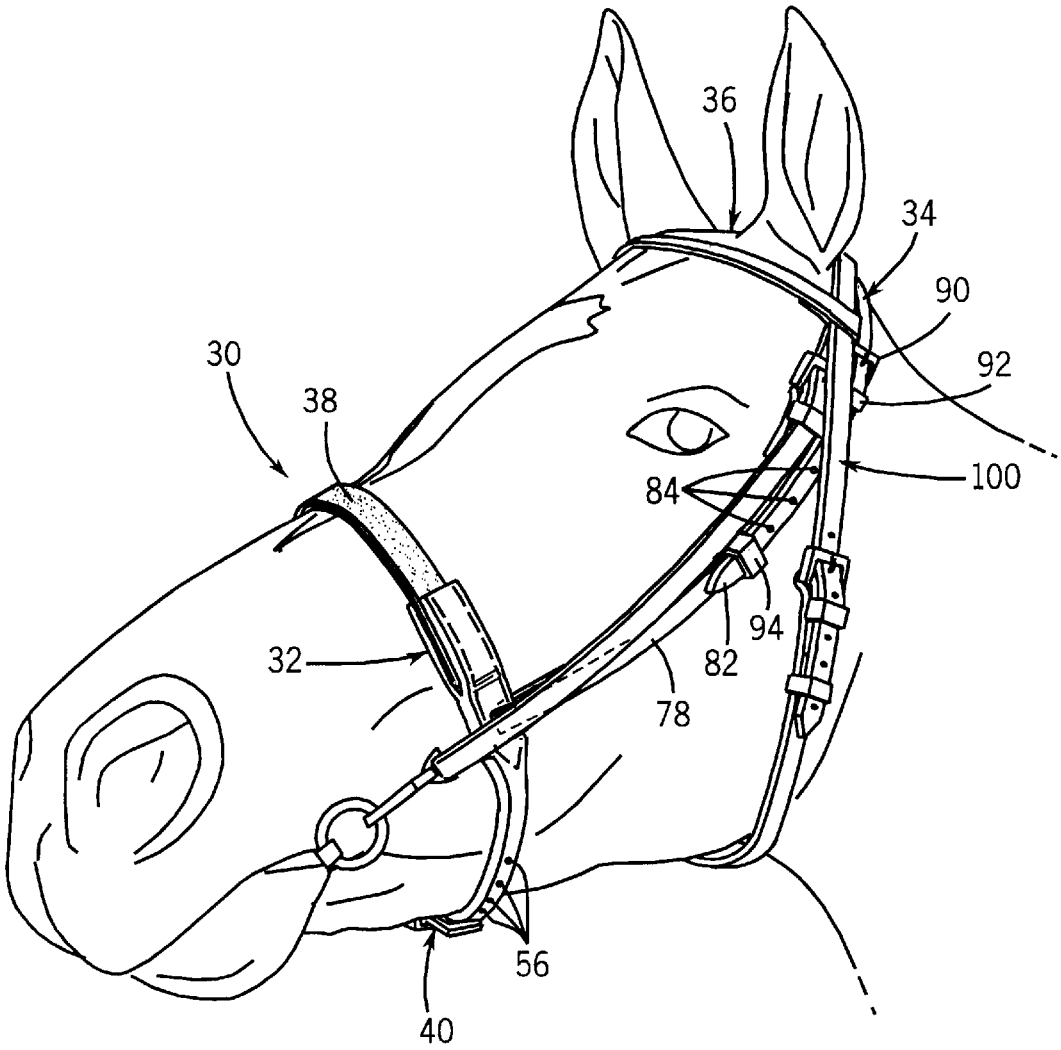
FIG. 6 is a perspective view of a horse wearing the caveson illustrated in FIGS. 1 through 5 positioned underneath a bridle.

Referring now FIG. 6, the preferred embodiment of the caveson 30 is shown on the horse's head 36 located underneath a bridle 100 as would be customary when used in horse training.

Figure 7:
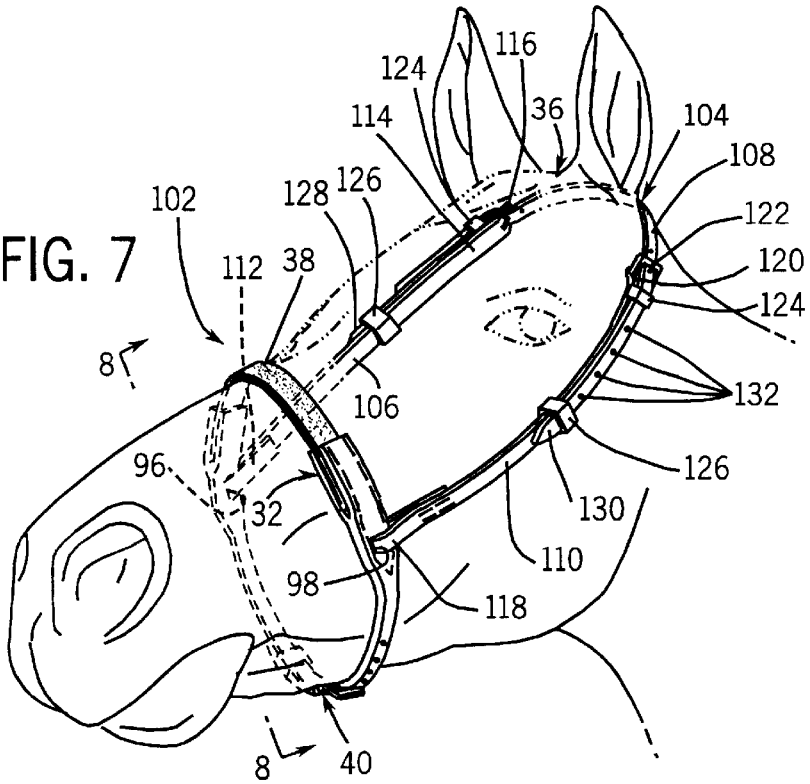
FIG. 7 is a perspective view of a horse wearing an alternate embodiment caveson.
Figure 8:
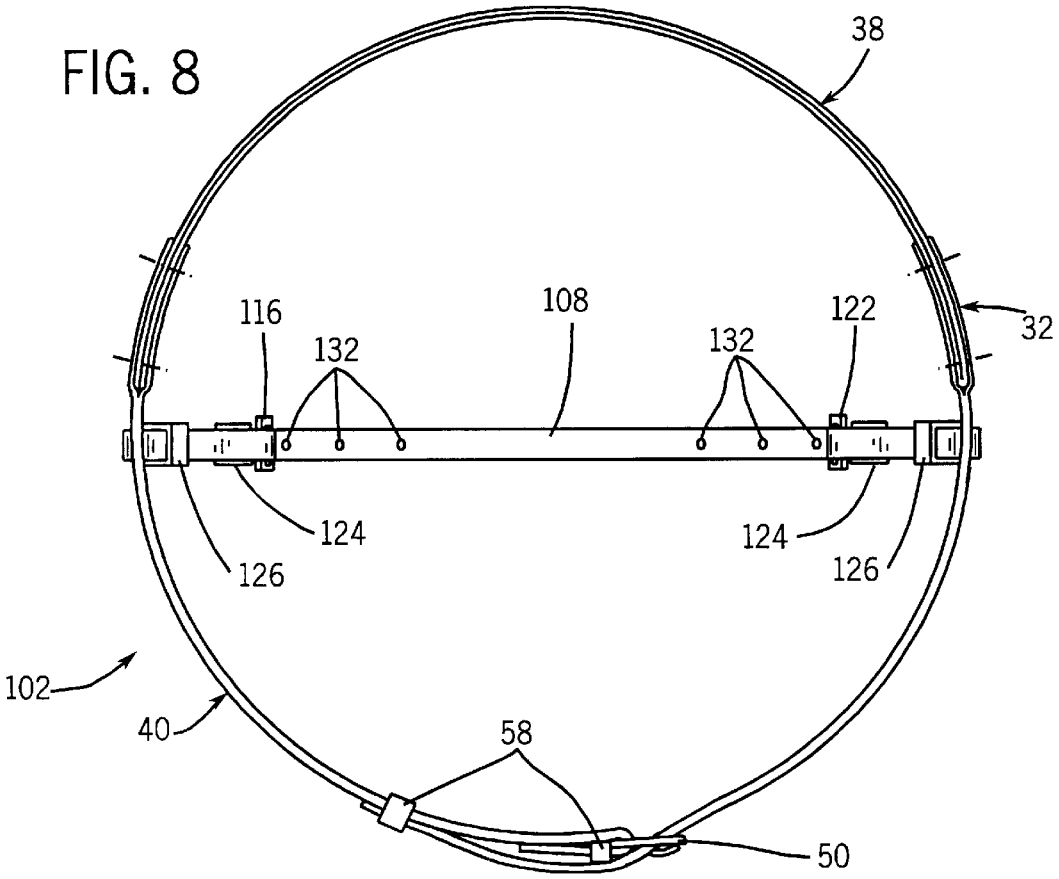
FIG. 8 is a front view of the alternate embodiment caveson shown in FIG. 7.

Referring next to FIGS. 7 and 8, a first alternate embodiment caveson is shown in which caveson 102 consists of a circular segment 32 that fits around the horse's nose and a headstall 104 which is connected to the circular segment 32 on opposite sides thereof and runs behind the horse's ears to maintain the caveson 102 in place on horse's head 36.

In this embodiment, the headstall 104 of the caveson 102 consists of three segments, a first segment 106, a second segment 108 and a third segment 110. The first segment 106 of the headstall 104 has a first end indicated generally at 112 which is looped through the elongated aperture 96 on the circular segment 32 and stitched directly onto itself, and a second, opposite end indicated generally at 114 which is connected to a first buckle 116 or similar mechanism for removably fastening the first segment 106 to the second segment 108.

Likewise, the third segment 110 has a first end indicated generally at 118 which is looped through the elongated aperture 98 on the circular segment 32 and stitched directly onto itself, and a second, opposite end indicated generally at 120 which is connected to a second buckle 122 or similar mechanism for removably fastening the third segment 110 to the second segment 108. Both the first segment 106 and the third segment 110 are provided with first buckle loops 124 located close to buckles 116 and 122 respectively for retaining the second segment 108 in place. In addition, both the first segment 106 and the third segment 110 are provided with second buckle loops 126 located a distance away from buckles 116 and 122 respectively for further retaining the second segment 108 in position.

The second segment 108 has a first end indicated generally at 128 and a second end indicated generally at 130. Ends 128 and 130 each contain a series of regularly spaced apertures 132 for receiving buckles 116 and 122 respectively when the caveson 102 is fastened onto the horse's head 36. The relative lengths of each of the segments 106, 108 and 110 is such that when buckles 116 and 122 are fastened, buckle 116 will be located on the right side of the horse's head 36 and buckle 122 will be located on the left side of the horse's head 36.

Figure 10:
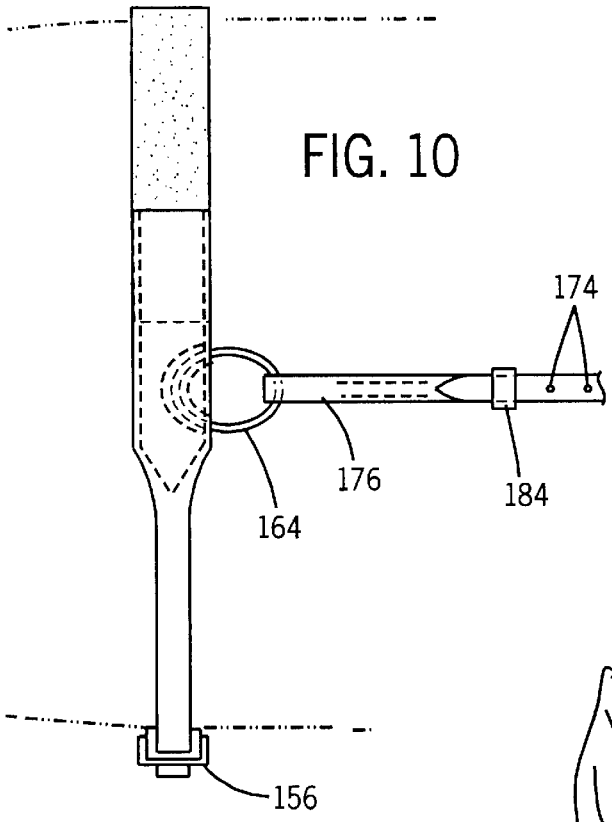
FIG. 10 is a side view of a portion of the caveson illustrated in FIG. 9, showing the connection of the noseband to the jaw strap which forms the circular segment, and also showing the connection of the headstall to the circular segment.
Figure 9:
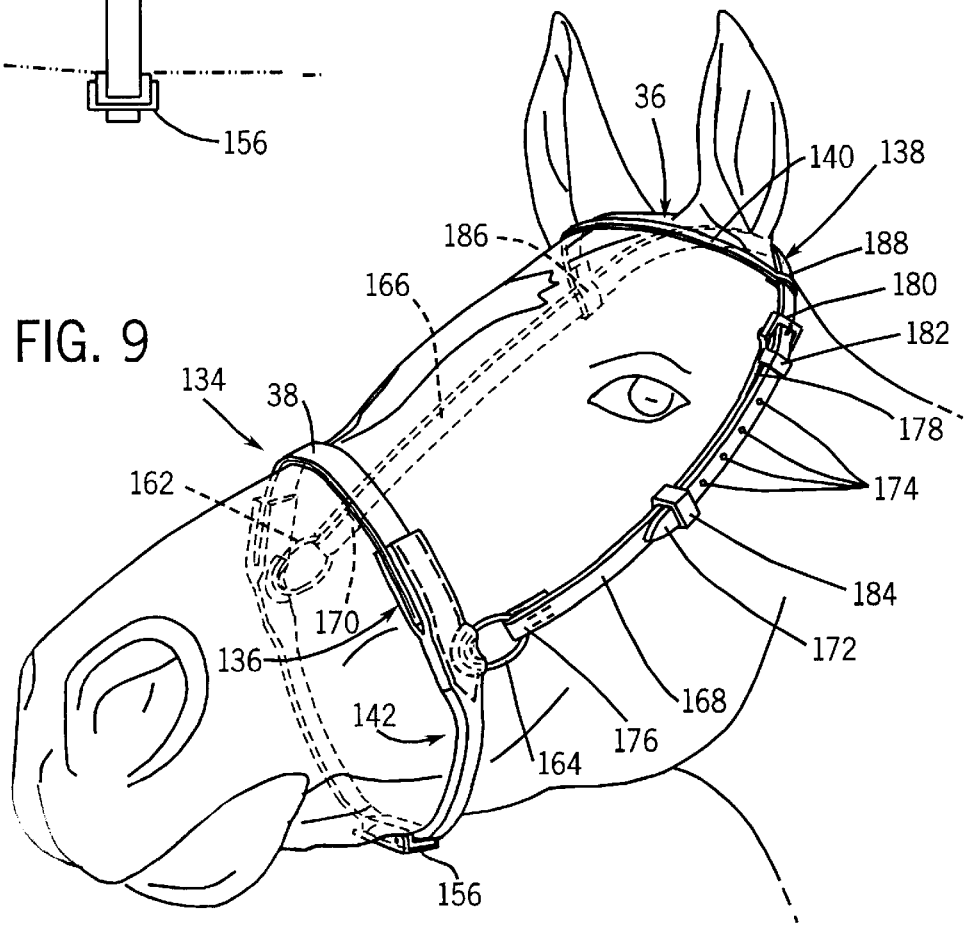
FIG. 9 is a perspective view of a horse wearing a second alternate embodiment caveson, which includes a crown piece.
Figure 11:
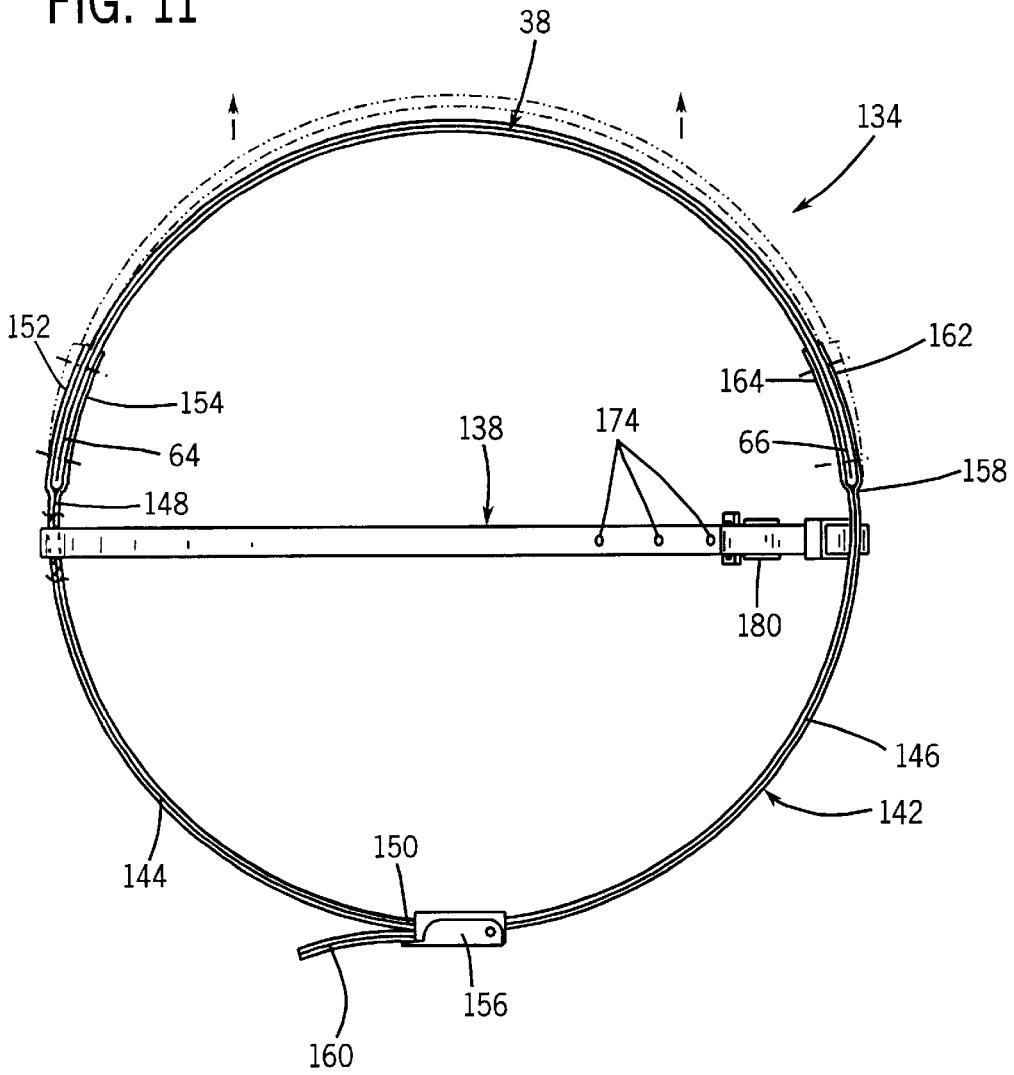
FIG. 11 is a front view of the caveson illustrated in FIGS. 9 and 10.

Referring next to FIGS. 9 through 11, a second alternate embodiment is shown in which a caveson 134 is provided consisting of a circular segment 136 that fits around the horse's nose, a headstall 138 which is connected to the circular segment 136 on opposite sides thereof and runs behind the horse's ears to maintain the caveson 134 in place on the horse's head 36, and a crown piece 140 which is connected to the headstall 138 on opposite sides of the horse's head 36, running along the forehead of the horse.

As best illustrated in FIG. 11, the circular segment 136 consists of a noseband 38 and a jaw strap indicated generally at 142. In this embodiment, the jaw strap 142 consists of two segments, a first segment 144 and a second segment 146. The first segment 144 has a first end indicated generally at 148, and a second, opposite end indicated generally at 150. The first end 148 of the first segment 144 is split into two layers, namely a first layer 152 and a second layer 154. The first end 64 of the noseband 38 is attached to the jaw strap 142 by inserting end 64 between layers 152 and 154 of the first segment 144 and the resulting joint is stitched or otherwise permanently joined together in a manner known to those skilled in the art. The second end 150 of the first segment 144 is connected to a friction-lock buckle 156 or similar mechanism for removably fastening the first segment 144 to the second segment 146 and for adjusting the size of circular segment 136.

Likewise, the second segment 146 has a first end indicated generally at 158, and a second, opposite end indicated generally at 160. The first end 158 of the second segment 146 is split into two layers, namely a first layer 162 and a second layer 164. The second end 66 of the noseband 38 is attached to the jaw strap 142 by inserting end 66 between layers 162 and 164 of the second segment 146 and the resulting joint is stitched or otherwise permanently joined together in a manner known to those skilled in the art. The second end 160 of the second segment 146 will be fed through the friction-lock buckle 156 when the caveson is fastened onto the horse's head 36. It will be appreciated by those skilled in the art that any appropriate fastening mechanism may be used to adjust the size of the circular segment 136 in place of the friction-lock buckle 156.

As best illustrated in FIGS. 9 and 10, the circular segment 136 is provided with a first metal ring 162 and a second metal ring 164 located on opposite sides of the circular segment 136. The first metal ring 162 is attached to the first segment 144 of the jaw strap 142 near the first end 148 by stitching or otherwise permanently joining in a manner known to those skilled in the art the first metal ring 162 to the jaw strap 142. The first metal ring 162 is joined to the jaw strap 142 in a manner such that the first metal ring 162 is only partially sewn into the jaw strap 142, as shown in FIG. 10.

Likewise, the second metal ring 164 is attached to the second segment 146 of the jaw strap 142 near the first end 158 by stitching or otherwise permanently joining in a manner known to those skilled in the art the second metal ring 164 to the jaw strap 142. The second metal ring 164 is joined to the jaw strap 142 in a manner such that the metal ring is only partially sewn into the jaw strap 142, shown in FIG. 10. Note that the metal rings 162 and 164 are located on opposite sides of the circular segment 136, and will be respectively located on the right and left sides of the horse's head 36 when the caveson 134 is installed thereupon.

FIGS. 9 and 10 illustrate detailed views of the caveson 134 of the present invention showing the connection of the headstall 138 to the circular segment 136. The headstall 138 consists of two segments, a first segment 166 and a second segment 168. The first segment 166 has a first end indicated generally at 170 and a second, opposite end indicated generally at 172 which contains a series of regularly spaced apertures 174. The first end 170 of the first segment 166 is connected to the first metal ring 162 on the circular segment 136 located on the right side of the nose of the horse's head 36 by inserting the first end 170 through the first metal ring 162 and stitching or otherwise permanently joining the first end 170 directly onto itself, forming a loop.

The second segment 168 of the headstall 138 has a first end indicated generally at 176 and a second, opposite end indicated generally at 178 which is connected to a buckle 180 or similar mechanism for removably fastening the first segment 166 to the second segment 168. The first end 176 of the second segment 168 is connected to the second metal ring 164 on the circular segment 136 located on the left side of the nose of the horse's head 36 by inserting the first end 176 through the second metal ring 164 and stitching or otherwise permanently joining the first end 176 directly onto itself, forming a loop. The second segment 168 is further provided with a first buckle loop 182 located close to the buckle 180 and a second buckle loop 184 located a distance away from the buckle 180 for retaining the first segment 166 when the headstall 138 is fastened into place.

As best illustrated in FIG. 9, the crown piece 140 has a first end 186 indicated generally at and a second end indicated generally at 188 which are connected to the headstall 138 on opposite sides of the horse's forehead. The first end 186 is looped around the first segment 166 of the headstall 138 at a location that will be located on the right side of the horse's head 36 immediately in front of the ears and stitched or otherwise permanently joined directly onto itself. Likewise, the second end 188 is looped around the first segment 166 of the headstall 138 at a location that will be located on the left side of the horse's head 36 immediately in front of the horse's ears and stitched or otherwise permanently joined onto itself. The positions of the ends 186 and 188 of the crown piece 140 may be slidably adjusted on the first segment 166 of the headstall 138.

Referring next to FIGS. 12 through 17, a third alternate embodiment is shown in which a caveson 190 is provided consisting of a first circular segment 192 that fits around the horse's nose, a second circular segment 194 that connects to the first circular segment 192 and fits around the horse's nose at a point closer to the mouth of the horse than the first circular segment 192, and a headstall 196 that is connected to the first circular segment 192 on opposite sides thereof and runs behind the horse's ears to maintain the caveson 190 in place on horse's head 36.

The first circular segment 192 of the caveson 190 consists of a noseband 198 that runs over the nasal bone of the horse and a jaw strap indicated generally at 200 that makes up the lower portion of the first circular segment 192.

Figure 13:
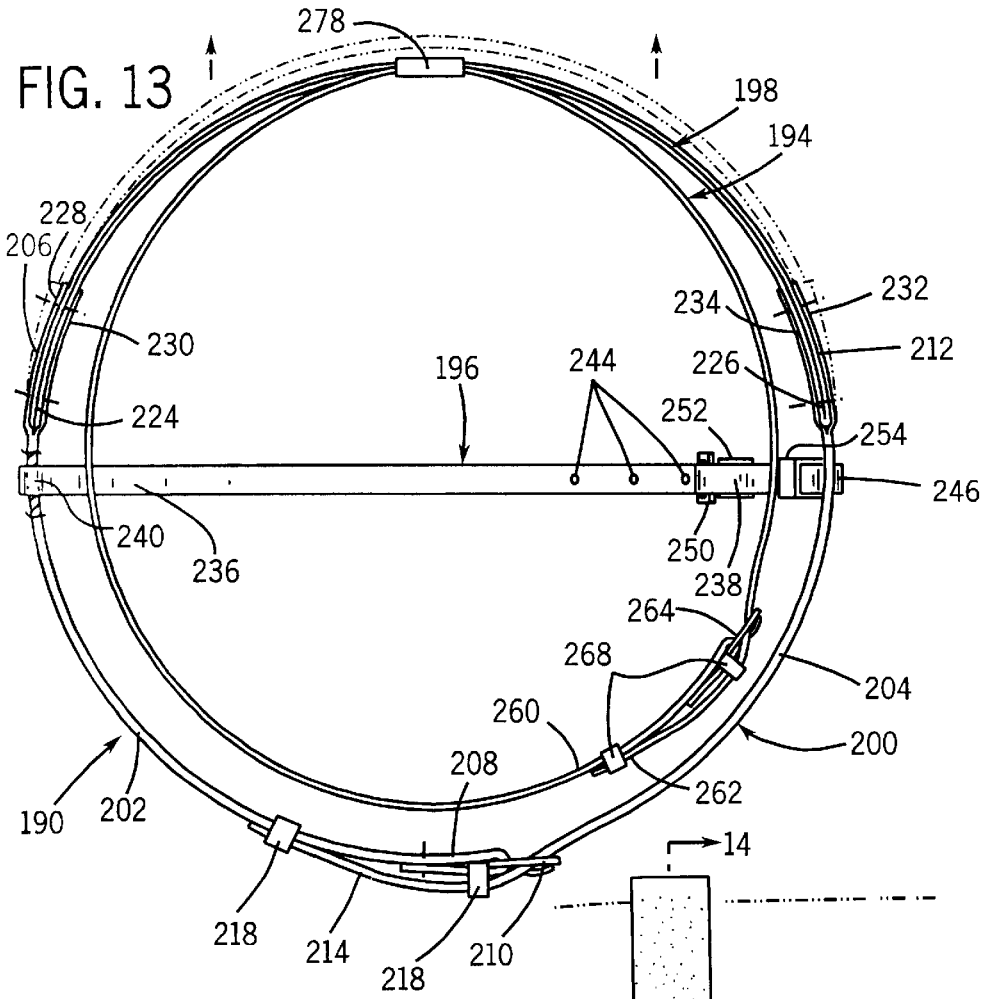
FIG. 13 is a front view of the third alternate embodiment shown in FIG. 12.

As best illustrated in FIGS. 12 and 13, the jaw strap 200 of the caveson 190 is used to adjust the size of the first circular segment 192, to accommodate different size horse noses, and to vary the amount of pressure to be applied to the horse's nose. The jaw strap 200 consists of two segments, a first segment 202 and a second segment 204. The first segment 202 has a first end indicated generally at 206 which is attached to the noseband 198, and a second, opposite end indicated generally at 208 which is connected to a buckle 210 or similar mechanism for removably fastening the first segment 202 to the second segment 204. The second segment 204 has a first end indicated generally at 212 which is attached to the noseband 198, and a second, opposite end indicated generally at 214 which contains a series of regularly spaced apertures 216 (best shown in FIGS. 12 and 15) which will receive the buckle 210.

FIG. 13 best illustrates the manner in which the first segment 202 is provided with buckle loops 218 located close to the buckle 210 for retaining the second end 214 of the second segment 204 after the jaw strap 210 has been buckled into place. The relative length of each of the segments 202 and 204 of the jaw strap 200 is such that when the buckle 210 is fastened, it is located on the underside of the horse's nose.

Referring for the moment to FIG. 14, the noseband 198 consists of a first layer 220 and a second layer 222 of a resilient material of identical width and length, stitched or otherwise joined together permanently in a manner known to those skilled in the art, forming a single reinforced band of resilient material. The noseband 198 has a first end indicated generally at 224 and a second, opposing end indicated generally at 226, in which ends 224 and 226 are used to connect the noseband 198 to the jaw strap 200. In an alternate embodiment, one or more layers of the noseband 198 may be constructed of a material that is not only elastic but also is soft and conforms to the shape of the horse's nose at the points of contact.

In accordance with this embodiment, the noseband 198 is connected to the jaw strap 200, forming the first circular segment 192 (shown in FIGS. 12 and 13). FIG. 14 also illustrates a detailed view of the connection of the noseband 198 to the jaw strap 200 of this embodiment. The first end 206 of the first segment 202 of the jaw strap 200 is split into two layers, namely a first layer 228 and a second layer 230. The first end 224 of the noseband 198 is inserted between the first layer 228 and the second layer 230, and the resulting joint is stitched or otherwise permanently joined together in a manner known to those skilled in the art.

Likewise, the second end 212 of the second segment 204 of the jaw strap 200 is split into two layers, namely a first layer 232 and a second layer 234. The second end 226 of the noseband 198 is inserted between the first layer 232 and the second layer 234, and the resulting joint is stitched or otherwise permanently joined together in a manner known to those skilled in the art. In this embodiment, the jaw strap 200 is constructed of leather, although it could instead be made of any other appropriate material that either has two layers or may be split into two layers as previously described. It will, at once, be appreciated by those skilled in the art that the jaw strap 200 may instead be constructed of one or more layers of resilient material, nylon, rope or any other appropriate material and connected to the noseband 198 to form the first circular segment 192 by stitching or in any other manner known to those skilled in the art.

Referring again to FIGS. 12 and 13, the headstall 196 consists of two segments, a first segment 236 and a second segment 238. The first segment 236 has a first end indicated generally at 240 which is attached to the first circular segment 192 on the side thereof which will be located on the right side of the nose of the horse's head 36, and a second, opposite end indicated generally at 242 which contains a series of regularly spaced apertures 244. The second segment 238 has a first end indicated generally at 246 which is attached to the first circular segment 192 on the side thereof which will be located on the left side of the nose of the horse's head 36, and a second, opposite end indicated generally at 248 which is connected to a buckle 250 or similar mechanism for removably fastening the first segment 236 to the second segment 238. The apertures 244 will receive the buckle 250 when the headstall 196 is fastened onto the horse's head 36.

FIG. 12 illustrates the manner in which the second segment 238 of the caveson 190 is provided with a first buckle loop 252 located close to the buckle 250 for retaining the second end 242 of the first segment 236, and a second buckle loop 254 located a distance away from the buckle 250 for further retaining the first segment 236 when the headstall 196 is fastened in place. The relative length of each of the segments 236 and 238 is such that when the buckle 250 is fastened, the buckle 250 will rest on the side of the horse's head 36.

Figure 15:
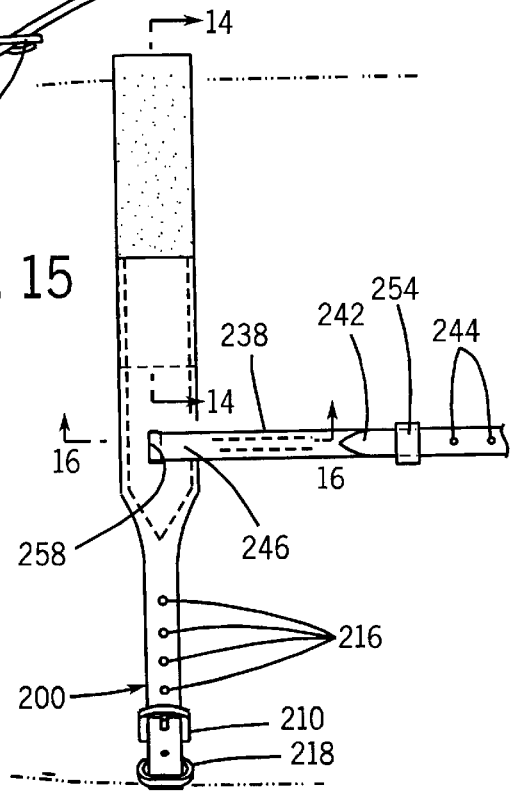
FIG. 15 is a side view of a portion of the caveson illustrated in FIGS. 12 through 14, showing the connection of the noseband to the jaw strap which forms the first circular segment, and also showing the connection of the headstall to the first circular segment.
Figure 16:
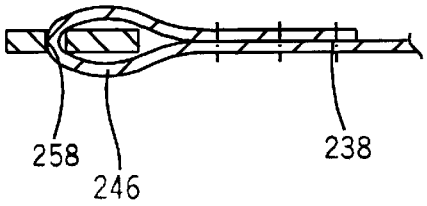
FIG. 16 is a cross-sectional view of the caveson illustrated in FIGS. 14 through 15, showing a detailed depiction of the connection of the headstall to the first circular segment.

Referring now to FIGS. 15 and 16 in addition to FIGS. 12 and 13, detailed views of portions of the caveson 190 of the present invention showing the connection of the headstall 196 to the first circular segment 192 are provided. The first segment 202 of the jaw strap 200 contains an elongated aperture 256 for receiving one end of the headstall 196. The first end 240 of the first segment 236 of the headstall 196 is looped through the elongated aperture 256 and stitched directly onto itself (as shown in FIGS. 15 and 16), or otherwise permanently joined together in a manner known to those skilled in the art.

Likewise, the second segment 204 of the jaw strap 200 contains an elongated aperture 258 for receiving the other end of the headstall 196. The first end 246 of the second segment 238 of the headstall 196 is looped through the elongated aperture 258 and stitched directly onto itself (as shown in FIGS. 15 and 16), or otherwise permanently joined together in a manner known to those skilled in the art. Note that the elongated apertures 256 and 258 are located on opposite sides of the first circular segment 192, and will be respectively located on the right and left sides of the horse's head 36 when the caveson 190 is installed thereupon. It will at once be appreciated by those skilled in the art that the headstall 196 may be connected to the first circular segment 192 as described, or alternatively, by stitching it directly to the first circular segment 192, or by any other mechanism known to those skilled in the art.

As best illustrated in FIGS. 12 and 13, the second circular segment 194 has a first end indicated generally at 260 and a second, opposite end indicated generally at 262. First end 260 is connected to a buckle 264 or similar mechanism for removably fastening the first end 260 to the second end 262. The second end 262 contains a series of regularly spaced apertures 266 (best shown in FIG. 12) which will receive the buckle 264. The first end 260 is provided with buckle loops 268 located close to the buckle 264 for retaining the second end 262 of the second circular segment is 194 in place. In this embodiment, the second circular segment 194 is constructed of leather, although it will at once be appreciated by those skilled in the art that the second circular segment 194 may instead be constructed of one or more layers of a resilient material, nylon, rope or any other appropriate material known to those skilled in the art.

FIGS. 12 and 17 illustrate how the second circular segment 194 is attached to the first circular segment 192. In this embodiment, a connecting segment 278 is provided having a first end indicated generally at 280 and a second, opposite end indicated generally at 282. Ends 280 and 282 of connecting segment 278 are inserted between the first layer 220 and the second layer 222 of the noseband 198 and the resulting joint is stitched or otherwise permanently joined together in a manner known to those skilled in the art, forming a loop with aperture 284. Note that the connecting segment 278 is attached to the first circular segment 192 at a point on the noseband 198 that is directly on the topside or bridge of the horse's nose (approximately 180 degrees from the horse's chin).

As best illustrated in FIG. 12, the second circular segment 194 is attached to the first circular segment 192 by inserting the second end 262 of the second circular segment 194 through the aperture 284 created by the connecting segment 278 and the ends 260 and 262 of the second circular segment 194 are fastened together by the buckle 264.

Referring now also to FIG. 18, the third alternate embodiment of the caveson 190 is shown on the horse's head 36 located underneath a bridle 100 as would be customary when used for horse training. Note that the second circular segment 194 encircles the horse's nose around the chin and in front of the bit when the caveson 190 is installed on the horse's head 36 (as shown in FIGS. 12 and 18). It will at once be appreciated by those skilled in the art that the second circular segment 194 may instead be directly connected to the first circular segment 192 at a point on the noseband 198 that is directly at the bridge of the horse's nose (approximately 180 degrees from the horse's chin) by stitching or in any other manner known to those skilled in the art.

Figure 19:
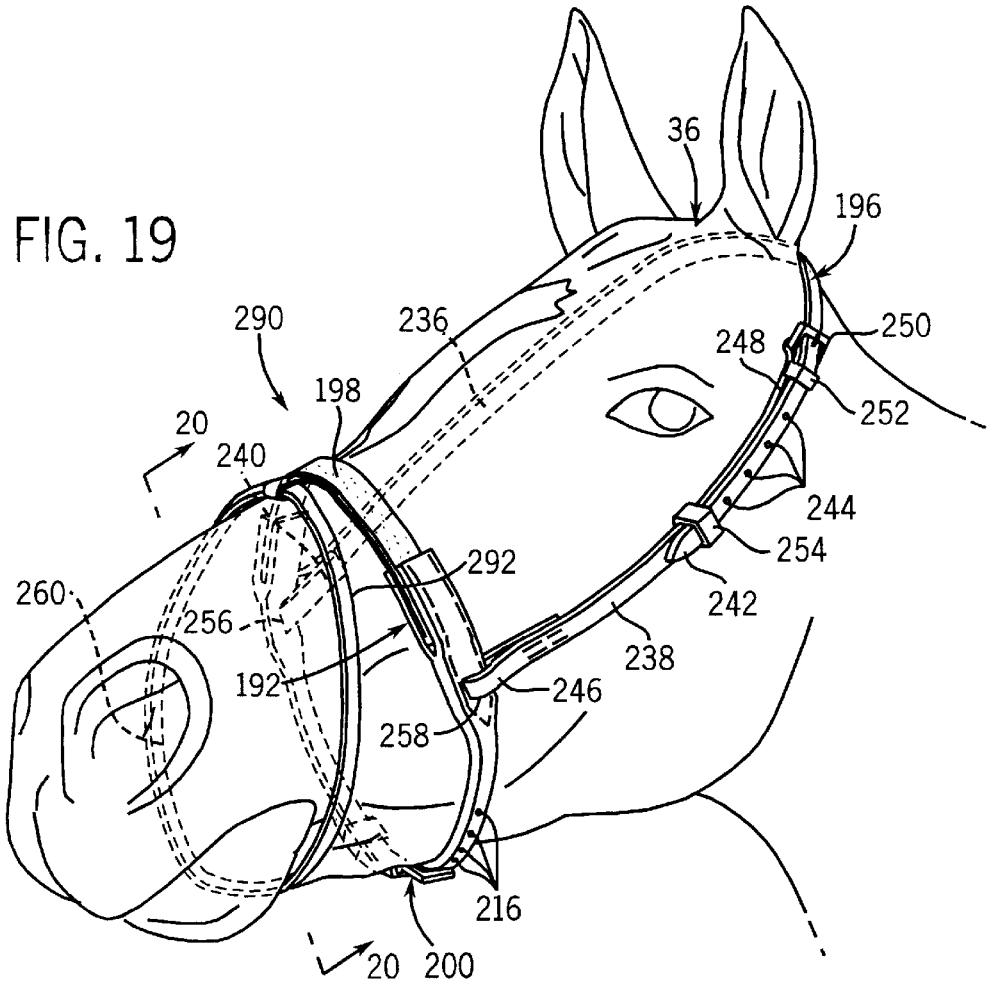
FIG. 19 is a perspective view of a horse wearing a fourth alternate embodiment caveson, which includes a second circular segment without a buckle.
Figure 20:
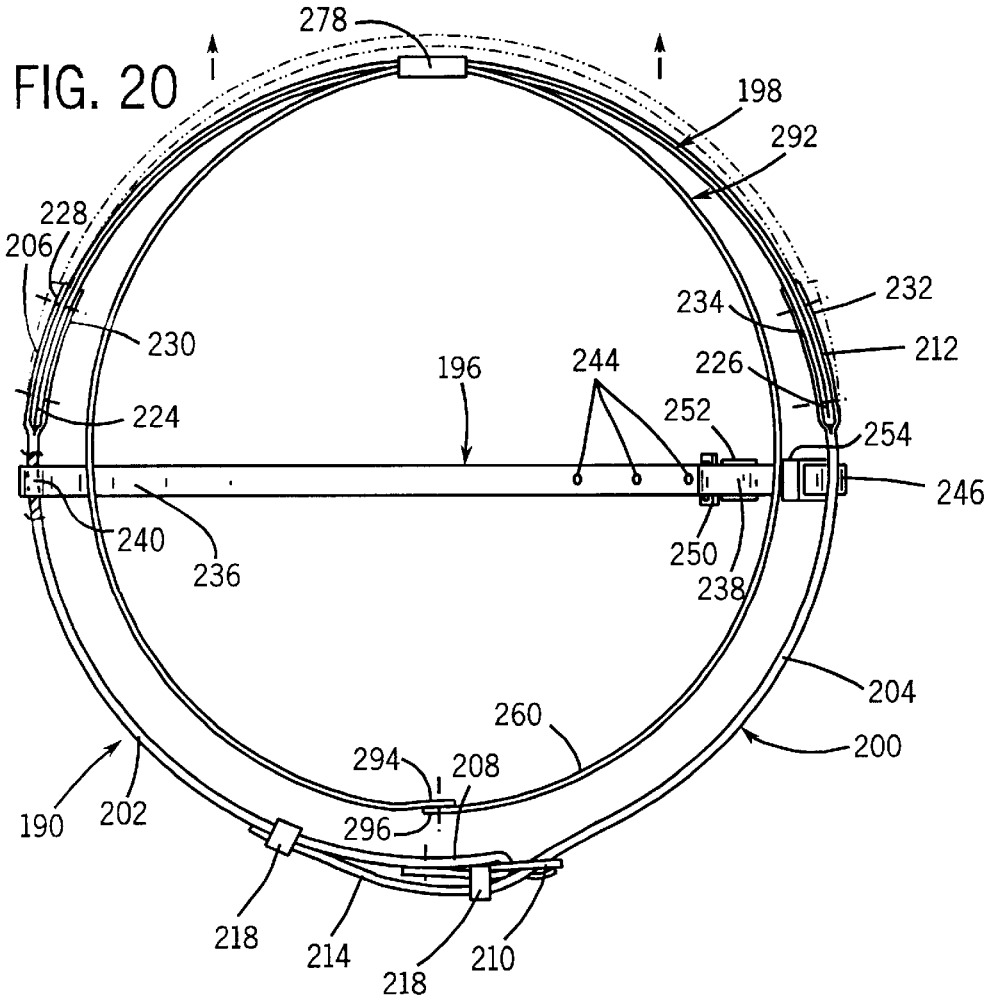
FIG. 20 is a front view of the fourth alternate embodiment shown in FIG. 19.

Referring next to FIGS. 19 and 20, a fourth alternate embodiment is shown in which a caveson 290 is provided consisting of a first circular segment 192 that fits around the horse's nose, a second circular section 292 that connects to the first circular segment 192 and fits around the horse's nose at a point closer to the mouth of the horse than the first circular segment 192, and a headstall 196 that is connected to the first circular segment 192 on opposite sides thereof and runs behind the horse's ears to maintain the caveson 190 in place on horse's head 36.

Note that in this embodiment, the first circular segment 192 and headstall 196 of caveson 290 are constructed in the manner described for the third alternate embodiment. Likewise, the noseband 198 of the first circular segment 192 is provided with connecting segment 278 in the manner previously described, which forms a loop with aperture 284 located at a point on the noseband 198 that is directly at the bridge of the horse's nose (approximately 180 degrees from the horse's chin).

Referring now to FIG. 20, the second circular segment 292 has a first end indicated generally at 294 and a second, opposite end indicated generally at 296. The second circular segment 292 is attached to the first circular segment 192 by inserting the end 294 of the second circular segment 292 through the aperture 284 created by the connecting segment 278 and ends 294 and 296 of second circular segment 292 are stitched together or otherwise joined in a manner known to those skilled in the art. It will at once be appreciated by those skilled in the art that the second circular segment 292 may be directly connected to the first circular segment 192 by stitching or joining them together in any other manner known to those skilled in the art. Note that the second circular segment 292 may be constructed of one or more layers of a resilient material, nylon, rope or any other appropriate material known in the art.

It may therefore be appreciated from the above detailed description of the preferred embodiments of the present invention that the noseband is manufactured, at least in part, of a resilient material as described, while the material used in other components of the caveson may vary depending on the specific use or application thereof.

Figure 21:
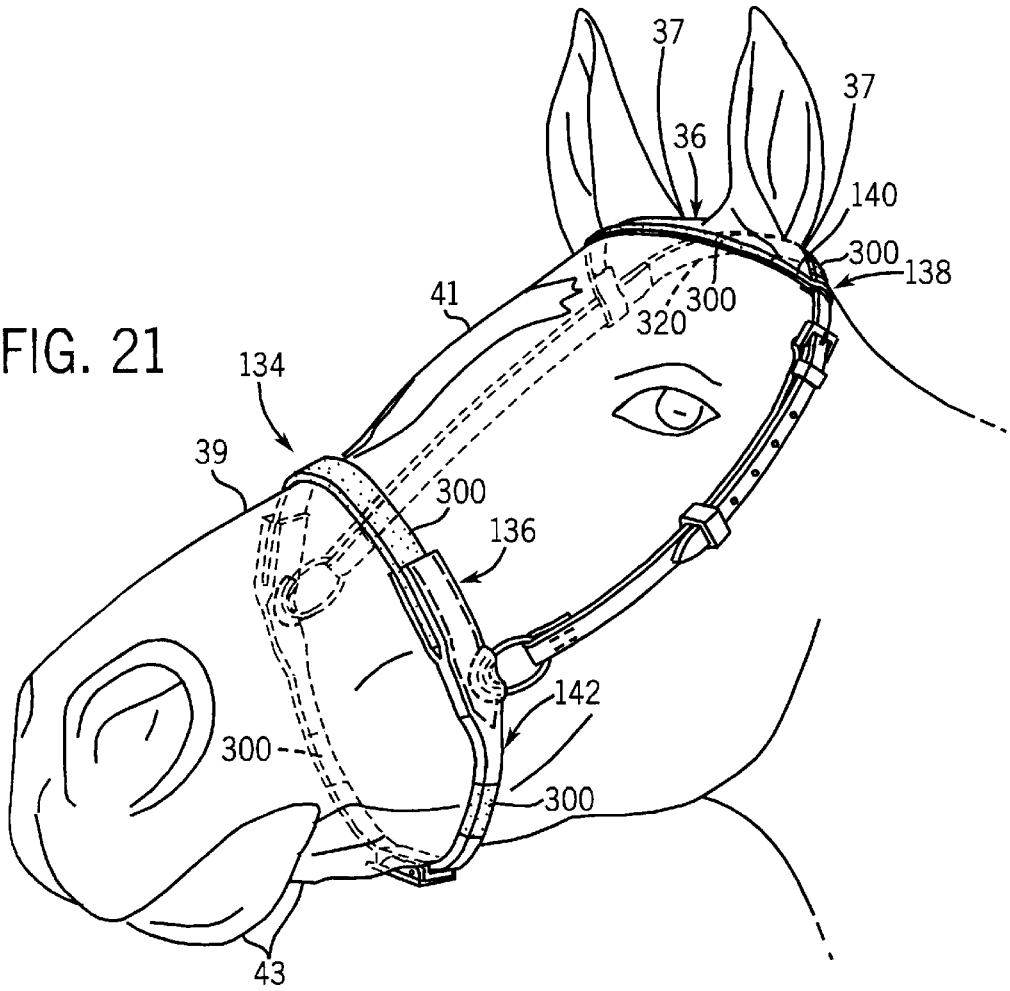
FIG. 21 is a perspective view of the caveson of FIG. 9 having one or more resilient portions, disposed at pressure points on the horse's head.

It may be appreciated that from the above detailed descriptions of the preferred caveson embodiments of the humane headgear of the present invention that the cavesons of FIGS. 1, 7, 9, 12, 18, 19 may have one or more portions constructed of a resilient material 300 disposed on a pressure point 37, 39, 41, 43, on the horse's head 36. Also the resilient material 300 may be used in other portions of the caveson, so that if the horse jerks his head back, the portions may stretch to accommodate the horse's action. For example, FIG. 21 is a perspective view of the caveson 134 of FIG. 9 having one or more portions constructed of resilient material 300 with the resilient material 300, used in part or in entirety, and disposed in the first circular segment 136 (e.g., noseband 38 and/or jaw strap 142), and/or the headstall 138 and/or on caveson crown piece 140. Those skilled in the art will appreciate that corresponding portions of the cavesons in FIGS. 1 and 7 may be similarly modified to have one or more portions constructed of resilient material 300 used in part or in entirety and disposed in the noseband and/or the headstall and/or the jaw strap and/or the caveson crown piece (if present).

Figure 22:
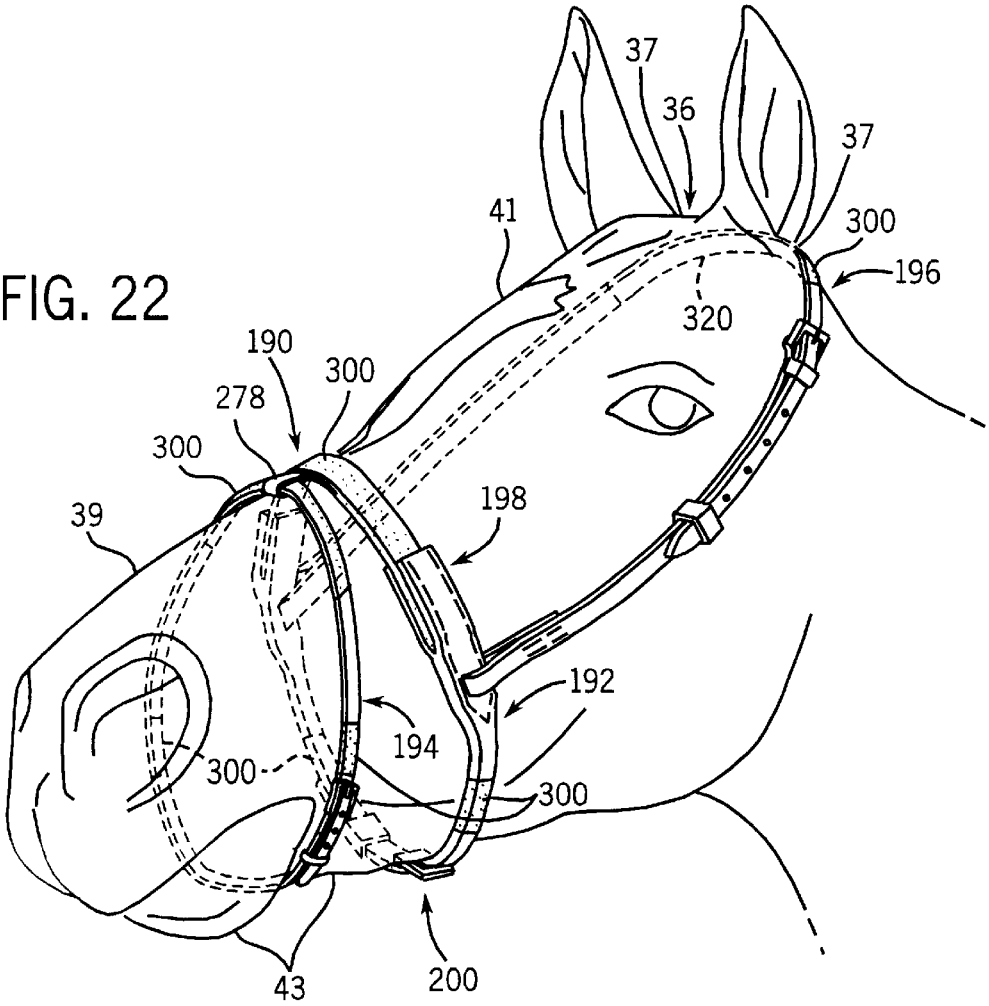
FIG. 22 is a perspective view of a horse wearing the caveson of FIG. 12, the caveson having one or more resilient portions, disposed at pressure points on a horse's head.

Likewise, the embodiments of the caveson with the second circular segment of FIGS. 12, 18, and 19 may be modified to have one or more portions constructed of resilient material 300 disposed in the first circular segment (e.g., the noseband and/or the jaw strap) and/or the headstall and/or the second circular segment (flash) and/or the caveson crown piece (if present). For example, FIG. 22 is a perspective view of a horse wearing the caveson 190 of FIG. 12 having one or more portions of resilient material 300 disposed in the first circular segment 192 (e.g., the jaw strap 200 and/or noseband 198), and/or the headstall 196 and/or the second circular segment 194. The caveson with second circular segment 194 is commonly used in dressage. Each of the aforementioned portions 192, 196, 194 of the caveson has a length. The resilient material preferably extends from 1% to 100% of a length of the portion of the caveson to which it is incorporated. Preferably the resilient material 300 is a woven elasticized material as described herein.

The headstall 34, 104, 138, and 196 of the caveson has an intermediate portion 320 disposed on the horse's poll behind the horse's ears. The intermediate portion 320 of the headstall of the caveson can be resilient, contoured or both resilient and contoured. Preferably, for the intermediate portion 320 of the headstall of the caveson, the intermediate portion is one half inch woven elastic. Intermediate portion 320 is preferably constructed as described below for the three different embodiments of the intermediate section 320 of the crown piece of the present invention which disclosure is incorporated by reference herein. The placement on the horse's head of the intermediate portion 320 of the headstall of the cavesons 1–22 of the present invention is as shown in FIGS. 27–29.

BRIDLE EMBODIMENTS OF THE HUMANE HORSE HEADGEAR

Referring now to FIGS. 23–41, wherein like numbers refer to similar parts, the bridle of the present invention may be a single bit bridle or a double bit bridle. A double bit bridle may be formed by the use of a single bit bridle and a snaffle piece having a second bit. The single bit bridle may have an integral caveson. The double bit bridle likewise may have an integral caveson.

SINGLE BIT BRIDLE

Figure 23:
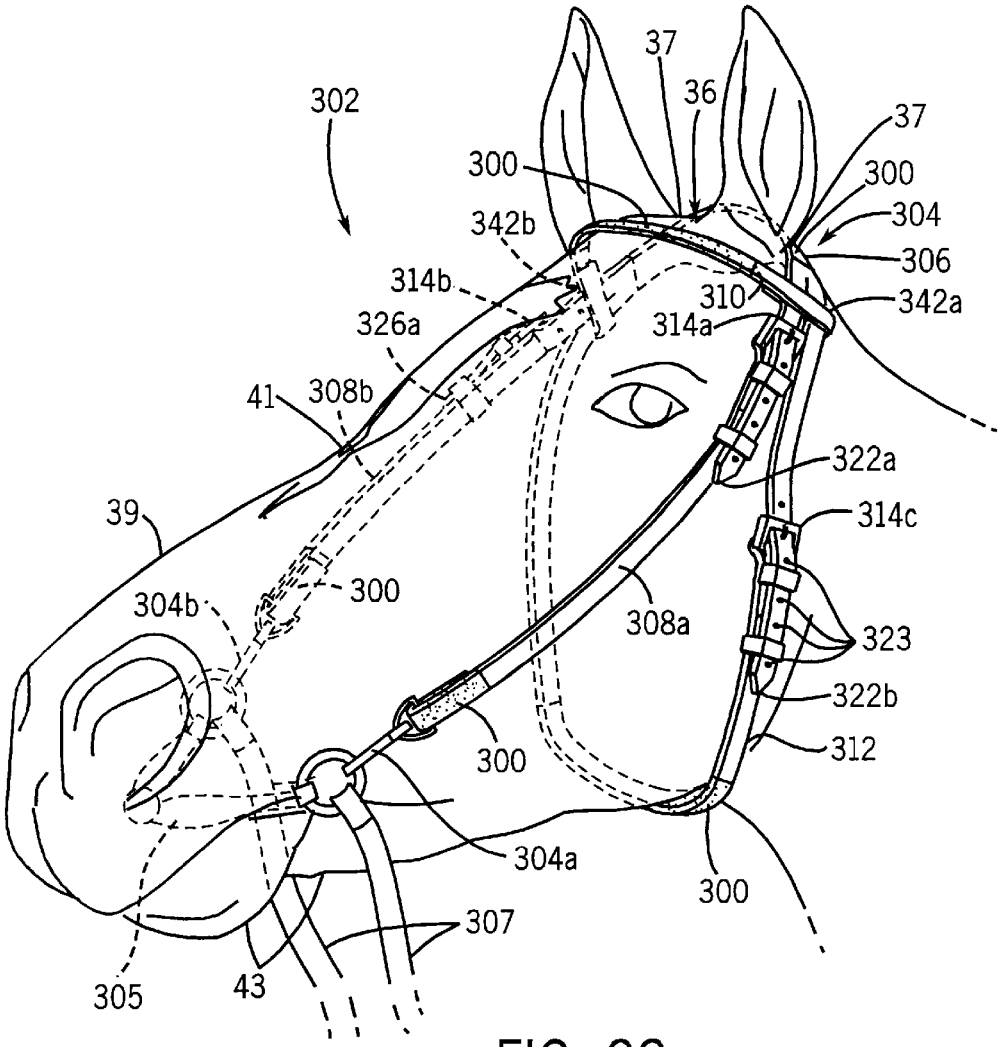
FIG. 23 is a perspective view of a horse wearing a single bit bridle constructed according to the teachings of the humane horse headgear of the present invention.
Figure 24:
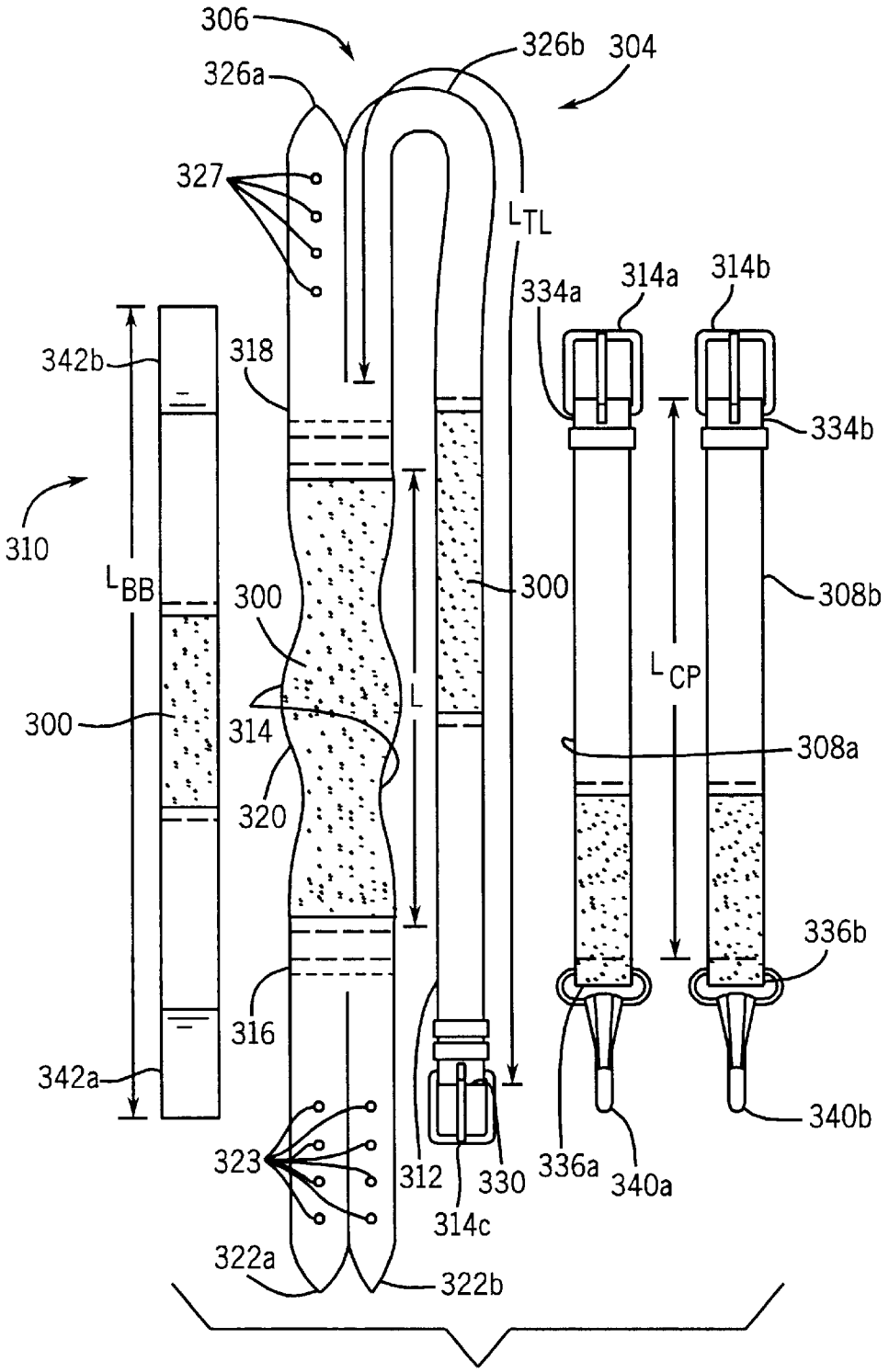
FIG. 24 is an exploded plan view of a headstall of the bridle of FIG. 23.

FIGS. 23 through 26 illustrate the preferred embodiment of a single bit bridle 302 of the humane horse headgear of the present invention. As illustrated in FIGS. 23, the single bit bridle 302 in its simplest form includes a headstall 304 and a bit 305. Reins 307 may be attached to bit 305. As shown in FIG. 23, the headstall 304 of the bridle 302 has one or more portions encircling and conforming to the horse's head 36. The headstall 304 of the bridle 302, as shown in FIG. 24 in plan view of each portion, includes a crown piece 306, a pair of cheek pieces 308 (308*a*, 308*b*), a brow band 310, and a throat latch 312. The crown piece 306 is fastened to the cheek pieces 308 and to the throat latch 312 by fastening means having a fastener 314 (314*a*, 314*b*, 314*c*) (also adjustment mechanisms, or adjustable fasteners) mating with a portion for engaging the fastener 314. The adjustable fastener 314 may include a buckle, a snap, a hook, VELCRO® strips, or other fastener 314 known in the art of horse headgear. In the preferred embodiment, the fastener 314 used is a buckle.

The crown piece 306 is a strip of one or more materials having a first end 316, an opposite second end 318 and an intermediate portion 320 disposed between the first end 316 and the second end 318. The first end 316 and second end 318 are each split opposite the intermediate portion 320. The first end 316 is split or divided into one or more first end segments 322 (322*a*, 322*b*, . . . ). In this preferred embodiment, a plurality of first end segments 322 are created. Each of the first end segments 322 has a portion 323, for engaging adjustable fastener 314.

The second end 318 is split or divided into one or more second end segments 326. In this embodiment a plurality of second and segments are created (326*a*, 326*b*, . . . ). At least one of the second end segments 326 has a portion 327, for engaging the fastener 314*a* associated with a cheek piece 308*a*.

Where the fastener 314 is a buckle or hook, the portion 323, 327 for engaging the fastener 314 is one or more spaced holes (apertures) which allow for adjustable attachment to the fastener 314. If the fastener 314 is a snap, the portion 323, 327 for engaging the fastener is a mating part of the snap; if the fastener 314 is a VELCRO® strip, the portion 323, 327 is a mating part of the VELCRO® strip.

Preferably, one of the plurality of second end segments 326*b* is is extended to a length sufficient to form the throat latch 312, which is preferably integral with crown piece 306. The throat latch 312 has an end 330 to which an adjustable fastener 314*c*, such as a buckle, is attached. Adjustable coupling of the throat latch 312 to the second end segment 322*b* is done by engaging the fastener 314*c* to portion 327 on the second segment 322*b*. Alternatively, as is known in the art, the throat latch 312 may be a separate strip of material having opposite ends with a fastener 314 on each end for releasably attaching to first end 316 and to the second end 318, and with the crown piece modified so as not to have the integral throat latch but rather having a second end segment 326*b* with a portion 327 for adjustably engaging the fastener 314 to throat latch 312. Yet alternately, as is known in the art, the throat latch 312 may be a separate strip of material having opposite ends, with each opposite end having a portion 323 for adjustably engaging a fastener 314. The crown piece is modified so as not to have the integral throat latch 312, but rather to have the first end 316 and the second end 318 each having an adjustable fastener 314 on one of the end segments 322 and 326 for adjustable engagement with the corresponding portion 323 on the opposite ends of the throat latch 312.

The throat latch 312 is connected to, or attached to, or extends from the crown piece 306, the one or more pairs of cheek pieces 308 and the brow band 310. The throat latch 312 is disposed under the horse's jowl.

Best shown in FIG. 23, the pair of the cheek pieces 308*a*, 308*b* extend from or are attached to or are connected to the crown piece 306. Each cheek piece 308*a*, 308*b* is a strip of material having a pair of opposite ends 334, 336. One end 334*a*, 334*b* of each cheek piece 308*a*, 308*b* is attached to an adjustable fastener 314, such as a buckle. Each opposite end 336*a*, 336*b* bears a bit attachment 340 (340*a*, 340*b*) for attaching bit 305 to the headstall 304 of the bridle 302. As is known in the art, the bit attachment 340 may be a clip enabling flexibility in the selection of bits 305 for use with the bridle 302.

One cheek piece of the pair of the cheek pieces 308*a*, 308*b* is disposed on an opposite cheek on a horse's face.

Thus cheek piece 308*b* is adjustably fastened by fastener 314*a* to second end segment 326*a*. Cheek piece 308*a* is adjustably fastened by fastener 314*b* to first end segment 322*a*.

The brow band 310 is a strip of material having opposite ends coupled to the crown piece 306. Typically the opposite ends form loops 342*a*, 342*b* through which the crown piece 306 slides. The loops are stitched or otherwise affixed in place as is known in the art. The brow band 310 is disposed in front of the horse's ears and above the horse's eyes on the horse's brow.

Best shown in FIGS. 23, 24 and 25, the intermediate portion 320 of the crown piece 308 of the humane horse headgear of the present invention is constructed preferably in part or in entirety of a resilient material 300. This construction allows the crown piece 306 to yield slightly in response to the movement of the horse's head. The portion constructed of resilient material 300 extends from 1% to 100% of a length "L" of the intermediate portion 320.

Preferably the intermediate portion 320 of the crown piece 306 is contoured, as shown in FIGS. 23, 24 and 26 and which will be described in detail in association with FIGS. 46 and 47. A contoured intermediate portion 314 is advantageously shaped to provide a load-bearing surface disposed on the poll of the horse. The contoured intermediate portion preferably has the length, L of the intermediate portion 320. In FIG. 26, the intermediate portion 320 is integral with first end 316 and second end 318.

Most preferably as shown in FIGS. 23 and 24, the crown piece 306 is a contoured crown piece with the intermediate portion 320 both being contoured and having a portion constructed of a resilient material, such as a woven elasticized material. The resilient portion of the contoured crown piece extends from 1% to 100% of a length of the L intermediate portion 320. The contoured portion of the crown piece including the most preferred embodiment will be discussed later under the section "Contoured Crown Piece Embodiments of the Humane Horse Headgear" which description is incorporated by reference herein. The intermediate portion 320 of the crown piece is disposed on an area on the top of the horse's head behind the horse's ears, shown in FIGS. 27–29.

Alternatively the bridle 302 has one or more resilient materials 300 in the crown piece 306 and/or the pair of cheek pieces 308*a*, 308*b* and/or the throat latch 312 and/or the brow band 310. The resilient material 300, extends from 1% to 100% of a length of each of the aforementioned portions 306 (L), 308*a* ($L_{CP}$), 308*b* ($L_{CP}$), 312 ($L_{TL}$), 310 ($L_{BB}$) of the headstall 304 of bridle 302. Preferably the resilient material 300 is an elasticized material, preferably a woven elasticized material and incorporated as described supra.

INTEGRAL CAVESON FOR USE WITH A SINGLE BIT BRIDLE

Figure 30:
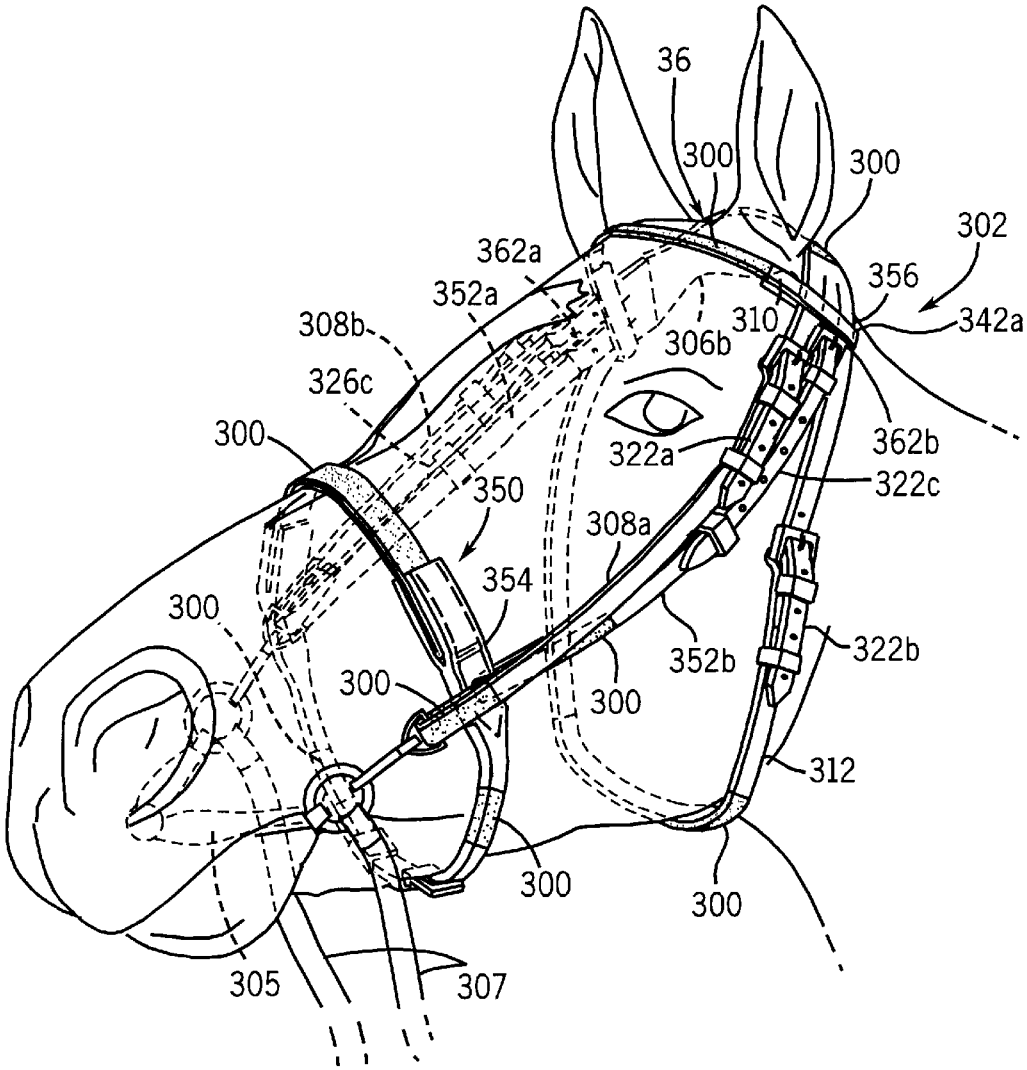
FIG. 30 is a perspective view of a horse wearing a single bit bridle with an integral caveson having a first circular segment, constructed according to the teachings of the humane horse headgear of the present invention.
Figure 31:
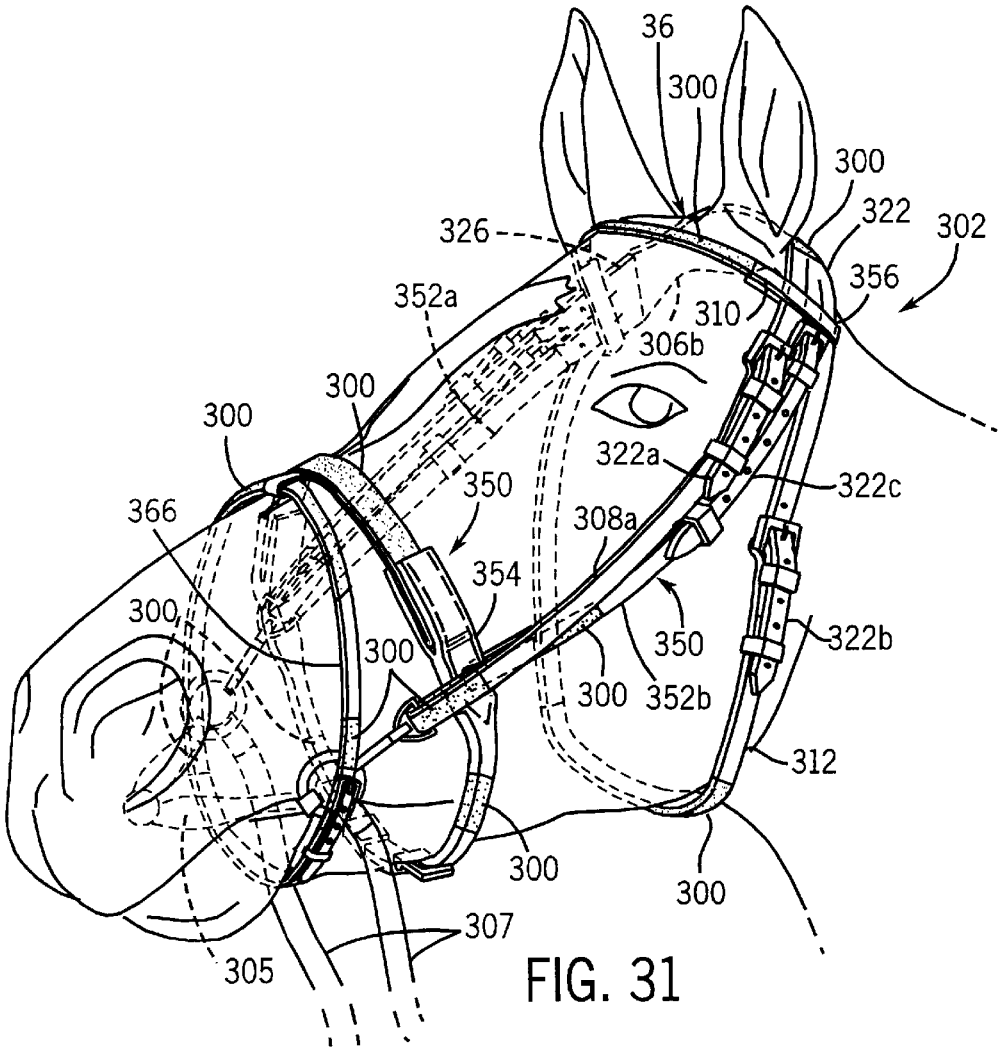
FIG. 31 is a perspective view of a horse wearing the single bit bridle with the integral caveson of FIG. 30, where the integral caveson has a second circular segment.
Figure 32:
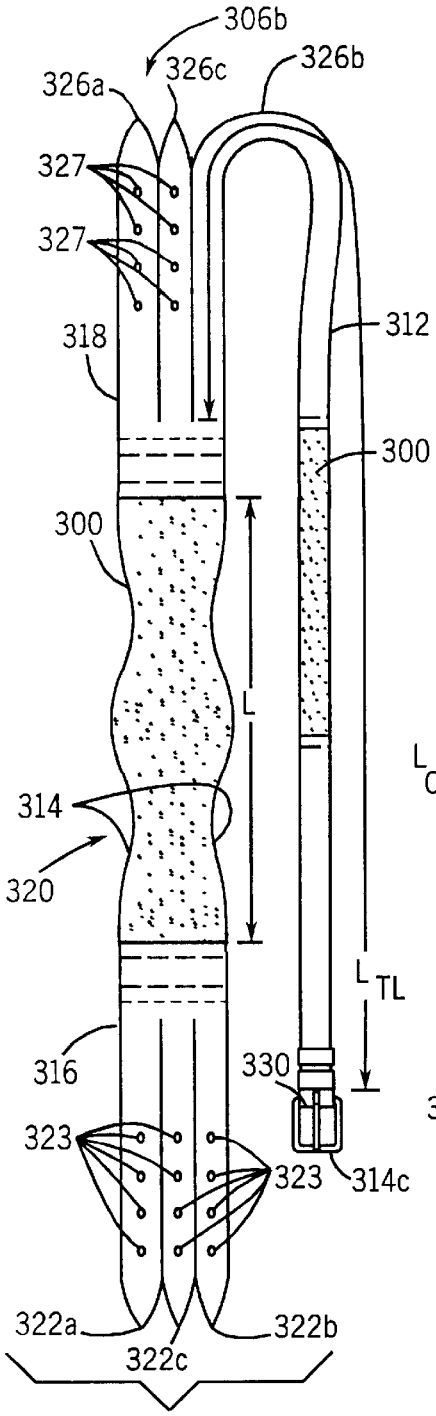
FIG. 32 is a plan view of a modified crown piece for use with the humane horse headgear of FIGS. 30, 31, 35, and 36.
Figure 33:
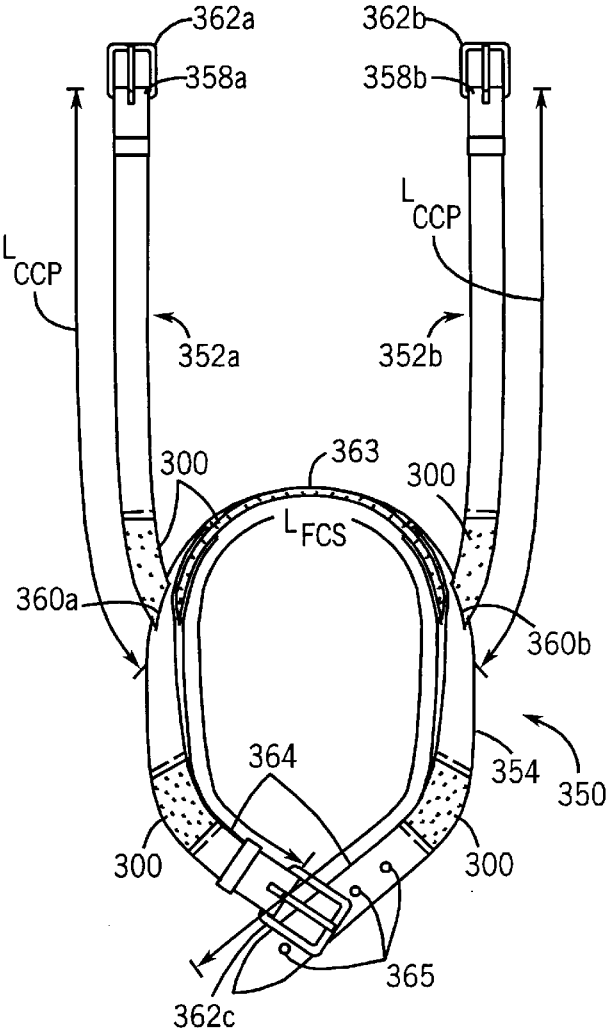
FIG. 33 is a view of the integral caveson having a first circular is segment shown in FIG. 30.
Figure 34:
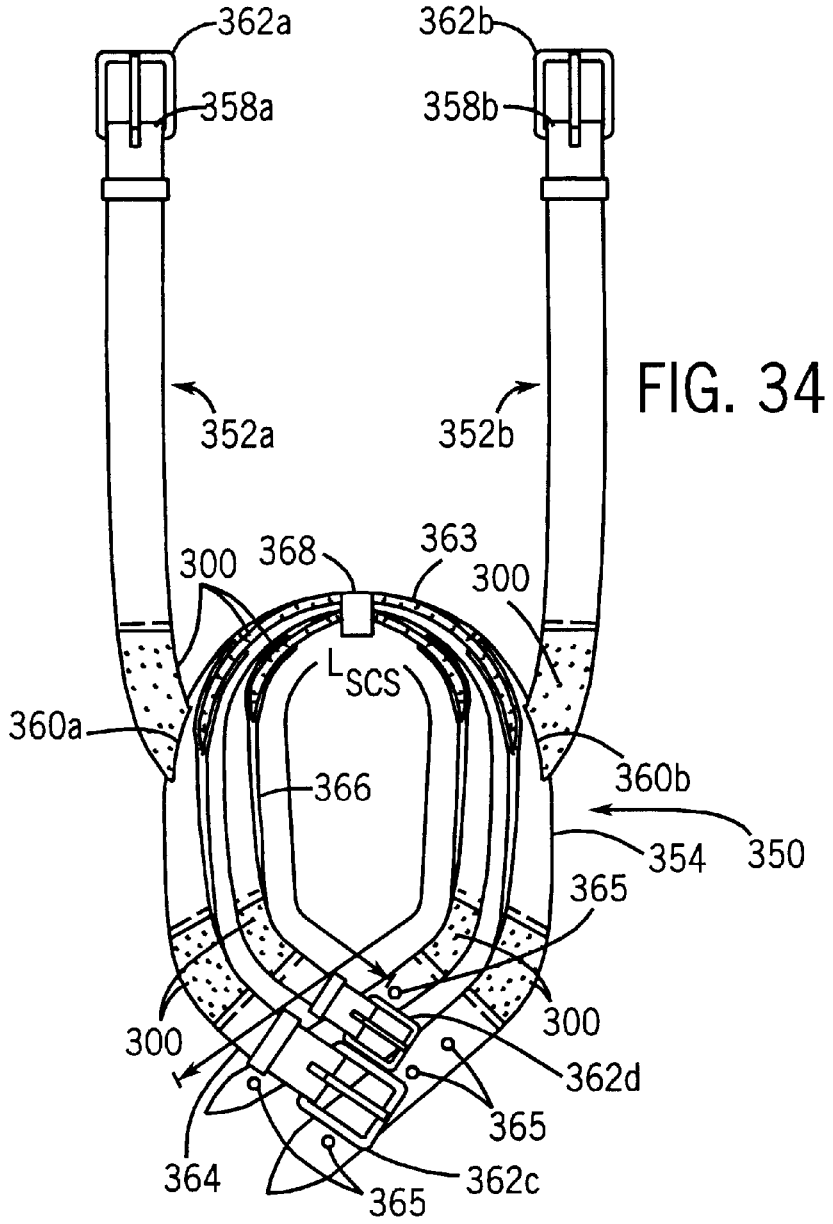
FIG. 34 is a view of the integral caveson having a first circular segment and a second circular segment shown in FIG. 31.
Figure 35:
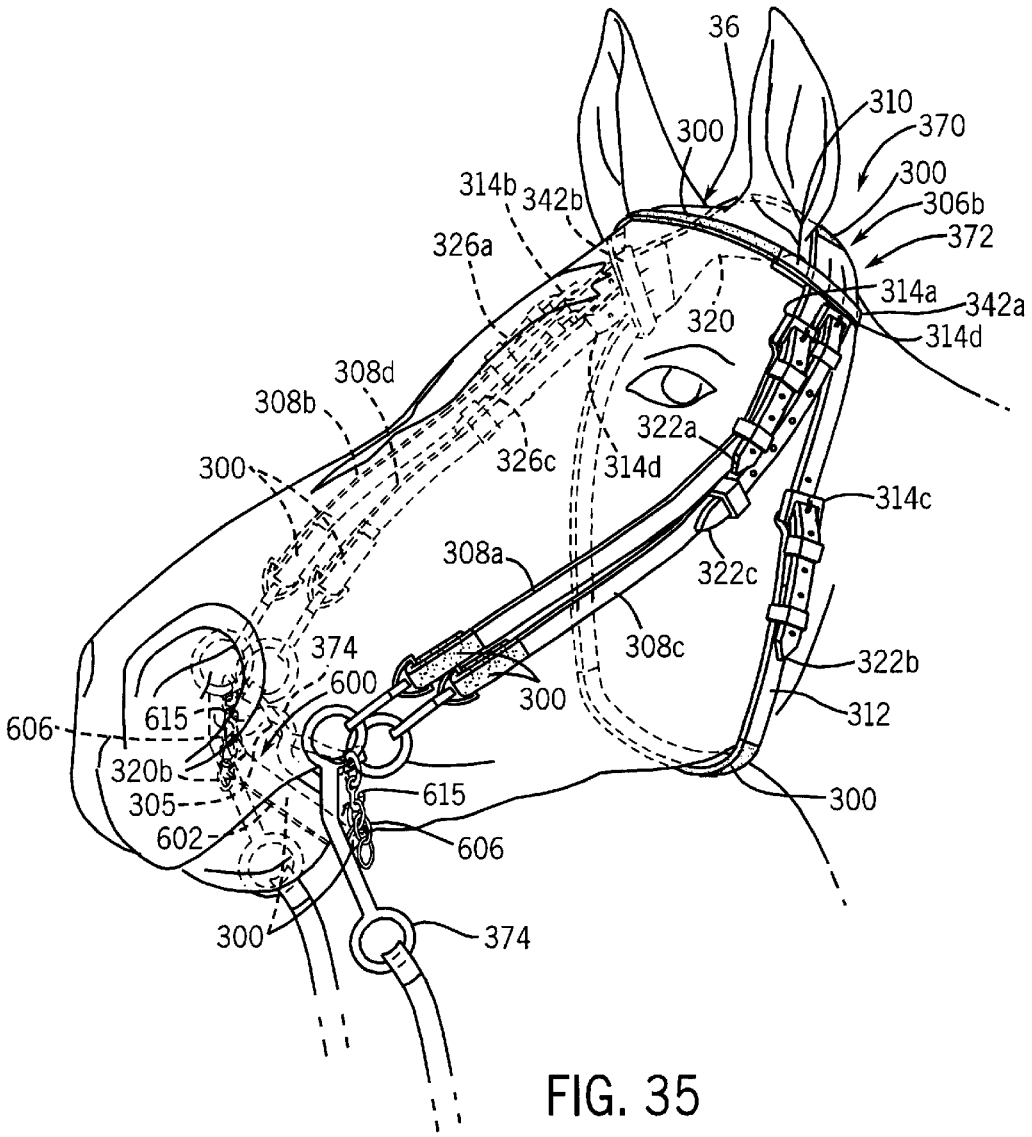
FIG. 35 is a perspective view of a horse wearing a double bit bridle constructed according to the teachings of the humane horse headgear of the present invention.

In a further alternate embodiment shown in FIGS. 30–34, the single bit bridle 302 includes an integral caveson 350. FIGS. 30 and 31 are perspective views of a horse wearing the single bit bridle 302 with an integral caveson 350 constructed according to the teachings of the humane horse headgear of the present invention. The integral caveson 350 may have one circular segment 354 as shown in FIGS. 30 and 33 or two circular segments 354, 366 as shown in FIG. 31 and 34. FIG. 32 shows a modified crown piece 306*b* for use with bridle 302 to which integral caveson 350 is attached.

In this embodiment of the humane horse gear of the present invention, like numbers refer to similar parts of the single bit bridle 302 supra, the disclosure of which is incorporated by reference. The single bit bridle 302 having a bit 305 and a bridle headstall 304, is as previously described in reference to FIGS. 23, 24, 25, and 26 herein, but has a modified crown piece 306*b*. Bridle headstall includes cheek pieces 308*a*, 308*b*, brow band 310 and a modified crown piece 306*b* with throat latch 312. The integral caveson 350 includes a pair of caveson cheek pieces 352*a*, 352*b* connected, joined or fastened to the first circular segment 354. The caveson cheek pieces 352*a*, 352*b* are adjustably fastened to the modified crown piece 306*b*.

As best shown in FIG. 32, the crown piece 306 of the single bit bridle 302 is modified to create modified crown piece 306*b* by the addition of an extra first end segment 322*c* having a portion 323, such as holes, for adjustably and releasably engaging a fastener, attached to caveson cheek piece 352*a*, and an extra second end segment 326*c* having a portion 327, for adjustably and releasably engaging a fastener attached to caveson cheek piece 352*b*. All other parts of the crown piece are not modified and engage with other portions of the bridle headstall 304 and bit 305 as previously described herein. As best shown in FIG. 33, each caveson cheek piece 352*a*, 352*b* of the pair of caveson cheek pieces of integral caveson 350 is a strip of material having opposite ends 358, 360. The pair of caveson cheek pieces 352*a*, 352*b* extend from, connect to or are attached to the modified crown piece 306*b* of FIG. 31. One cheek piece of the pair of caveson cheek pieces 352*a*, 352*b* is disposed on one of the horse's cheeks on either side of the horse's face. Thus, caveson cheek piece 352*b* is adjustably attached by a fastener 362, such as a buckle 362*b*, to first end segment 322*c* having a portion 323 for releasable attachment to fastener 362. Caveson cheek piece 352*a* is adjustably attached by a fastener 362, such as buckle 362*a* to second end segment 326*c* having a portion 327 for releasable attachment to fastener 362.

The first circular segment 354 is preferably strap-like having opposite ends, one of the ends having an adjustable fastener 362*c* and the other end having a portion 365 for adjustably engaging the fastener. The first circular segment 354 includes a noseband 363 and a jaw strap 364 which is releasably and adjustably attached to the noseband. The jaw strap 364 and the noseband 363 encircle the horse's nose forming the first circular segment 354. Ends 360*a*, 360*b* of the caveson cheek pieces 352*a*, 352*b* are sewn, fastened or otherwise attached to the first circular segment 354 preferably at the noseband 363. The noseband 363 has a portion constructed of the resilient material 300 and either or both, the jaw strap 364 and the pair of caveson cheek pieces 352*a*, 352*b* have one or more portions constructed of the resilient material 300.

As best shown in FIGS. 31 and 34, the integral caveson 350 further includes a second circular segment 366 encircling the horse's nose and attached to the first circular segment 354 preferably at the noseband 363 by a joining portion 368. The other parts of the integral caveson 350, the bridle 302 and modified crown piece 306*b* are as described supra. The second circular segment 366 is strap-like having opposite ends. One of the ends has a releasable adjustable fastener 362*d*, preferably a buckle. The opposite other end has a portion 365 for engagement with the fastener 362*d* preferably portion 365 are holes for adjustably and releasably attaching the buckle. Preferably, the second circular segment 366 has one or more portions constructed of the resilient material 300.

Alternatively, the construction of the first circular segment and the second circular segment and their attachment to each other is as detailed in FIGS. 1–20 supra, which is incorporated by reference herein. Alternatively, the fastening of the caveson cheek pieces 352*a*, 352*b* to the first circular segment may be similar to the fastening of the first circular segment to the caveson headgear disposed on the horse's cheeks as shown in FIGS. 1–20, which is incorporated by reference herein.

The resilient material 300 in the integral caveson 350 shown in FIGS. 30–34 may extend from 1% to 100% of a length of the first circular segment 354 (jaw strap and/or noseband), ($L_{FCS}$) and/or a length of the second circular segment 366 ($L_{SCS}$) and/or a length of the caveson cheek pieces 352*a*, 352*b* ($L_{CCP}$). The resilient material is preferably an elasticized material, most preferably a woven elastic material.

Similar to the crown pieces shown in FIGS. 23–25, the modified crown piece 306*b* of the single bit bridle 302 for use with integral caveson 350, as shown in FIGS. 30–34, may have an intermediate portion 320 having a resilient material 300, preferably a woven elasticized material as shown in FIGS. 30–32 and 25 extending a length "L" of the intermediate portion. Alternatively, similar to the crown pieces shown in FIGS. 23–24, 26, the modified crown piece 306*b* as shown in FIGS. 30–32, may have an intermediate section 320 having a contoured portion 314 as shown in FIGS. 26 and 47. However the most preferred embodiment of the modified crown piece 306*b* is the elasticized and contoured crown piece shown in FIGS. 30–32 and 47. The intermediate portion 320 of the modified crown piece 306*b* rests on the horse's head as shown in FIGS. 27–29.

DOUBLE BIT BRIDLE

Figure 36:
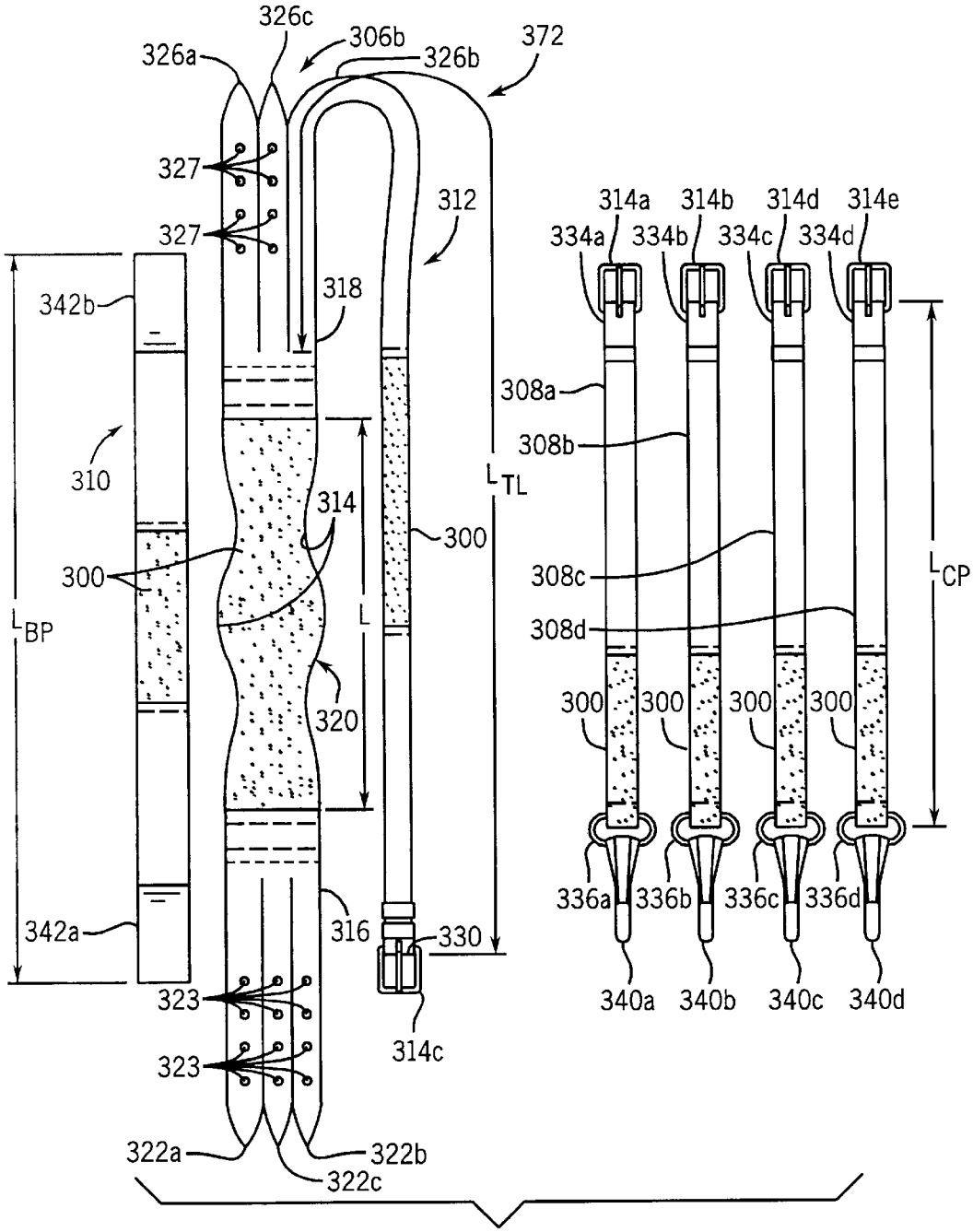
FIG. 36 is an exploded plan view of a headstall of the bridle of FIG. 35.
Figure 37:
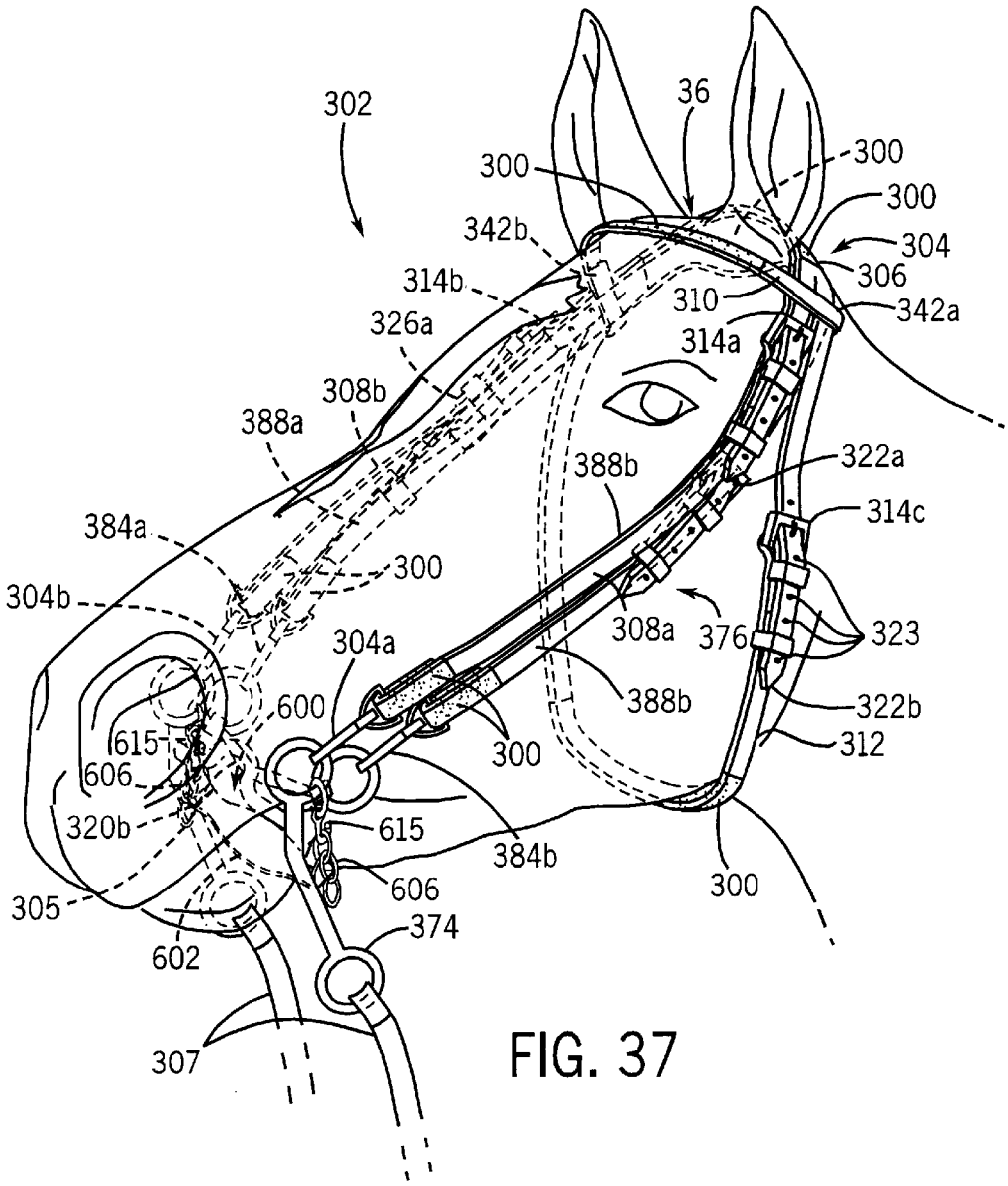
FIG. 37 is a perspective view of a horse wearing the single bit bridle of FIG. 23 along with a snaffle piece constructed according to the teaching of the humane horse headgear of the present invention.

In yet an alternate embodiment of the humane horse headgear of the present invention, best shown in FIGS. 35–36, the bridle is a double bit bridle 370. The double bit bridle 370 may be considered a modification of the single bit bridle 302 of the present invention. The modifications include a second bit 374, a second pair of cheek pieces 308*c* 308*d* and a modified crown piece 306*b*. FIG. 35 is a perspective view of a horse wearing the double bit bridle 370 constructed according to the teachings of the humane horse headgear of the present invention. The double bit bridle 370 in its simplest form includes a headstall 372 and two bits 306, 374. FIG. 36 is an exploded plan view of the headstall 372 of bridle 370 of FIG. 35. FIGS. 25–26 and 46–47 are plan views of the intermediate portion 320 of the modified crown pieces for the headstall 372 of FIGS. 35–36. The headstall 372 of the bridle 370 has one or more portions encircling and conforming to the horse's head. The headstall 372 of the double bit bridle 370 includes the headstall portions 304 of the single bit bridle 302, described herein, with the modified crown piece 306*b* of FIG. 32, plus an extra pair of cheek pieces 308*c*, 308*d* (which are constructed identical to cheek pieces 308*a*, 308*b*. Thus, similar portions are numbered in the double bit bridle 370 and constructed as they are in the single bit bridle 302, and in modified crown piece 306b, the disclosures of which are incorporated by reference.

Thus headstall 372 of the bridle 370 as shown in FIGS. 35 and 36 includes the modified crown piece 306*b*, at least two pairs of cheek pieces 308 (308*a*, 308*b*, 308*c*, 308*d*), a brow band 310, and a throat latch 312. The crown piece 306*b* is fastened to the cheek pieces 308 and to the throat latch by fastening means, including adjustable fasteners 314 and corresponding portions 323, 327 for adjustable releasable attachment to the fastener. The modified crown piece 306*b* is identical in construction to the modified crown piece 306*b* as described in FIG. 32. The ends 326*c* and 322*c* in this embodiment of bridle 370 now fasten to the second pair of cheek pieces 308*c*, 308*d*, as shown in FIG. 35.

The crown piece 306*b* is a strip of one or more materials having a first end 316, an opposite second end 318 and an intermediate portion 320 disposed between the first end 316 and the second end 318. The first end 316 is split or divided into a plurality of first end segments 322 (322*a*, 322*b*, 332*c* . . . ). Each of the first end segments 322 has a portion 323 for engaging the fastener 314.

The second end 318 is split or divided into a plurality of second end segments 326 (326*a*, 326*b*, 326*c* . . . ). At least two of the plurality of second end segments 326 has a portion 327 for engaging fasteners 314. Where the fastener 314 is a buckle or hook, the portions 323 and 327 for engaging the fastener is one or more holes (apertures) which allow for adjustable attachment to the fastener 314. If the fastener 314 is a snap or a VELCRO® strip, the portion 327 for engaging the fastener is a mating part of the snap or the VELCRO® strip, respectively. Preferably the fastener 314 is a buckle.

One of the plurality of second end segments 326*b* is extended to a length sufficient to form the throat latch 312. The construction of the throat latch 312 and modification are as described for the single bridle 302 supra, the disclosure of which is incorporated by reference.

The throat latch 312 is connected to, or attached to, or extends from the crown piece 306*b*, the two or more pairs of cheek pieces 308 and the brow band 310.

Best shown in FIGS. 36 and 37, the two pair of the cheek pieces 308*a*, 308*b*, 308*c*, and 308*d* extend from or are attached to or are connected to the crown piece 306*b*. Each cheek piece 308*a*, 308*b*, 308*c*, 308*d* is a strip of material having a pair of opposite ends 334, 336. One end 334*a*, 334*b*, 334*c*, 334*d* of each cheek piece 308*a*, 308*b*, 308*c*, 308*d*, respectively, is attached to a fastener 314, such as a buckle (314*a*, 314*b*, 314*d*, and 314*e*). Each opposite end 336*a*, 336*b*, 336*c*, 336*d* bears a bit attachment 340 (340*a*, 340*b*, 340*c*, 340*d*) for attaching bits 305, 374 to the headstall 372.

One cheek piece of the pairs of the cheek pieces is disposed on an opposite cheek on a horse's face. Thus cheek piece 308*a* is adjustably fastened by buckle 314*a* to first end segment 322*a*. Cheek piece 308*b* is adjustably fastened by buckle 314*b* to second end segment 326*a*. Cheek piece 308*c* is adjustably fastened by buckle 314*d* to first end segment 322*c*. Cheek piece 308*d* is adjustably fastened by buckle 314*e* to second end segment 326*c*.

The brow band 310 is a strip of material having opposite ends 342*a*, 342*b* coupled to the modified crown piece 306*b*. Typically, opposite ends 342*a*, 342*b* of the brow band are looped and stitched onto themselves and the crown piece 306*b* slides through the loops in the brow band 310. The brow band 310 is disposed in front of the horse's ears and above the horse's eyes on the horse's brow.

Best shown in FIGS. 35, 36 and 25, the intermediate portion 320 of the modified crown piece 306*b* of the humane horse headgear of the present invention is constructed preferably in part or in entirety of a resilient material 300. This construction allows the modified crown piece 306*b* to yield slightly in response to the movement of the horse's head. The portion constructed of resilient material 300 extends from 1% to 100% of a length L of the intermediate portion 320.

Preferably, the intermediate portion 320 of the modified crown piece 306*b* is a contoured crown piece having an intermediate portion 320 having a contoured portion 314, as shown in FIGS. 36, 26, and 47. The contoured portion 314 is advantageously shaped to provide a load-bearing surface disposed on the poll of the horse. The contoured portion 314 has a length, "L", preferably equal to length L of the intermediate portion 320.

Most preferably, as shown in FIGS. 35, 36, and 46 the modified crown piece 376 is a contoured crown piece 306*b* with the intermediate portion 320 both being contoured and having a portion constructed of a resilient material 300, such as an elasticized material, preferably a woven elastic material. The resilient portion of the contoured crown piece 306*b* extends from 1% to 100% of the length of the intermediate portion 320. The contour portion of the bridle crown head piece including the most preferred embodiment will be discussed later under the section "Contoured crown piece embodiments of the humane horse headgear" which description is incorporated by reference herein. The intermediate portion 320 of modified crown piece 306*b* is disposed on an area on the top of the horse's head behind the horse's ears, shown in FIGS. 27–29.

Alternatively the bridle 370 may have one or more resilient materials 300 in the crown piece 306*b* and/or the two pair of cheek pieces 308*a*, 308*b*, 308*c*, 308*d* and/or the throat latch 312 and/or the brow band 310. The resilient material 300, may extend from 1% to 100% of a length of each of the aforementioned portions 306*b* (L), 308*a* ($L_{CP}$), 308*b* ($L_{CP}$), 308*c* ($L_{CP}$), 308*d* ($L_{CP}$), 310 ($L_{BB}$), and 312 ($L_{TL}$) of the bridle 370. Preferably the resilient material 300 is an elasticized material, preferably a woven elastic material. Bit 374 is shown as a curb bit. A curb device 600 of the present invention is shown attached to the curb bit. The curb device 600 will be discussed in the section labeled "Curb Device".

SNAFFLE PIECE

Figure 38:
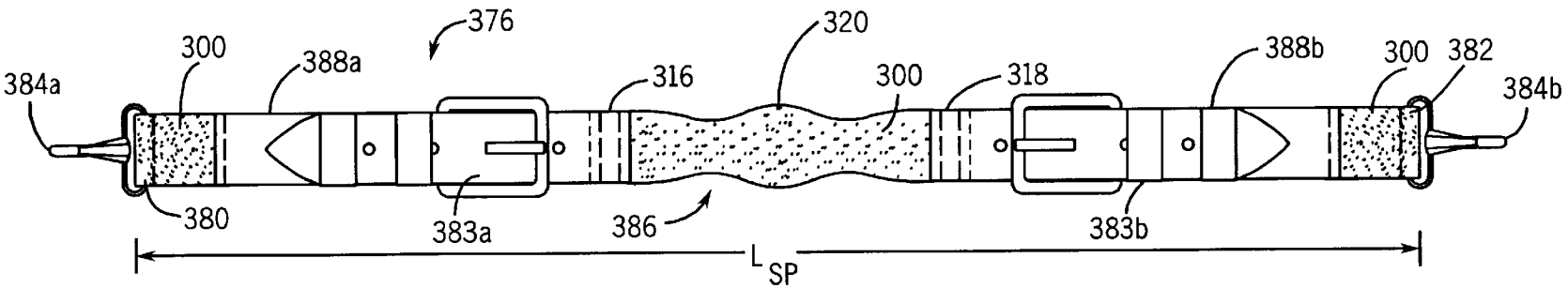
FIG. 38 is a plan view of the snaffle piece shown in FIG. 37.

Yet, alternatively, a double bit bridle, as shown in FIG. 37, is created by using the single bit bridle 302 as described supra and shown in FIGS. 23–26, the disclosure of which is incorporated by reference, along with a snaffle piece 376 and a bit 374. The snaffle piece 376, as shown in FIG. 38, is a strip of material, typically bridle leather, having a length "$L_{SP}$" and having opposite ends 380, 382. The strip is adjustable by the inclusion of fastening means 383*a*, 383*b*. The fastening means 383*a*, 383*b* include a fastener and separable portion having a portion to engage the fastener. Here the fastener is a buckle and the separable portion is a strap with holes (apertures) therein for engaging the buckle; however, other fastening means known in the tack art may be used. The snaffle piece 376 is dimensioned to extend around the back of the horse's head behind the horse's ears and to extend down the either side of the horse's cheeks to the horse's mouth. Each end 380, 382 of the snaffle piece terminates in a bit attachment 384*a*, 384*b* respectively to hold the snaffle bit 378. The snaffle piece 376 is threaded through the looped ends 342*a*, 342*b* of the brow band 310 of the bridle 302. The snaffle piece 376 has one or more portions having a resilient material 300 therein, preferably disposed at a pressure point on the horse's head. The resilient material 300 in the snaffle piece 376 is preferably disposed in a portion 386 under the crown piece 306 of the bridle and/or along portions 388*a*, 388*b* extending down the cheeks of the horse. Portion 386 of the snaffle piece 376 is designed like crown piece 306, 306*b* having ends 316, 318 and an intermediate portion 320 disposed between opposite ends 316, 318. Intermediate portion 320 of snaffle piece 376 is preferably designed like intermediate portion 320 of crown piece 306, 306*b* supra, and in FIGS. 25, 26, 46 and 47, the disclosure of which is incorporated by reference. The resilient material 300 is preferably an elasticized material, preferably a woven elasticized material and is integral with or attached as previously described herein. A curb device 600 is shown attached to curb bit 374.

DOUBLE BIT BRIDLE WITH INTEGRAL CAVESON

Figure 39:
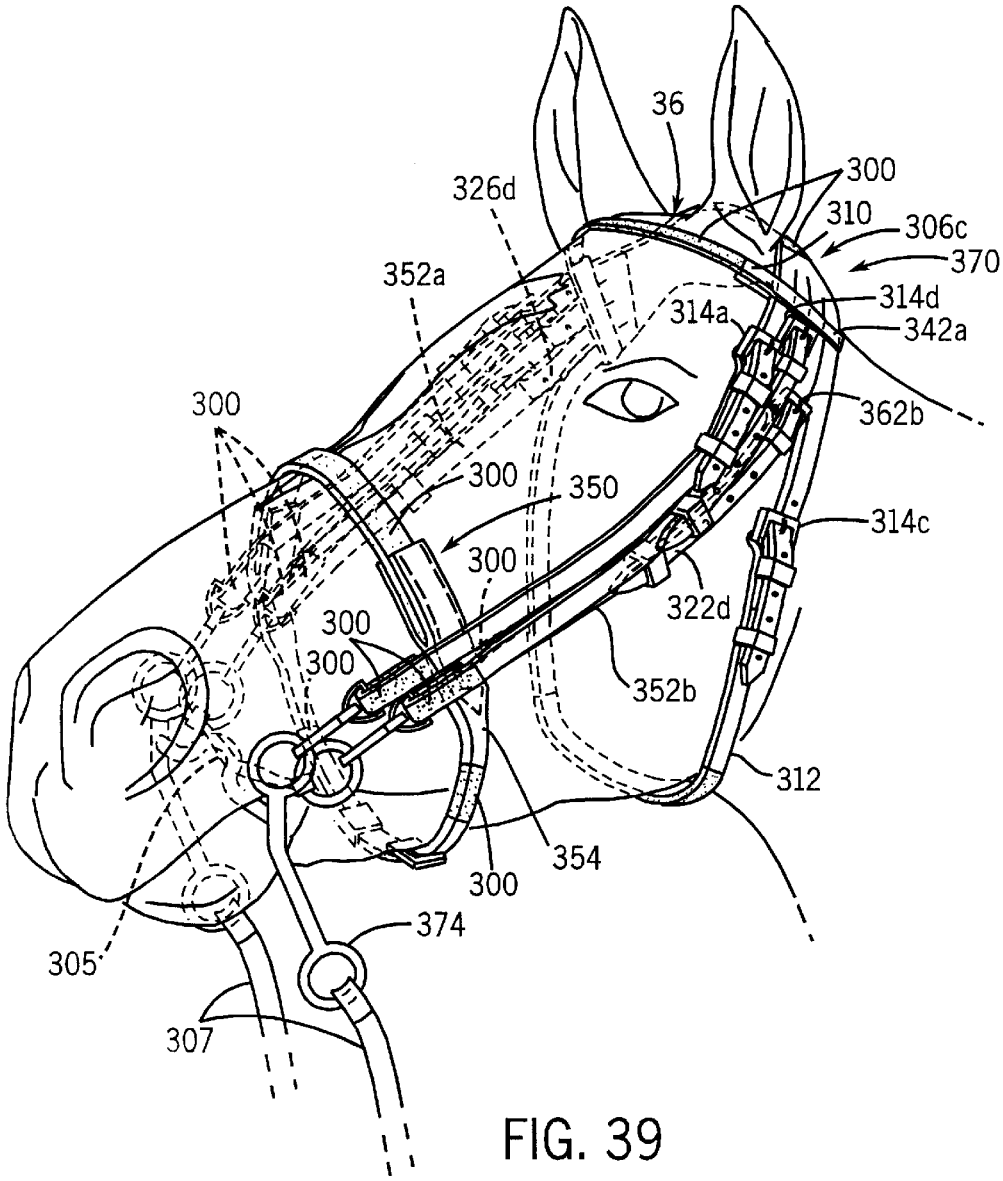
FIG. 39 is a perspective view of a horse wearing the double bit bridle of FIG. 35 with the integral caveson of FIG. 33 constructed according to the teachings of the humane horse headgear of the present invention.
Figure 40:
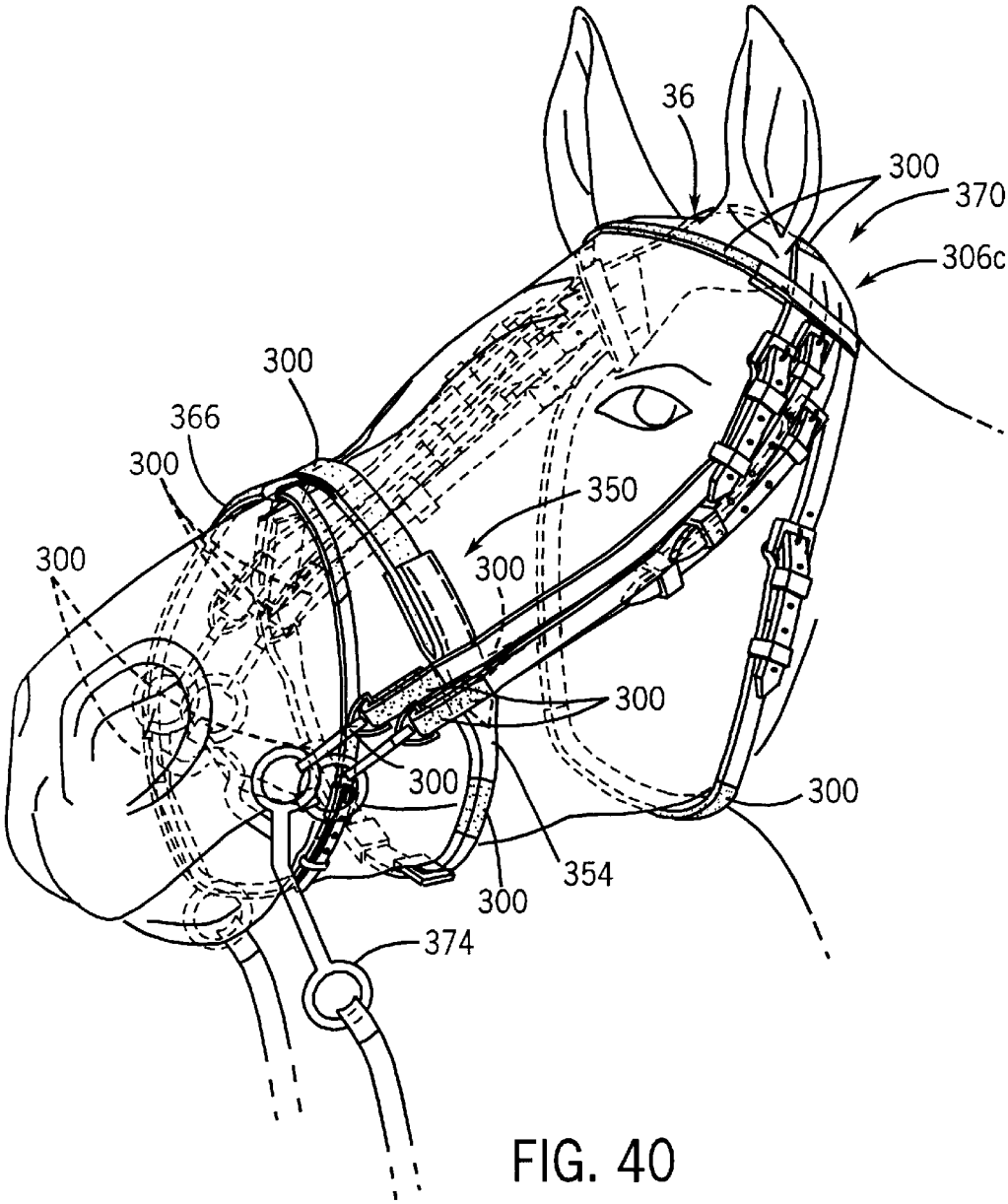
FIG. 40 is a perspective view of a horse wearing the double bit bridle of FIG. 35 with the integral caveson of FIG. 34, where the integral caveson has a second circular segment.

In a further alternate embodiment shown in FIGS. 39–43, the double bit-bridle 370 includes the integral caveson 350, where like numbers refer to similar parts of the double bit bridle 370 and to the integral caveson 350, both as previously described supra, the disclosure of which is incorporated by reference. FIGS. 39, 40 are perspective views of a horse wearing the double bit bridle 370 of FIG. 37 with the integral caveson 350 of FIGS. 33 and 34 constructed according to the teachings of the humane horse headgear of the present invention. FIG. 39 shows the double bit bridle 370 with the caveson 350 having one circular segment 354. FIG. 40 shows the double bit bridle 370 with the integral caveson 350 having a second circular segment 366. (Curb device 600 is not shown.)

Integral caveson 350 includes a pair of caveson cheek pieces 352*a*, 352*b* and a first circular segment 354. The double bit bridle 370 includes bits 305, 374 and a bridle headstall 372, as previously described herein, but with a modified crown piece 306*c*. The first circular segment 359 and/or the pair of caveson cheek pieces 352*a*, 352*b* have one or more portions constructed of a resilient material as previously described herein.

Figure 41:
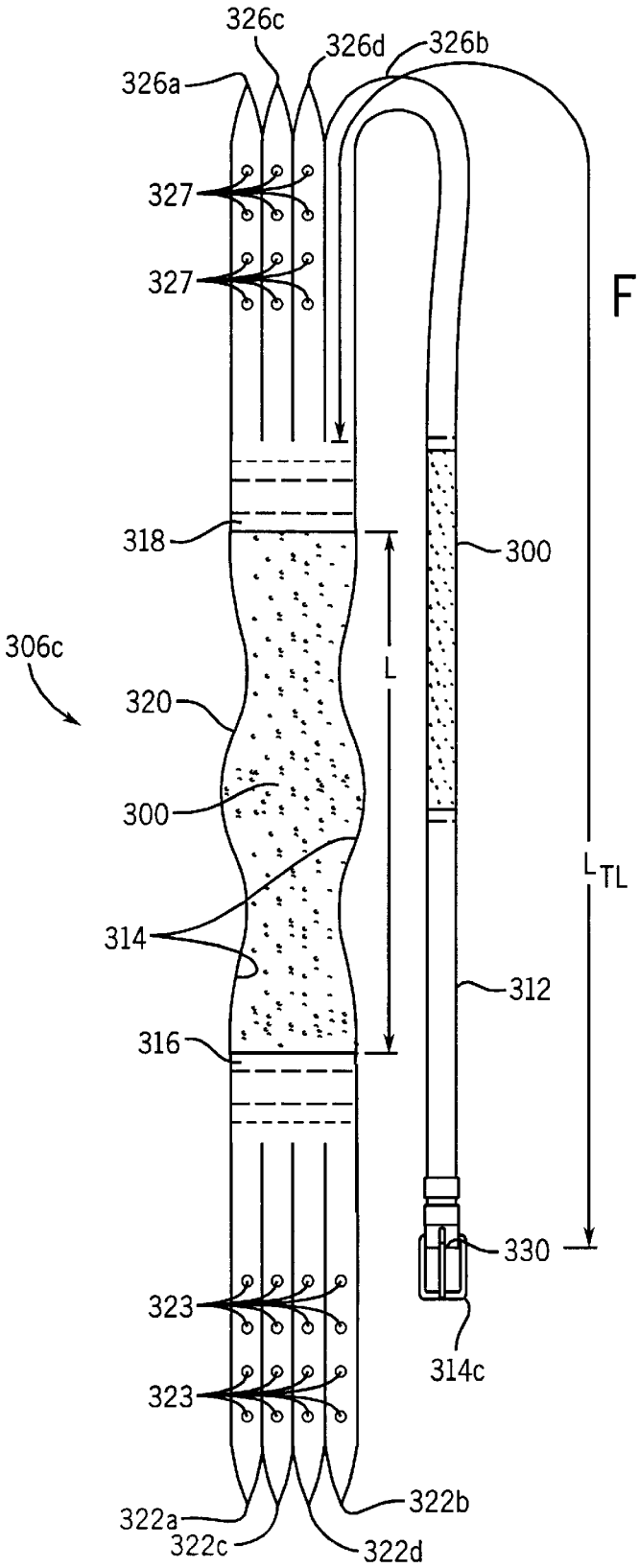
FIG. 41 is a plan view of a modified crown piece for use in the double bit bridle of FIGS. 39 and 40.

As best shown in FIG. 41, to create the modified crown piece 306*c*, shown in FIGS. 39 and 40, the crown piece 306*b* from FIG. 32 is only modified by the addition of an extra first end segment 322*d* having a portion 323, such as holes, for releasably engaging a fastener, and an extra second end segment 326*d* having a portion 327, such as holes, for releasably engaging a fastener. All other portions of crown piece 306*c* are identical and unchanged and are comparable to portions in 306*b*. The extra first end segment 322*d* and extra second end segment 326*d* are for releasable attachment to the pair of integral caveson cheek pieces 352*a*, 352*b*, best shown in integral caveson 350 FIGS. 30 and 31. The caveson cheek pieces 352*a*, 352*b* pieces are fastened to end segments 326*d*, 322*d* respectively.

As best shown in FIGS. 40 and 34, the double bit bridle 370 with the integral caveson 350 further includes the second circular segment 366 encircling the horse's nose and attached to the first circular segment 354 preferably at the noseband 363 by a joining portion 368 as previously discussed herein in reference to FIG. 34, the disclosure of which is incorporated by reference. The second circular segment 366 has one or more portions constructed of the resilient material as previously described herein.

Similar to the crown pieces 306, 306*b*, and snaffle piece 376, the modified crown piece 306*c* of the double bit bridle 370 with integral caveson 350 as shown in FIGS. 39–41 and 25 may have an intermediate portion 320 having a resilient material 300, preferably a woven elasticized material. Alternatively, similar to the crown piece 306, 306*b*, and snaffle piece 376, the modified crown piece 306*c* of the double bit bridle 370 with is integral caveson 350 as shown in FIGS. 39–41, 26 and 47 may have an intermediate portion 320 which is contoured. However, the most preferred embodiment is the elasticized and contoured crown piece 306*c* having shown in FIGS. 39–41 and 46. The modified crown piece 306*c* rests on the horse's head as shown in FIGS. 27–29.

Likewise, similar to crown pieces 306, 306*c*, and snaffle piece 376, the resilient material 300 in the modified crown piece 306*c* shown in FIGS. 39–41, 26, and 46 may extend from 1% to 100% of a length of the intermediate portion 320 of the crown piece 306*c*. The resilient material 300 is incorporated into the modified crown piece 306*c* and into the integral caveson 350 as previously described supra.

HALTER EMBODIMENTS OF THE HUMANE HORSE HEADGEAR

The humane horse headgear of the present invention includes a halter for use in horse training and thereafter. Referring now to FIGS. 42–45 and 25 and 26, wherein like numbers refer to similar parts, the halter of the present invention may be a work halter or a show halter.

WORK HALTER

Figure 42:
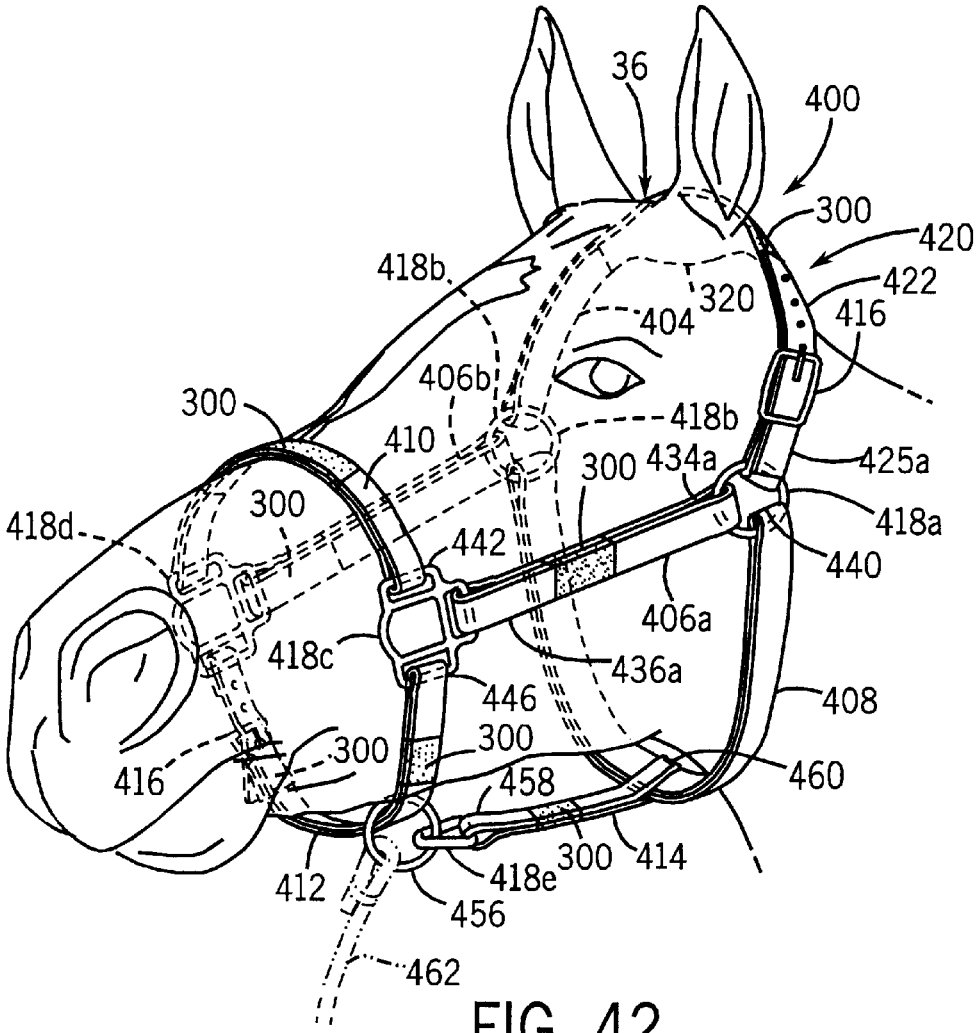
FIG. 42 is a perspective view of a horse wearing a work halter constructed according to the teachings of the humane horse headgear of the present invention.
Figure 43:
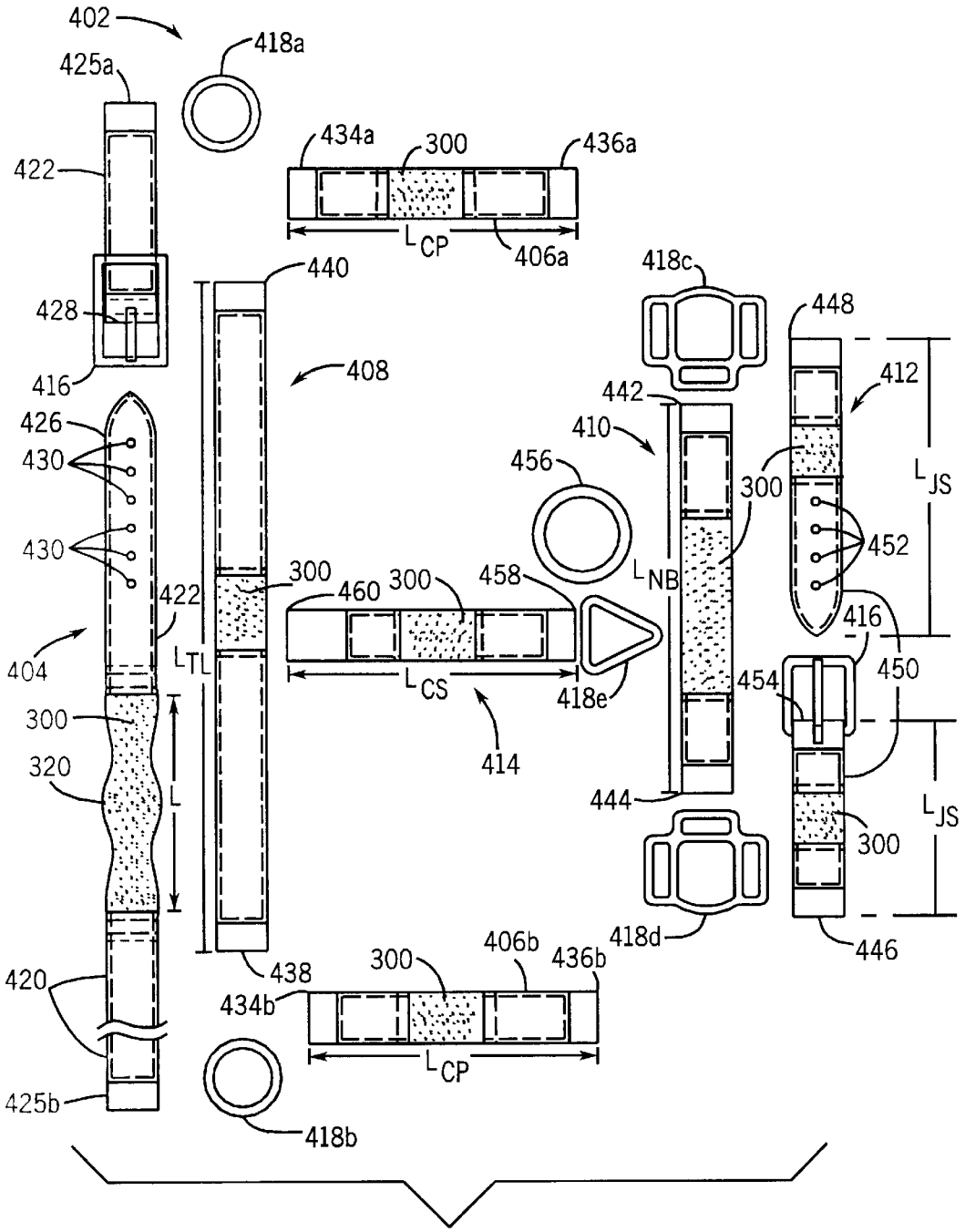
FIG. 43 is an exploded plan view of the halter of FIG. 42.

In a preferred embodiment the halter is a work halter 400 best shown in FIGS. 42–47. FIG. 42 is a perspective view of a horse wearing the work halter 400 constructed according to the teachings of the humane horse headgear of the present invention. FIG. 43 is an exploded plan view of the work halter 400 of FIG. 42. The work halter comprises a headstall 402 having one or more portions encircling and conforming to the horse's head. The portions of the headstall of the work halter 400 include, a crown piece 404, a pair of cheek pieces 406 (406*a*, 406*b*), a throat latch 408, a noseband 410, a jaw strap 412 and a connector strap 414. Engageable adjustable fasteners 416 and/or connectors 418 are used to fasten or connect the aforementioned plurality of portions to one another. Each of the portions 404, 406 (406*a*, 406*b*), 408, 410, 412, and 414 has a portion length, $L_{CP}$, $L_{TL}$, $L_{NB}$, $L_{JS}$, $L_{CS}$. As shown in FIGS. 27–29, an intermediate portion 320 of the crown piece 404 rests on the area on the top of the horse's head on the edge of the bones behind the horse's ears.

The crown piece 404 connects on either side of the horse's face to the cheek pieces 406*a*, 406*b* and to the throat latch 408 via connectors 418*a*, 418*b*, preferably O ring type connectors. The crown piece 404 is a strip of one or more materials having a first end 420 fastened to connector 418*a*, an opposite second end 422 fastened to connector 418*b* and an intermediate portion 320 disposed between the first end 420 and the second end 422. The first end 420 and the second end 422 each have a portion 425 (425*a*, 425*b*) fashioned to receive connector 418. The intermediate portion 320 of halter 400 is designed identically to the intermediate portion 320 of crown piece 306, 306*b*, 306*c*, and of snaffle piece 376, the disclosure of which is incorporated by reference. In the preferred embodiment the portions 425*a*, 425*b* are looped around connector 418*a*, 418*b* respectively and sewn in place. Second 422 end has a portion 426 which is adjustable for engaging fastener 416 and a portion 428 extending from second end 422 and having a fastener 416 thereon. Preferably fastener 416 is a buckle. Where the fastener 416 is a buckle or hook, the portion 426 for engaging the fastener 416 has one or more apertures 430 which allow for adjustable attachment to the fastener 416. If the fastener 416 is a snap or VELCRO®, the portion 426 for engaging the fastener 416 is a mating part of the snap or the VELCRO®, respectively.

Best shown in FIGS. 42, 43, and 25, in a preferred embodiment, the intermediate portion 320 of the crown piece 404 is constructed preferably in part or in entirety of a resilient material 300. This construction allows the crown piece 404 to yield slightly in response to the movement of the horse's head. The portion constructed of resilient material 300 extends from 1% to 100% of a length L of the intermediate portion 320.

In a preferred embodiment, the intermediate portion 320 of the crown piece 404 has a contoured portion 314, as shown in FIGS. 42, 43, 26, and 46–47. The contoured portion 314 is advantageously shaped to provide a load-bearing surface disposed on the poll of the horse. The contoured portion 314 preferably has a length "L" corresponding to the length L of intermediate portion 320.

In the most preferred embodiment, as shown in FIGS. 42, 43, and 46 the crown piece 404 is a contoured crown piece with the intermediate portion 320 both being contoured and having a portion constructed of a resilient material 300, such as an elastic material, preferably a woven elasticized material. The resilient portion of the contoured crown piece extends from 1% to 100% of the length of the intermediate portion 320. The contour portion of the crown piece 404 including the most preferred embodiment will be discussed later under the section "Contoured crown piece embodiments of the humane horse headgear" which description is incorporated by reference herein. The positioning of the intermediate portion 320 of the crown piece 404 on the horse's head is best shown in FIGS. 27–29.

The cheek pieces 406*a*, 406*b* attach via connectors 418*c*, 418*d* to the noseband 410 on top of the horse's face and to the jaw strap 412 on the bottom. One cheek piece of the pair of cheek pieces is disposed on each cheek on the horse's face. Each cheek piece 406*a*, 406*b*, is a strip of material having a pair of opposite ends 434, 436, the opposite ends are respectively fashioned to receive connectors. In the preferred embodiment, the opposite ends 434*a*, 434*b* are looped around connectors 418*a*, 418*b* respectively and sewn in place; and opposite ends 436*a*, 436*b* are looped around connectors 418*c*, 418*d* and sewn in place.

The throat latch 408 is a strip of material having a pair of opposite ends 438, 440; the opposite ends are respectively fashioned to receive connectors. The throat latch 408 is disposed under the horse's jowl. In the preferred embodiment, the opposite end 438 is looped around connector 418*b* and sewn in place and opposite end 440 is looped around connector 418*a* and sewn in place.

Extending down the horse's face and above the horse's mouth is the noseband 410. The noseband 410 is part of the headstall 402 that passes over the horse's nose. The noseband is a strip of material having a pair of opposite ends fashioned 442, 444 to receive connectors. In the preferred embodiment the opposite end 442 is looped around connector 418*c* and sewn in place and opposite end 444 is looped around connector 418*d* and sewn in place.

The jaw strap 412 is disposed under the horse's mouth. The jaw strap 412 is a strip of material having a pair of opposite ends 446, 448 fashioned to receive connectors. In the preferred embodiment, the opposite end 446 is looped around connector 418*c* and sewn in place and opposite end 448 is looped around connector 418*d* and sewn in place. The jaw strap 412 preferably has a separable adjustable portion 450 between ends 446 and 448. The separable adjustable portion 450 has fastening means therein, e.g., a portion 452 adjustable for engaging a fastener 416 and a portion 454 having a fastener 416 thereon. Preferably fastener 416 is a buckle, alternatively the fastener may be a hook, a VELCRO® strip, or a snap or other fastener. Where the fastener 416 is a buckle or hook, the portion 452 for engaging the fastener 416 has one or more spaced apertures 430 which allow for adjustable attachment to the fastener 416. If the fastener 416 is a snap or of the VELCRO® strip, the portion 452 for engaging the fastener 416 is a mating part of the snap or VELCRO® strip, respectively.

The jaw strap 412 in turn connects to the throat latch 408 via the connector strap 414 under the horse's jaw. Another connector 456, typically a larger O-ring is used to connect the connector strap 414 to the jaw strap 412. Jaw strap 412 is threaded through connector 456. Under jaw connector strap 414 is a strip of material having a pair of opposite ends 458, 460. End 458 is fashioned to receive a connector 418*e*. End 460 is fashioned to receive throat latch 408. In the preferred embodiment the end 458 is looped around connector 418*e* and sewn in place. Connector 418*e* is fastened to connector 456. Opposite end 460 is looped around throat latch 408 and sewn in place, permitting the throat latch 408 to slide through the loop. A lead rope 462 shown in phantom is connected to the connector 456.

Connectors 418, 456 are usually metal connectors typically ring-type or other geometric shaped metal connectors, but connectors 418, 456 may be made of any substance that provides the appropriate level of strength and rigidity (physical properties). The connectors 418, 456 may be made of plastic, if cost and physical properties permit. Usually the metal ring-type connectors are round, square, or triangular, or combinations thereof or other geometric forms. Alternatively, in lieu of using connectors 418, the portions of the halter joined at connectors 418 may be stitched together as is known in the art.

In alternate embodiments of the work halter 400 of the humane horse headgear of the present invention, one or more of the noseband 410, the pair of cheek pieces 408*a* 408*b* and the connector strap 414 are constructed with a portion of resilient material 300. In a preferred embodiment of the work halter 400, one or more of the crown piece 404, the pair of cheek pieces 406*a*, 406*b*, the throat latch 408, the noseband 410, the jaw strap 412 and the connector strap 414 have a portion constructed of a resilient material 300. In any of the aforementioned embodiments, the portion constructed of resilient material 300 extends from 1% to 100% of a length of the respective portion 404 (L), 406 ($L_{CP}$), 408 ($L_{TL}$), 414 ($L_{CS}$), 410 ($L_{NB}$), 412 ($L_{JS}$). The resilient material is preferably an elastic material, most preferably a woven elastic material, sewn or otherwise incorporated into the portion.

SHOW HALTER

In a preferred embodiment, the humane horse headgear includes a show halter 470 for use in horse training and thereafter. The show halter 470 is best shown in FIGS. 44–47 and 25–26. The show halter 470 comprises a headstall 304 having one or more portions encircling and conforming to the horse's head. FIG. 43 is a perspective view of a horse wearing the show halter 470 constructed according to the teachings of the humane horse headgear of the present invention. FIG. 45 is an exploded plan view of the show halter 470 of FIG. 44. FIGS. 25–29 and 46–47 are views of crown pieces for the show halter's crown piece of FIGS. 43–45. In this embodiment of the humane horse gear of the present invention, like numbers of the show halter 470 refer to similar parts of the work halter 400, the bridle crown piece 306 and the throat latch 312 supra, the disclosure of which is incorporated by reference. The crown piece of the halter 470 is preferably constructed identical to the bridle crown piece 306 including the integral throat latch 312.

The plurality of portions of the show halter 470 include a crown piece 306, a pair of cheek pieces 406 (406*a*, 406*b*), a throat latch 312, and a noseband 410. Engageable adjustable fasteners 416 and/or connectors 418 fasten and/or connect the portions to one another. Each of the portions 306, 406, 410, 312 has a portion length L, $L_{CP}$, $L_{NB}$, $L_{TL}$. As shown in FIGS. 27–29, the crown piece 306 rests on the area on the top of the horse's head behind the horse's ears.

The crown piece 306 connects on either side of the horse's face to the cheek pieces 406*a*, 406*b* and to the throat latch 312 via engageable adjustable fasteners 314, 416, preferably buckles 314*c*, 416*a*, 416*b*. The crown piece 306 is as previously described in the section in the single bit bridle. End segments 322 (322*a*, 322*b*), and 326*a* each have a portion 323, and 327 respectively fashioned to receive and engage a fastener 314*c*, 416*a*, and 416*b*. In the preferred embodiment the portions 323 and 327 are apertures for adjustably engaging fasteners 416*a*, 416*b* of cheek pieces 406*a*, 406*b* respectively. First end segment 326*b* has an extended portion forming throat latch 312. The throat latch 312, disposed under the horse's jowl, has an end 330 having a fastener 314*c* thereon; preferably fastener 314*c* is a buckle. Where the fastener 316*c* is a buckle or hook, the portion 323 for engaging the fastener 316*c* has one or more apertures which allow for adjustable attachment to the fastener 316*c*. If the fastener 316*c* is a snap or a VELCRO strip, the portion 323 for engaging the fastener 316*c* is a mating part of the snap or VELCRO® strip, respectively.

Frequently, a decoration (not shown), such as a concho or a medallion (not shown) is placed on the show halter for display only. Best shown in FIGS. 44, 45, and 25, in a preferred embodiment, the intermediate portion 320 of the crown piece 306 is constructed preferably in part or in entirety of a resilient material 300. This construction allows the crown piece 306 to yield slightly in response to the movement of the horse's head. The portion constructed of resilient material 300 extends from 1% to 100% of a length of the intermediate portion 320. Preferably, the crown piece is a stretchable dyed surgical tubing.

In a preferred embodiment, the intermediate portion 320 of the crown piece 306 is a contoured crown piece having a contoured portion 314, as shown in FIGS. 44, 45, 26, and 47. The contoured portion 314 is advantageously shaped to provide a load-bearing surface disposed on the poll of the horse. The contoured portion 314 has a length, preferably equal to length L of the intermediate portion 320.

Figure 44:
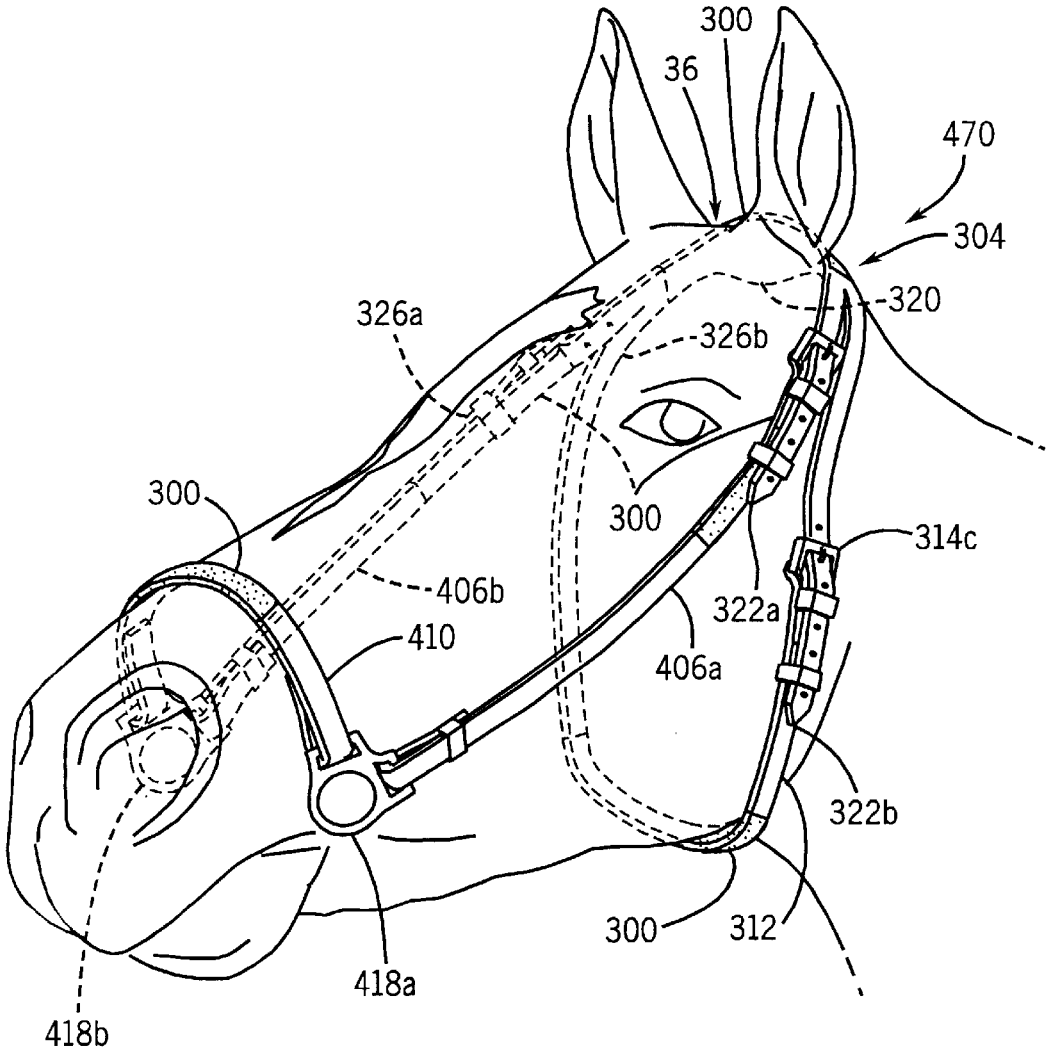
FIG. 44 is a perspective view of a horse wearing a show halter constructed according to the teachings of the humane horse headgear of the present invention.
Figure 45:
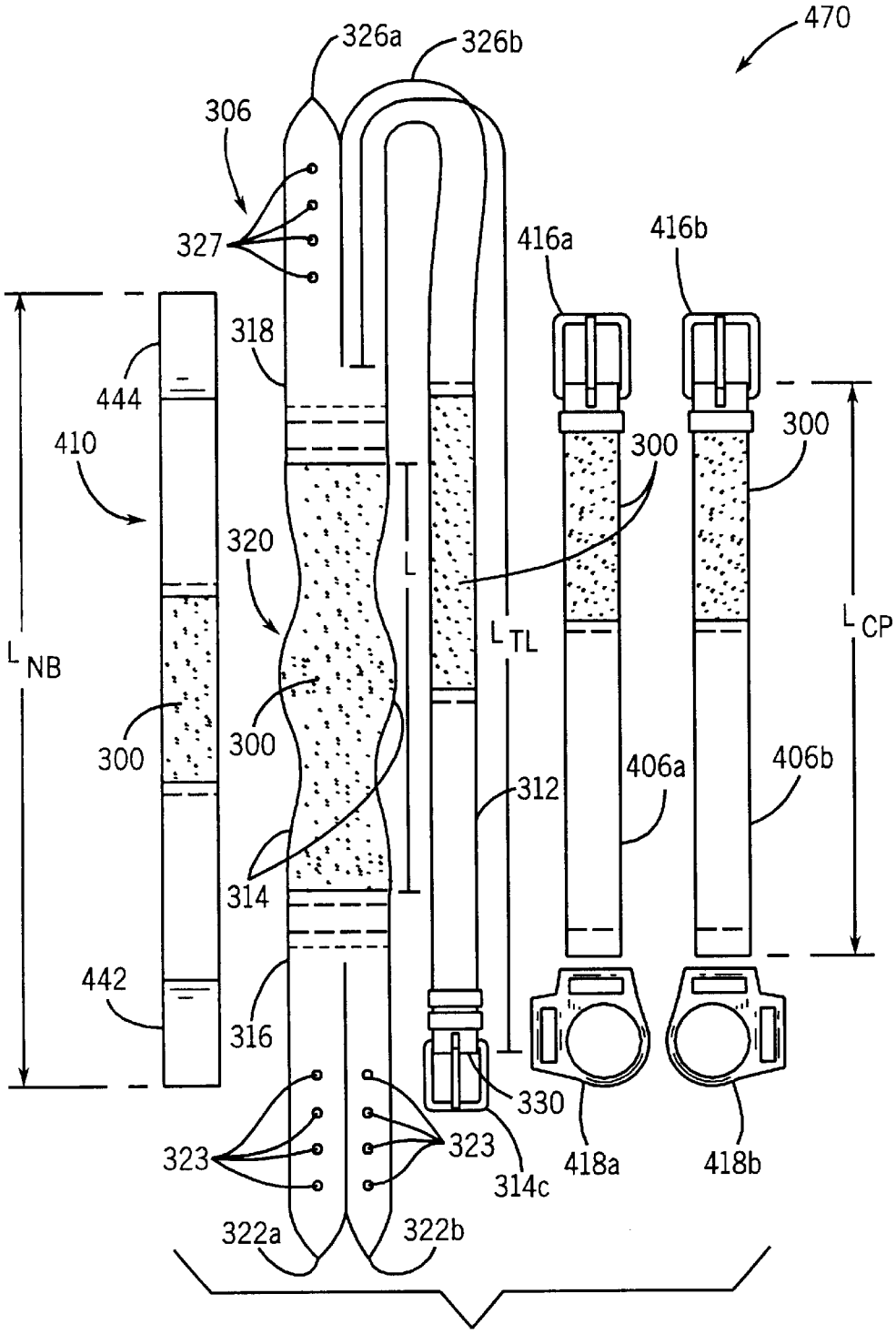
FIG. 45 is an exploded view of the halter of FIG. 44.

In the most preferred embodiment as shown in FIGS. 44–46, the crown piece 306 is a contoured crown piece with the intermediate portion 320 both being contoured and having a portion constructed of a resilient material, such as a woven elasticized material. The resilient portion of the contoured crown piece extends from 1% to 100% of the length of the contoured portion 320. The contour portion 314 of the crown piece 306 including the most preferred embodiment will be discussed later under the section. "Contoured crown piece embodiments of the humane horse headgear" which description is incorporated by reference herein.

The cheek pieces 406*a*, 406*b* are as described in the section on the work halter supra and attach via fasteners 416*a* and 416*b* to the crown piece 306 and attach via connectors 418*a*, 418*b* to the noseband 410 on top of the horse's face and to a chain (not shown) on the bottom.

Extending down the horse's face and above the horse's mouth is the noseband 410, which is connected to connector 418*a*, 418*b* and is as described in the section on the work halter supra. A chain (not shown) may be disposed between connectors 418*a*, 418*b* on opposite ends 442, 444 to which a lead rope (not shown) may be attached. A lead rope with either a single line or two lines in a "Y" fashion is attached to the connectors. The horse is then lead on the lead rope.

In alternate embodiments of the show halter 470 of the humane horse headgear of the present invention, one or more of the crown piece 306, the noseband 410, the pair of cheek pieces 408*a* 408*b* and the throat latch 312 are constructed with a portion of resilient material 300.

As is shown in FIGS. 44 and 45, the crown piece 306 and cheek pieces 406*a*, 406*b* have releasable fastening means for adjustment to the horse's head size. Alternatively, the crown piece 306 and the cheek pieces 406*a*, 406*b* are integral with each other. Alternatively, the throat latch 312 is releasably attached to the crown piece 306 as previously described herein. In alternate embodiments of the show halter 470 of the humane horse headgear of the present invention, either the pair of cheek pieces 416*a*, 416*b*, the noseband 410, or both, may be constructed having a portion of resilient material 300. The portion of resilient material extends from 1% to 100% of the length of 320 (L), 410 ($L_{NB}$), or 416 ($L_{CP}$). The resilient material 300 is preferably an elastic (elasticized) material, most preferably a woven elasticized material sewn, fastened to or integral with the noseband 410 and/or pair of cheek pieces 416*a*, 416*b* and/or the crown piece 306.

CONTOURED CROWN PIECE EMBODIMENTS OF THE HUMANE HORSE HEADGEAR

The humane horse headgear also includes a crown piece, having an intermediate portion 320 which is contoured, for use as a crown piece in a headstall of conventional bridles and/or halters and in the bridles, snaffle pieces, cavesons, and halters described in the present invention including FIGS. 1–20 and shown in detail in FIGS. 21, 22, 23–24, 26–27, 29, 30, 31, 32, 35–43, 44, and 45.

Contoured crown piece has been identified herein as 306, 306*b*, 306*c*, and portion 386 in snaffle piece 376 supra. The contoured crown piece is shown in greater detail in FIGS. 46 and 47. The contour shape resembles opposed sine waves. The contoured crown piece is suitably designed to fit around and behind the horse's ears in the hollow formed by its skull best shown in FIGS. 27 and 29. This provides a broad load bearing surface across the poll as well as providing a comfortable fit for the horse.

The crown piece 306, 306*b*, 306*c*, and portion 386 of 376 has a first end 316, an opposite second end 318 and an intermediate portion 320 disposed between the first 316 and second end 318 (where the crown piece is 404, first end is 420, second end is 422 with the intermediate portion disposed between opposed ends). The intermediate portion 320 is fastened to the first end 316 (or 420) and to the second end 318 (or 422) or is integral with the first end 316 (or 420) or integral with the second end 318 (or 422). The intermediate portion 320 has a contoured portion 314 advantageously dimensioned and contoured to minimize pressure at the pressure point on the horse's poll behind its ears and to provide a broad load-bearing surface across the horse's poll.

The contoured portion 314 of the intermediate portion 320 has a width "W", a length "L", a pair of opposed sides 506, 508 across the width and a pair of opposed curved sides 510, 512 across the length. Sides 506 and 508 are preferably parallel to each other. Preferably, the length L of the intermediate portion 320 and length "L" of the contoured portion 314 are identical. Each side of the pair of opposed curved sides 510, 512 has a first concave portion 514 preferably continuous with a convex portion 516 preferably continuous with a second concave portion 518. The first concave portion 514 of each side of the pair of curved sides 510, 512 is aligned to form a first narrow portion 520. The convex portion 516 of each side of the pair of curved sides 510, 512 is aligned to form a broad portion corresponding to the width W. The second concave portion 518 of each side of the pair of curved sides 510, 512 is aligned to form a second narrow portion 522. One of the pair of opposed sides 506 is attached to or integral with the first end 316 (or 420) and the other of the pair of opposed sides 506 is attached to or integral with the second end 318 (or 422).

The length L of the contoured portion of the crown piece is sufficient in dimension to fit around and behind a horse's ears in a hollow formed by a horse's skull as best shown in FIGS. 27 and 29. The concave portions 514, 518 are sufficiently concave to follow the curvature around and behind the back of each of the horse's ears. The distance of the two narrow portions 520, 522 from each other is approximately the distance between centers of the backs of the horse's ears.

The width W of the broad portion of the contoured portion of the contoured crown piece provides a broad load-bearing surface across the horse's poll. Advantageously, the bearing surface becomes the poll and not the edge of the bones behind the ears. The contoured crown piece may be made of rigid woven materials or of leather or leather strap-like materials, shown in FIG. 47, or of resilient material 300, as is shown in FIG. 46. For a medium head sized horse the contoured portion preferably extends about 10 inches in length with the width W of the broad portion about 1 inch and the two narrow portion 520, 522 about one-half inch each.

In the most preferred embodiment, the contoured portion has a resilient portion 300 extending from 1% to 100% of the length L of the contoured portion 314. As shown in FIG. 46, in the most preferred embodiment, the resilient portion extends 100% of the length L and is made of an elastic material preferably a woven elasticized material. For a medium head sized horse, the woven elastic material is 10 inches in length and stretches one-half inch to ten and a half inches. For the embodiment shown in FIG. 47, similar dimensions are used as in the embodiment shown in FIG. 46.

Where the woven elastic material is used in cheek pieces of single bit or double bit bridles or in snaffle piece, or in an integral caveson cheek piece, snaffle pieces, or the cheek pieces (including integral caveson cheek pieces) have sufficient stretchability (or give) to allow the bit to sit comfortably in the horse's mouth so that pressure on the reins will not translate into pressure on the poll. The ensures that the horse remains comfortable and unstressed. The elasticized portion may range from 1% to 100% of the length of the cheek piece respective (bridle or integral caveson) or snaffle piece. A preferred embodiment of the cheek piece is the use of a single layer of elastic material extending to 100% of the length of the cheek piece. Most preferably there is no stitching or seams against the horse's face with the material affixed in other ways. In other embodiments the length of elastic material incorporated into the humane headgear of the present invention ranges from 1% to 100% of the length of the portion into which it is incorporated.

CURB DEVICES OF THE HUMANE HORSE HEADGEAR

The humane horse headgear of the present invention includes a curb device 600 for use with a curb bit 374. Referring now to FIGS. 35, 37, 46–60 wherein like numbers refer to similar parts, the curb device 600 is a curb chain 602

(FIGS. 48–54) or a curb strap 604 (FIGS. 55–60) dimensioned to fit under the horse's chin 43 and to releasably and adjustably attach to the curb bit 374. The curb chain 602 has chain links 606 therein, which can be used for adjustable attachment (FIGS. 48 and 54). The curb strap 604 is a strap 607 typically of leather or nylon. The curb device 600 has a pair of opposite ends 608, 610 with an intermediate portion 320*b* between the opposite ends. The opposite ends 608, 610 are secured to or extend from the intermediate portion 320*b*. The intermediate portion 320*b* extends under the horse's chin 43 and along the sides of the chin (FIGS. 35, 37 and 48). As is known in the art, the pair of opposite ends 608, 610 are releasably fastened to the curb bit 374. Thus, the opposite ends 608, 610 include harness ends 612 (leather or nylon) (FIGS. 49–52, 58–60) having buckles and fastening straps; or the opposite ends 608, 610 have sections of rope 614 fastened thereto (FIG. 53); or the opposite ends 608, 610 have rings (or chain links) (FIGS. 48–51 and 54) which attach to hooks for attachment to the curb bit 374 or combinations thereof, or any other devices for releasably fastening the opposite ends to the curb bit 374.

FIG. 48 is a perspective view of a preferred embodiment of the curb chain 602 of the curb device 600 of the present invention attached to a curb bit 374. The mouth piece of the curb bit 374 is not shown. The horse's chin 43 and nose 39 are shown in the phantom.

FIGS. 49–51 show plan views of alternate embodiments of the curb chain 602 of the curb device 600 of the present invention. Ends 608 are shown attached to harness ends 612. End 610 may be attached to harness ends 612 as shown in FIG. 52. Alternatively, as shown in FIG. 53, ends 608, 610 may be attached to rope 614 which ties onto bit 374, as is known in the art. Yet, alternatively, as shown in FIGS. 48, 49–51 and 54 ends 608, 610 are fastened to chain links 606 which may be adjusted by hooking an individual link 606 onto a hook 615. As is known in the art, ends 608, 610 may be releasably fastened in other ways and are included in the present invention.

Figure 55:
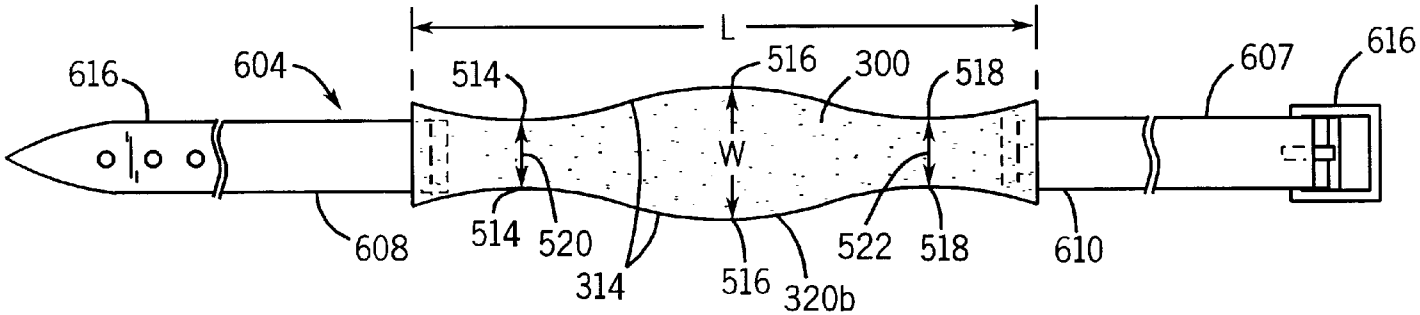
FIGS. 55–60 are plan views of alternate curb straps of the curb device of the present invention.
Figure 56:
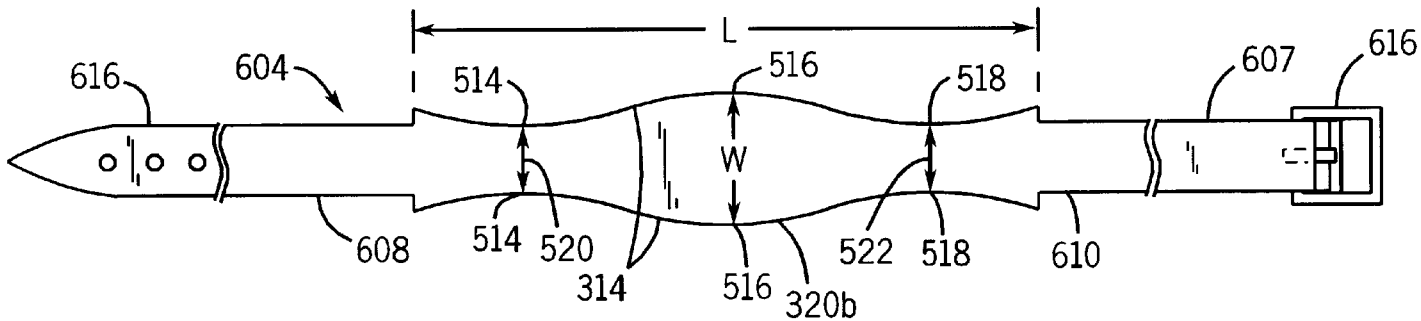
Figure 57:
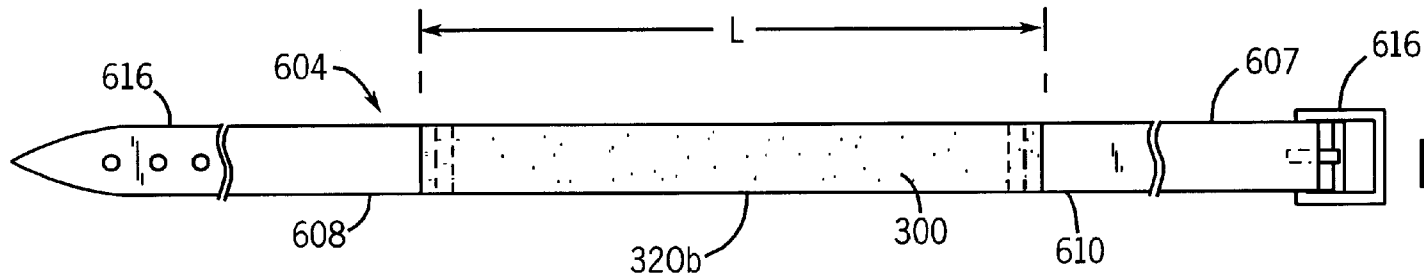
Figure 58:
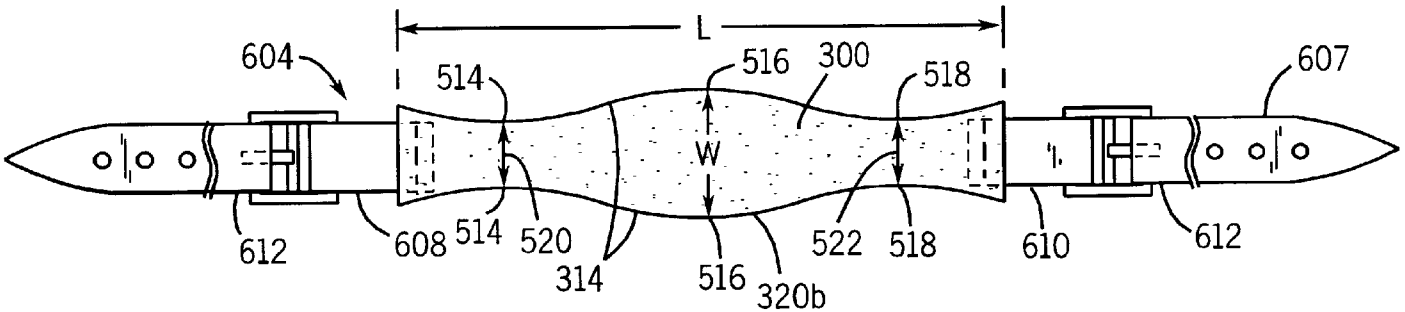

If the curb device 600 is a curb strap 604, each of the opposite ends 608, 610 may have a harness end 612 attached to or extending to the curb bit 374. FIGS. 58–60 show plan views of curb straps 604 of the present invention having harness ends 612 attached to opposite ends 608, 610. Alternatively, as is known in the art, the ends 608, 610 of curb straps 602 (FIGS. 55–57) may loop through the curb bit 374 and have fastening means 616 on either end 608, 610 to attach to each other. FIGS. 55–57 show plan views of curb straps 604 of the present invention having a fastening means 616 attached to opposite ends 608, 610.

The intermediate portion 320*b* of the curb device 600 of the present invention is constructed advantageously in three different ways, to provide comfort to the horse's mouth and chin when reins are pulled. Referring now to FIGS. 25, 35, 46, 48–49, 51–54, 55, 57–58 and 60, the intermediate portion 320 320*b* has a portion constructed of a resilient material 300, as previously described herein, extending from 1% to 100% of a length L of the intermediate portion 320*b*. The intermediate portion 320*b* is fastened to the chain links 606 in the curb chain 602 or is stitched or otherwise incorporated into strap 607 of the curb strap 604, or both (if there are chain links 606 before harness or nylon ends or fastening means). Alternatively, the intermediate portion 320*b* has a contoured portion 314, as shown in FIGS. 26, 46, 47, 48–50, 55–56 and 58–59. The contoured portion 314 is as previously described for the contoured portion 314 of the intermediate portion 320 of crown piece 306, 306*b*, 306*c*, 404 and portion 386 of 378 described above, which disclosure is incorporated by reference herein. Thus, concave portion 514 is numbered like contoured crown piece, supra. as detailed in FIGS. 46–47. In this instance the length of the intermediate portion 320*b* of the curb device 600 (curb strap 604 or curb chain 602) is sufficient in dimension to fit under the horse's chin and along the sides of the chin as best shown in FIGS. 35, 37 and 48. The concave portions 514, 518 are sufficiently concave to follow the curvature on the sides of the horse's chin 43. The distance of the two narrow portions 520, 522 from each other is approximately the distance to the chin groove (slot) on each side of the horse's mouth about 4–5 inches depending on the horse's size. The width W of the broad portion (convex portion 516) of the contoured intermediate section provides a lighter feel in the horse's mouth and creates less of a pull on the mouth when the reins are pulled. This provides a curb device 600 that is less harsh to the horse and provides less of a shock to the horse when the reins are pulled. The contoured intermediate portion 320*b* may be made of rigid woven materials or of leather or strap-like leather material, as shown in FIGS. 26, 37, 50, 56, and 59 or of a resilient material 300 as shown in FIGS. 46, 48, 49, 52–55, and 58. Preferably the intermediate portion 320*b* of curb device 600 of the present invention is both contoured and resilient as shown in FIGS. 46, 48, 49, 52–54, 55, and 58 with the width W approximately one inch, the narrow portions 520, 522 approximately one half inch and the length L, about four to five inches having a stretch of about one half inch for a medium horse's head 36. For the non-resilient embodiment of the curb device 600 shown in FIGS. 26, 37, 50, 56 and 59 and the W, L and narrow portion dimensions are as recited above. The resilient material is preferably an elastic, most preferably a woven elastic and extends from 1% to 100% of the length L of the intermediate portion 320*b* of the curb device 600. Where the curb device 600 has an intermediate portion 320*b* with resilient material 300 therein as shown in FIGS. 25, 35, 51, 57, and 60, the resilient material 300 is preferably two and a half inches long (L) and one half inch wide with a stretch of one half inch. The incorporation of the resilient material is as previously disclosed in association with other embodiments of the humane horse headgear of the present invention.

Although an exemplary embodiment of the humane horse headgear of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A humane horse headgear comprising one or more portions encircling and conforming to a horse's head, at least one of the one or more portions constructed at least in part of an elastic material;

wherein the one or more portions constructed at least in part of an elastic material permit limited movement of one or more parts of the horse's head while at the same time exerting progressive resistance in response to movement of the one or more parts of the horse's head; and wherein the one or more portions constructed at least in part of an elastic material are sufficiently elastic that movement of one or more parts of the horse's head can not stretch said elastic material to its elastic limit.

2. The humane horse headgear as defined in claim 1, wherein the elastic material in the one or more portions is disposed at one or more pressure points on the horse's head.

3. The humane horse headgear as defined in claim 1, wherein each of the one or more portions constructed of the elastic material has a portion length and the resilient material corresponds to 1% to 100% of the portion length.

4. The humane horse headgear as defined in claim 1, wherein the one or more portions encircling and conforming to the horse's head include at least one of a caveson, an integral caveson, a headstall of a bridle, and a snaffle piece for use with a bridle.

5. The humane horse headgear as defined in claim 1, wherein the one or more portions encircling and conforming to the horse's head include a headstall for a work halter or a show halter for a horse.

6. The humane horse headgear as defined in claim 1, wherein the one or more portions constructed of elastic material is comprised of at least one layer of elastic material.

7. The humane horse headgear as defined in claim 1, wherein the one or more portions constructed of a elastic material is constructed of two layers of elastic material, placed directly on top of each other and affixed together permanently.

8. The humane horse headgear as defined in claim 1, wherein the one or more portions constructed of a elastic material is comprised of at least one layer of a woven elasticized material that conforms to the shape of a horse's head at points of contact.

9. The humane horse headgear as defined in claim 1, wherein the humane horse headgear is a curb device for use with a curb bit, the curb device having a pair of opposed ends for fastening to the curb bit and an intermediate portion disposed between the pair of opposed ends, the intermediate portion having at least one of a elastic material therein and a contoured portion therein.

10. The humane horse headgear as defined in claim 1, wherein the humane horse headgear is a caveson comprising:

a first circular segment having a noseband, and a jaw strap attached to the noseband with the first circular segment encircling a horse's nose; and a caveson headstall attached to the first circular segment and encircling a horse's head and extending behind a horse's ear;

wherein the noseband has a portion constructed of the elastic material, and wherein at least one of the jaw strap and the caveson headstall have one or more portions constructed of the elastic material.

11. The humane horse headgear as defined in claim 10, the caveson further comprising a second circular segment encircling the horse's nose and attached to the first circular segment; wherein the second circular segment has a portion constructed of the resilient material.

12. The humane horse headgear as defined in claim 11, the caveson further comprising a caveson crown piece connected to the headstall and disposed on a forehead of the horse in front of a horse's ears, wherein the caveson crown piece has a portion constructed of the resilient material.

13. The humane horse headgear as defined in claim 1, wherein the humane horse headgear is a bridle comprising:

a) a head stall having the one or more portions encircling and conforming to the horse's head including:

i.) a crown piece disposed on an area on top of the horse's head, behind a horse's ears;

ii.) one or more pairs of cheek pieces connected to or extending from the crown piece, one cheek piece of each pair of the one or more pairs of cheek pieces disposed on either cheek on opposite sides of a horse's face, each cheek piece having an end bearing a bit attachment;

iii.) a brow piece connected to the crown piece and to the one or more pairs of cheek pieces, the brow piece disposed in front of a horse's ears and above a horse's eyes on a horse's brow;

iv.) a throat latch connected to or extending from the one or more pairs of cheek pieces, the crown piece and the brow piece; the throat latch disposed under a horse's jowl; and b.) a bit for resting on a horse's lower jaw on a horse's gums, behind a horse's teeth, the bit being attached to the bit attachment.

14. The humane horse headgear as defined in claim 13, wherein the bridle crown piece has a portion constructed of the elastic material.

15. The humane horse headgear, as defined in claim 13, wherein the one or more pairs of cheek pieces each has a portion constructed of the elastic material.

16. The humane horse headgear as defined in claim 13, wherein at least one of the brow piece and the throat latch has a portion constructed of the elastic material.

17. The humane horse headgear as defined in claim 13, wherein the bridle further comprises an integral caveson extending from or connected to the bridle crown piece.

18. The humane horse headgear as defined in claim 13, the bridle further comprising a snaffle piece and a snaffle bit, the snaffle piece having a portion constructed of the elastic material.

19. The humane horse headgear as defined in claim 13, wherein the bridle comprises a second bit, and wherein the one or more pairs of cheek pieces comprises two pairs of cheek pieces, each cheek piece of the two pairs of cheek pieces having a portion constructed of the elastic material, and wherein one pair of the two pairs of cheek pieces is attached to one bit and wherein the second pair of the two pairs of cheek pieces is attached to the second bit.

20. The humane horse headgear as defined in claim 13, wherein the bridle crown piece has a contoured portion shaped to provide a load-bearing surface disposed on a poll of a horse.

21. The humane headgear as defined in claim 20, wherein the contoured portion has a length and wherein the crown piece has an elastic portion extending from 1% to 100% of the length of the contoured portion.

22. The humane horse headgear as defined in claim 13, wherein the bridle crown piece and the one or more pairs of cheek pieces have a portion constructed of the elastic material.

23. The humane horse headgear as defined in claim 1, wherein the humane horse headgear is an integral caveson for use with a bridle having a crown piece, the integral caveson comprising a first circular segment encircling a horse's nose, and a pair of caveson cheek pieces extending from or connected to the crown piece, one cheek piece of the pair of caveson cheek pieces disposed on either cheek on opposite sides of a horse's face, and each cheek piece of the pair of caveson cheek pieces attached to the first circular segment.

24. The humane horse headgear as claimed in claim 23, wherein the first circular segment has a portion constructed of the elastic material.

25. The humane horse headgear as claimed in claim 23, wherein at least one of the jaw strap and the pair of caveson cheek pieces have one or more portions constructed of the elastic material.

26. The humane horse headgear as defined in claim 23, the caveson further comprising a second circular segment encircling the horse's nose and attached to the first circular segment.

27. The humane horse headgear as defined in claim 26, wherein the second circular segment has a portion constructed of the resilient material.

28. The humane horse headgear as defined in claim 1, wherein the humane horse headgear is a work halter, the work halter comprising a headstall having the one or more portions encircling and conforming to the horse's head, the headstall including:

a crown piece disposed on an area on top of the horse's head behind a horse's ears;

a pair cheek pieces connected to or extending from the crown piece, one cheek piece of each of the pair of cheek pieces disposed on either cheek on opposite sides of a horse's face;

a throat latch connected to or extending from the crown piece and the pair of cheek pieces, the throat latch disposed under a horse's jowl;

a noseband extending down the horse's face and above a horse's mouth and disposed over a horse's nose;

a jaw strap disposed under a horse's jaw; the noseband and the jaw strap attached to each other and encircling the horse's nose; each cheek piece of the pair of the cheek pieces attached to the noseband and to the jaw strap;

a connector strap connecting the jaw strap to the throat latch, the connector strap disposed under the horse's jaw.

29. The humane horse headgear of claim 28, wherein the crown piece has a portion constructed of the elastic material.

30. The humane horse headgear as defined in claim 28, wherein the noseband has a portion constructed of the elastic material.

31. The humane horse headgear as defined in claim 28, wherein each cheek piece of the pair of cheek pieces has a portion constructed of the elastic material.

32. The humane horse headgear as defined in claim 28, wherein the connector strap has a portion constructed of the elastic material.

33. The humane horse headgear as defined in claim 28, wherein at least one of the jaw strap and the throat latch has a portion constructed of the elastic material.

34. The humane horse headgear as defined in claim 28, wherein the crown piece has a contoured portion shaped to provide a load-bearing surface disposed on a poll of a horse.

35. The humane horse headgear as defined in claim 34, wherein the contoured portion has a length and wherein the elastic portion of the crown piece extends from 1% to 100% of the length of the contoured portion.

36. The humane horse headgear as defined in claim 28, wherein at least one of the crown piece, the pair of cheek pieces, the throat latch, the jaw strap, the noseband, and the connector strap has a portion constructed of the elastic material.

37. The humane horse headgear as defined in claim 1, wherein the humane horse headgear is a show halter, the show halter comprising a headstall having the one or more portions encircling and conforming to the horse's head including:

a crown piece disposed on an area on top of the horse's head behind a horse's ears;

a pair cheek pieces connected to or extending from the halter crown piece, one of each of the pair of cheek pieces disposed on a cheek on the side of a horse's face;

a throat latch connected to or extending from the halter crown piece and the pair of cheek pieces; the throat latch disposed under a horse's jowl; and a noseband disposed down the horse's face and above a horse's mouth and over a horse's nose.

38. The humane horse headgear as defined in claim 37, wherein the halter crown piece has a portion constructed of the elastic material.

39. The humane horse headgear as defined in claim 37, wherein the noseband has a portion constructed of the elastic material.

40. The humane horse headgear as defined in claim 39, wherein one or more of the crown piece, the noseband, or the pair of cheek pieces has a portion constructed of the elastic material.

41. The humane horse headgear as defined in claim 39, wherein the elastic material is surgical tubing.

42. The humane horse headgear as defined in claim 37, wherein each cheek piece of the pair of cheek pieces has a portion constructed of the elastic material.

43. The humane horse headgear as defined in claim 37, wherein the halter crown piece has a contoured portion shaped to provide a load-bearing surface disposed on a poll of a horse.

44. The humane headgear as defined in claim 43, wherein the contoured portion has a length and wherein the elastic portion of the crown piece extends from 1% to 100% of the length of the contoured portion.

45. A curb device for use with a curb bit, the curb device comprising:

a pair of opposed ends adapted for fastenably attaching to the curb bit; and an intermediate portion disposed between the pair of opposed ends;

wherein the intermediate portion has a contoured portion having:

a width;

a length;

a pair of opposed sides across the width; and a pair of opposed curved sides across the length, each side of the pair of opposed curved sides having a first concave portion continuous with a convex portion continuous with a second concave portion, wherein the first concave portion of each side of the pair of curved sides is aligned to form a first narrow portion, and wherein the convex portion of each side of the pair of curved sides is aligned to form a broad portion, and wherein the second concave portion of each side of the pair of curved sides is aligned to form a second narrow portion;

wherein one of the pair of opposed sides across the width is attached to, or extends from the first end and the other of the pair of opposed sides across the width is attached to, or extends from the second end; and wherein the intermediate portion is constructed to provide lessened strain on a chin of a horse wearing the curb bit when reins attached to the curb bit are pulled.

46. The curb device, as defined in claim 45, wherein the intermediate portion is constructed of an elastic material extending from 1% to 100% of the length of the contoured portion.

47. A humane horse headgear comprising one or more portions encircling and conforming to a horse's head, at least one of the one or more portions being constructed at least in part of an elastic material;

wherein the one or more portions constructed at least in part of an elastic material permit limited movement of one or more parts of the horse's head while at the same time exerting progressive resistance; and wherein the one or more portions constructed at least in part of an elastic material are disposed at one or more pressure points on the horse's head, said pressure points comprising a poll of a horse, a nose of a horse, and a bridge of the nose of a horse; and wherein the one or more portions constructed at least in part of an elastic material are sufficiently elastic that movement of one or more parts of the horse's head can not stretch said elastic material to its elastic limit.

48. A humane horse headgear as defined in claim 47, wherein each of the one or more portions constructed at least in part of the elastic material has a portion length, wherein the elastic material comprises to 1% to 99% of the portion length.

49. A humane horse headgear as defined in claim 47, wherein the one or more portions encircling and conforming to the horse's head include at least one of a caveson, an integral caveson, a headstall of a bridle, and a snaffle piece for use with a bridle.

50. A humane horse headgear as defined in claim 47, wherein the one or more portions encircling and conforming to the horse's head include a headstall for a work halter or a show halter for a horse.

51. A humane horse headgear as defined in claim 47, wherein at least one of the one or more portions constructed at least in part of an elastic material is comprised at least in part of one layer of elastic material.

52. A humane horse headgear as defined in claim 47, wherein the one or more portions constructed at least in part of an elastic material is constructed of two layers of elastic material, placed directly on top of each other and affixed together permanently.

53. A humane horse headgear as defined in claim 47, wherein the one or more portions constructed at least in part of an elastic material is comprised of at least one layer of a woven elasticized material that conforms to the shape of a horse's head at points of contact.

54. A humane horse headgear as defined in claim 47, wherein said one or more pressure points further comprise a chin of the horse's head; and wherein the one or more portions constructed at least in part of an elastic material are disposed at the chin of the horse's head.

* * * * *